US006205713B1

(12) United States Patent
Thompson et al.

(10) Patent No.: US 6,205,713 B1
(45) Date of Patent: Mar. 27, 2001

(54) HURRICANE/STORM PROTECTION FOR WINDOWS/DOORS

(76) Inventors: Thomas Thompson, 92-543 Kokole Pl., Makakilo, HI (US) 96707; John Rasmus Thompson, 3267 Stuart St., Denver, CO (US) 80212

( * ) Notice: Subject to any disclaimer, the term of this patent is extended or adjusted under 35 U.S.C. 154(b) by 0 days.

(21) Appl. No.: 09/087,728

(22) Filed: May 29, 1998

Related U.S. Application Data

(63) Continuation of application No. 08/597,194, filed on Feb. 6, 1996, now abandoned.

(51) Int. Cl.[7] ..... E06B 3/68
(52) U.S. Cl. ..... 49/465; 49/50; 49/61
(58) Field of Search ..... 49/394, 395, 398, 49/62, 63, 56, 57, 463, 464, 465, 50; 52/202

(56) References Cited

U.S. PATENT DOCUMENTS 563,430 * 2/1896 Strain ..... 282/16
1,830,789 * 11/1931 Foster ..... 49/67
2,975,491 * 3/1961 Paul et al. ..... 49/67
3,167,828 * 2/1965 Hutchisson, Jr. ..... 49/67
4,389,135 * 6/1983 Peters ..... 403/327
4,478,002 * 10/1984 English ..... 49/57
4,756,122 * 7/1988 Snapka ..... 49/57
5,487,244 * 1/1996 Hill ..... 52/202
5,540,018 * 7/1996 Biggers ..... 52/202
5,737,874 * 4/1998 Sipos et al. ..... 49/67

* cited by examiner

*Primary Examiner*—Daniel P. Stodola
*Assistant Examiner*—Curtis A. Cohen

(57) ABSTRACT

A shutter for withstanding hurricane wind and pressures has permanent hardware attached to a structure and a temporary shutter that can be stored until needed. Hardware consists of brackets mounted above or below a window and sliding latches at the edges of the window. Sliding latches have a key way for a carriage bolt to enter and attach. Brackets allow a shutter that has attached hinges to latch and pivot around a bridge. The shutter can be made from any material. Hinges are attached to shutter and are able to be latched and pivoted on the brackets mounted on the house. The shutter can also be swung up to protect a high window. The shutter is swung over the window and locked down to sliding latches and carriage bolts with wing nuts through holes in shutter.

6 Claims, 69 Drawing Sheets

HURRICANE/STORM PROTECTION FOR WINDOWS/DOORS

REFERENCE TO PRIOR APPLICATIONS

This is a continuing application of prior application Ser. No. 08/597,194 filed Feb. 6, 1996, now abandoned.

BACKGROUND—FIELD OF THE INVENTION

The invention relates to a shutter, fastener, and locking mechanism that provides an easy to install means of protecting door and window openings from hurricanes, strong winds, rain, wind-blown debris, and vandals.

BACKGROUND—DESCRIPTION OF PRIOR ART

Background

Studies of damage from Hurricanes Hugo, Andrew, and Iniki show that most of the damage to a home was from the wind or wind-borne missiles that broke a window and let rain and wind into the home. Once the wind was inside a home, the resulting pressure helped lift the roof off the house. Shutters can help keep the wind and rain from entering a home during strong winds.

During Hurricane warnings, plywood is usually nailed over windows and patio doors to prevent wind-driven rain and debris from breaking the window and entering the house. Nailing sheets of plywood over windows is difficult on many homes, and it could take too much time to secure a cover over each window. Strong winds can rip down nailed-up plywood; and roll-down shutters and louvered shutters are equally ineffective (Fine Homebuilding, 1992).

Homeowners are usually reluctant to drive nails into their window frames or do not want to be on a ladder during high winds. An individual can not hold up a large, heavy piece of plywood and nail it in at the same time When a hurricane is expected, often the building suppliers run out of plywood.

Plywood nailed to a window frame can be blown out of a building due to the high pressure inside a building compared to the low pressure outside during high winds. This is due to the Bernoulli effects, where wind blowing around and over a building causes lower pressure than the high pressure air inside, and sucks out a window, wall, or roof.

An airplane rises due to the pressure differential of faster air moving over a wing, compared to the high pressure of slower moving air under a wing. So too does the side walls blow out of a house due to the Bernoulli effects of wind blowing perpendicular to the wall. Gable ends blow out of a house, because of higher pressure in the house compared to the extremely low pressure on the leeward edge of the wind direction.

Once the window, side wall, or gable end of a house is blown out, the rigidity of the roof and entire house is compromised due to wind getting into the house. Driven rain, along with the wind can damage everything in the house, along with damaging the structural integrity of the roof and walls of the house.

Previously, homeowners thought that they could prevent their walls from being blown out by opening windows to relieve the high pressure on the leeward and sides of a house, but the open windows on the windward side let in wind and rain. If windows are open on the leeward side only, the wind can rapidly change direction and blow into the windows. The wind must go somewhere, and would blow out the walls or roof as it sought a way out. The resulting damage negates any advantage of trying to ease the pressure differential.

This invention automatically helps relieve the pressure differential between the inside and outside of a house that's under the stress of a wind storm, while preventing wind and rain from entering the house. The invention is simple to install, economical, and can fit on a wide variety of houses.

The current fad of testing shutters is by shooting a 2×4 into the shutter to test its strength. This simulates a roof rafter being blown into the shutter from a neighbor's house. My previous patent application Ser. No. 08/191,852 helps keep the rafter and roof on a house, and would prevent many of these missiles.

The factual odds of a 2×4 being blown head-on into a window shutter is minuscule. Actually, a 2×4 fired headed-on into a building would go through most wood-frame and concrete-block walls. Studies after Hurricane Andrew show that the most common projectile was roof shingles and roof tiles; and when roof tiles go airborne, they damage neighboring buildings (Miller, 1992).

One new advantage of this invention is that any type of covering can be used for the shutter. Plywood was used in the past because it was readily available, strong, inexpensive, easy to store, and could be cut to fit windows by most homeowners using simple tools. The major problem was with the installation.

No one wanted to be on a ladder during windy conditions, especially trying to hold the heavy plywood sheet with one hand and trying to hammer a nail with the other. That leaves no hands to hold the nail or hold on to the ladder—an unsafe situation.

Plywood can still be used as the shutter material for this invention, but steel and other stronger, lighter, and cheaper materials can be used including new materials as they become available. Researchers testing shutter material claim that thin steel walls are more effective at stopping hurricane debris than thick wood, and the most effective material was 22-gauge steel backed with a thin layer of rubber (Civil Engineering, 1994).

This is good information, but thin sheets of steel with rubber are not readily available to a homeowner. Nevertheless, if it was obtainable, it could be used as the shutter material for this invention.

When thin sheets of steel are corrugated, pleated, or formed into parallel ridges, the resulting shutter cover is stronger than flat steel. Bending the sheets of steel work-hardens it and strengthens the bends. Corrugated metal sheets, used as a shutter cover, are stronger than steel with rubber, and could withstand larger and faster wind-blown missiles. Standard corrugated steel sheets may be used with this invention as a shutter cover, but this invention includes a unique corrugated metal shutter.

Other materials can also be used for the cover such as sheets of aluminum, which are light, recyclable, strong, non-rusting, and relatively easy to cut with power equipment, Kevlar©, fiberglass, rubber sheets, or any strong, lightweight material could also be used for the cover.

Bamboo has recently been used as flooring because it is attractive, wears well, and can be sanded and refinished. Bamboo can be weaved, is flexible and can bend, and can have resins added to make a product as strong as fiberglass. Unlike timber, bamboo is a plentiful grass that regenerates itself quickly from existing root systems after being cut. Bamboo forests are not clear-cut, but are maintained by harvesting mature stalks which makes room for new shoots to grow (Home Mechanix, 1995). In the tropics, bamboo would make a good cover for a shutter and would be environmentally attractive.

Shutters should be bolted to a building (Fine Homebuilding, 1992). During Hurricane Andrew, ¾-in. plywood bolted over a window sustained several hits from tree limbs, but nothing came through (Fine Homebuilding, 1992). Even with modern weather forecasting, there would not be enough time to bolt plywood to each window of a house. This invention has brackets permanently attached to the framing members of a house for quick and easy positioning of a shutter with companion hardware.

Another important advantage of this invention is that the grooves or ridges help relieve pressure differential in and outside a house.

Concrete-Block Houses

In Florida, most of the homes are made of concrete-block walls. The window and patio frames are not set flush with the outside wall, but are set part-way into the thick walls. Many of the window frames and patio doors are made of aluminum alloy and may not be secured correctly to the concrete-block.

To fit into the window opening, a sheet of plywood would have to be cut very accurately. Plywood boards stored for use during a hurricane could warp in the humid climate that is prevalent in Florida, and would not fit into the window opening without alterations.

Sometimes there is only a thin part of the window frame exposed in the window well opening. It is very difficult to nail or screw a sheet of plywood into the narrow exposed part of the window frame. Caulking may be set next to the window well and window frame, and there may be voids next to some window frames. Nails in caulk or voids would not form a secure fastening for the plywood board.

In a concrete-block wall, the window frame is not a structural member of the wall and does not provide any load of the roof, hence it is not very strong. This invention does not attach to the weak window frame of a concrete-block home, but instead attaches to the wall itself. Since the wall has about equal strength around the window, this invention can be mounted on the top, sides, or bottom of the window.

By being attached to the concrete block outside the window well, the plywood sheet does not have to be cut accurately. Even if the board warped, it would still fit over the window well opening and keep out wind and rain. Only small plates are permanently attached to the cinder block wall and they can be painted to match the wall.

Wood-Frame Buildings

In many areas along the East and Gulf Coasts, outside of Florida, and in Hawaii, many of the homes are built of wood. There are two major types of wood-frame houses: platform or stud wall construction, and post-and-beam construction.

In platform framing, the wall sections consist of studs that support the roof or second floor. Wood framing around a window or door opening consists of headers and trimmers which are usually double (or more) the thickness of the wall framing. This extra framing helps provide structural rigidity to the wall, where the wall studs are missing from the window or door area.

On wood-framed houses, the window is sometimes flush with the outside sheathing, but may extend out beyond the sheathing and be framed with wood trim. The header board above the window provides a strong attaching point to affix the hinge plate of this invention. Doors would have similar construction framing and a patio door (sliding-glass) and garage door would have stronger headers and trimmers.

In Hawaii and the Caribbean, many of the homes are built using post-and-beam construction. One of the chief structural advantages of this type of construction is the simplicity of framing around door and window openings.

Since the roof loads are carried by fewer, but stronger timbers, large openings can be framed without the need for headers. Wide window walls are formed by merely inserting window frames between the posts and beams.

Some windows are fixed or non-opening windows which provide daylight and a view of the outdoors. Jalousie windows are also common in tropical areas because they provide excellent ventilation. Both windows are weak against wind and rain, and must be protected by shutters during high winds.

Some houses in Hawaii and the Caribbean have jalousie wood louvers under large non-opening windows that provide ventilation. Shutters are also needed on these louvers to protect them from strong winds, and prevent wind and rain from entering the house.

On post-and-beam houses, the window frame is commonly extended out beyond the outside sheathing and framed with wood trim pieces. The beam above the window provides a strong anchor point for the hinge plate of this invention. The bottom and side frame of the window, which attaches to the posts, forms a strong attaching point for the locking mechanism.

Description of Prior Art

A number of shutter systems are presently marketed to homeowners that are permanently attached to the house. Some of these shutters roll down over a window from an attached compartment, and some are screwed in. Many homeowners dislike prior shutters for many reasons, but mostly because they are complicated, heavy, unreliable, expensive, take a lot of time to deploy, take tools to deploy, or do not match the color and architecture of the house.

Several recent types of shutter systems have been patented including U.S. Pat. No. 4,248,022 (1981) to Walker, U.S. Pat. No. 4,333,271 (1982) to De Paolo et al, U.S. Pat. No. 4,384,436 (1983) to Green, U.S. Pat. No. 5,228,238 (1993) to Fenkell, U.S. Pat. No. 5,335,452 (1994) to Taylor, U.S. Pat. No. 5,345,716 (1994) to Caplan, U.S. Pat. No. 5,347,775 (1994) to Santos, and U.S. Pat. No. 5,383,315 (1995) to Birs.

All are good inventions, but they are not inexpensive, they are not simple, they contain complex hardware, they cannot be installed quickly, they cannot fit wood, concrete-block, and masonry houses, they cannot be installed on the top, bottom, or side of a window, they cannot use different types and thicknesses of material for the shutter, they cannot be installed on the inside of a house, some are too thick to be stored easily, they do not help equalize the inside and outside air pressure during a hurricane, and the hardware is bulky and unattractive on a house.

OBJECTS AND ADVANTAGES

Objects of this invention are to easily, quickly, and economically protect windows, doors, and houses from the destructive winds of hurricanes. It is a further object of this invention that the shutters will not be permanently attached to the house, except for modest plates. It is a still further object that windows that are higher off the ground can be protected without having to be on a ladder during a windstorm.

Another objective is to make the installation procedure simple, so that a handy homeowner can install the shutter hardware. A further object is that this invention can be used on various size window and door openings, various types of houses, and can hinge from the top, bottom, or sides. Another objective is the shutter can be made out of any material including plywood, steel, corrugated steel, aluminum, bamboo, kevlar©, fiberglass, rubber sheets, or any strong, lightweight material.

A still further object is for the invention to be retro-fit onto new and old homes made of wood, concrete-block, or masonry. Another object is for the shutters to be installed inside buildings, such as multi-story apartment houses, where they are too high off the ground to reach from the outside.

A fresh object for this hurricane shutter, that no previous shutter ever accomplished, is to bleed high pressure air from the house, without letting wind or rain inside, thereby preventing the hurricane from blowing out the windows, roof, or walls. Another object is to retain the shutter cover over the window and door to prevent vandalism after a hurricane has passed. Further objects and advantages of my invention will become apparent from a consideration of the drawings and ensuing description.

These and other objectives of the invention are achieved by a system of simple and economical connectors that allow a homeowner to quickly and easily protect a window or door with a strong covering.

This invention includes several embodiments in order to fit on wood, concrete-block, and masonry houses. Some embodiments are specialized for the type of house; some can be installed in a vertical or horizontal position and some can be installed above, below, or to one side of the window. Several embodiments also use different manufacturing techniques including manipulated sheet metal, casting, forging, extrusion, and plastic molds or injection. Advantages of each will be discussed in the description.

BRIEF DESCRIPTION OF THE DRAWINGS

FIG. 29B is a perspective view of a corrugated steel sheet with tee slots.

FIG. 29C is a perspective view of a tee bar and tee hooks.

FIG. 29D is a perspective view of a corrugated steel sheet and tee bar.

Reference Numerals in Drawings

Figure 1A:
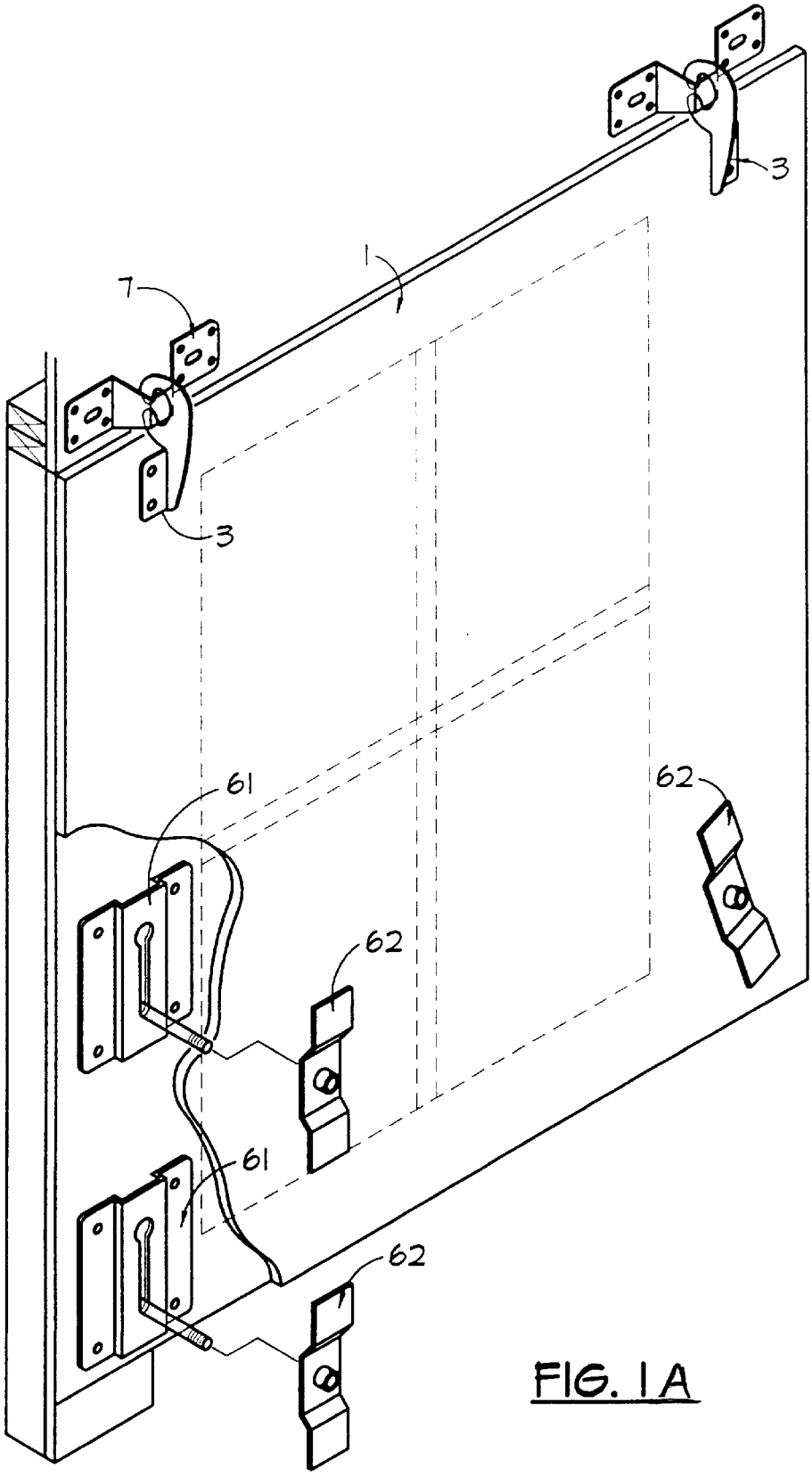
FIG. 1A is a perspective view of the invention protecting a window.

| | |
|---|---|
| 1 | Shutter cover |
| 2 | Sheet metal plate |
| (vertical) | |
| 3 | Sheet metal hinge |
| 4 | Nail holes |
| 5 | Lag bolt holes |
| 6 | Hinge holes |
| 6A | Width |
| 6B | Height |
| 7 | Sheet metal plate |
| (horizontal) | |
| 8 | bend lines |
| 8A | Bridge |
| 8B | Relief |
| 8C | Stature |
| 8D | Ample |
| 8E | Angled droop |
| 8F | Bear bend |
| 8G | Honest bend |
| 8H | Liberal |
| 8J | Span |
| 8K | Liberty bend |
| 8L | Corner bend |
| 8M | Window bend |
| 8N | Valley bend |
| 8P | Hill bend |
| 8Q | Junction bend |
| 8R | Interchange bend |
| 8S | Crossing bend |
| 8T | Balance |
| 8U | Veer bend |
| 8V | Solution bend |
| 8W | Core bend |
| 8X | Favored bend |
| 8Y | Convenient bend |
| 8Z | Timely bend |
| 9 | Alignment indentations |
| 10 | Straight sides |
| 11 | Bolts |
| 12 | Top hook |
| 13 | Bottom hook |
| 14 | Base member |
| 14A | Right-angle bend |
| 15A | Web component |
| 15B | Web segment |
| 16 | Locating pin |
| 17 | Cast metal plate |

-continued

| Reference Numerals in Drawings | |
|---|---|
| 18 | Cast metal hinge |
| 19 | Round rod |
| 20 | Narrow channel |
| 21 | Wall base |
| 22 | Flat cuts |
| 23 | Bolt holes |
| 24 | Slot |
| 25 | Shoulder |
| 26 | Outer hook |
| 27 | Inner hook |
| 28 | Support ledge |
| 29 | Bottom web |
| 30 | Stop tab |
| 31 | Round web |
| 32 | Metal staple |
| 32A | Adjustable metal staple |
| 33A | Male staple |
| 33B | Shaft |
| 33C | Female staple |
| 33D | Cranny |
| 34A | Staff |
| 34B | Hollow |
| 34 | Flattened tube |
| 35 | Bar member |
| 35A | Lengthened bar member |
| 36 | Scalloped metal plate |
| 37 | Scallops |
| 37A | Modest bend |
| 37B | Shallow bend |
| 37C | Knurled |
| 38 | Top plate tab |
| 39 | Expansion slot |
| 40 | Cylindrical core |
| 41 | Tower |
| 42 | Stops |
| 43 | Cross bar |
| 44 | Adjustable metal staple |
| 45 | Handle plate |
| 46 | Backing |
| 47 | Pivot opening |
| 48 | Jay hook |
| 48A | Top jay hook |
| 48B | Side jay hook |
| 49 | Handle hook |
| 50 | Handlebar |
| 50A | Window |
| 50B | Window flap |
| 51 | Ceiling hook |
| 52 | Hanging hook |
| 53 | Ceiling plate |
| 54 | Spring latch |
| 55 | Base element |
| 56 | Housing |
| 56A | Plunger |
| 57 | Spring |
| 58 | Locating pin |
| 58A | Locating slot |
| 59 | Angle-iron tab |
| 60 | Wire |
| 61 | sliding latch |
| 62 | Knock off |
| 63 | Backbone |
| 64 | Corrugated handle plate |
| 65 | Corrugation tab |
| 65A | Slope tab |
| 65B | Hill tab |
| 66 | Corrugated steel sheet |
| 67 | Augmentation |
| 68A | Valley |
| 68B | Slope |
| 68C | Hill |
| 69 | Locking latch |
| 70 | Foundation web |
| 70A | Aperture web |
| 70B | Left locking tab |
| 70C | Right locking tab |
| 71 | Pole hole |

-continued

| Reference Numerals in Drawings | |
|---|---|
| 71A | left locking hole |
| 71B | Right locking hole |
| 72 | Slave lock |
| 73 | Support web |
| 73A | Perforation web |
| 74 | Metal rod |
| 74A | Sturdy bend |
| 74B | Dogleg |
| 74C | Metal tee-bar |
| 74D | Tee handle |
| 74E | Bullet end |
| 74F | Yew hook |
| 74G | Simple bend I |
| 74H | Simple bend II |
| 74J | Simple bend III |
| 75 | Common lock |
| 76 | Double hook |
| 77 | Double plate |
| 78 | Double ceiling hook |
| 79 | Double ceiling plate |
| 80 | Washer |
| 80A | Carriage bolts |
| 80B | Carriage holes |
| 80C | Square shank |
| 81 | Keyway |
| 81A | Keyway opening |
| 82 | Mainstay |
| 83 | Footing |
| 83A | Wings |
| 83B | Footing hole |
| 84 | Screw stud |
| 84A | Threads |
| 84B | Lip |
| 85A | Flat steel |
| 85B | Rigid tabs |
| 86 | Cinch latch |
| 86A | Straight pin |
| 86B | Cross pin |
| 86C | Rod loop |
| 87A | Needle bend |
| 87B | Sharp bend |
| 87C | Hairpin bends |
| 88 | Yew latch |
| 89A | Basis web |
| 89B | Impound tab |
| 89C | Comfortable web |
| 89D | Impound hole |
| 90 | Tee slot opening |
| 90A | Tee slot |
| 91 | Cable latch |
| 91A | Cable web |
| 91B | Safe bend |
| 91C | Buttress web |
| 91D | Cable holes |
| 91E | Swaged cable |
| 92 | Latch bar |
| 92A | Cinch holes |
| 92B | Cinch bend |
| 93 | Teebar |
| 93A | Tee hooks |
| 93B | Stiffen bends |
| 93C | Pivot |
| 93D | Tee wings |
| 93F | Bolt holes |

DESCRIPTION AND OPERATION

Figure 1B:
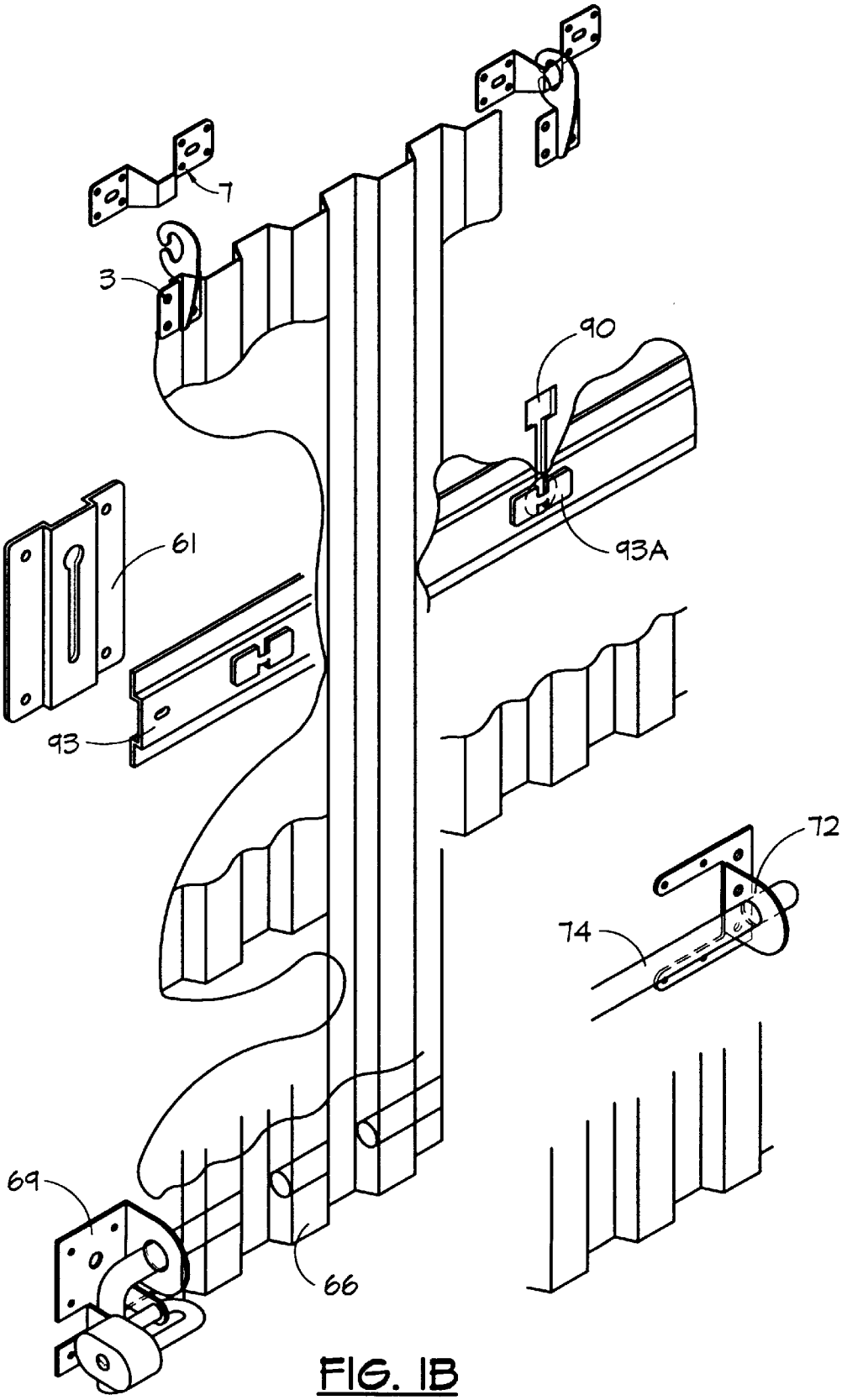
FIG. 1B is a perspective view of one embodiment protecting a window.
Figure 1C:
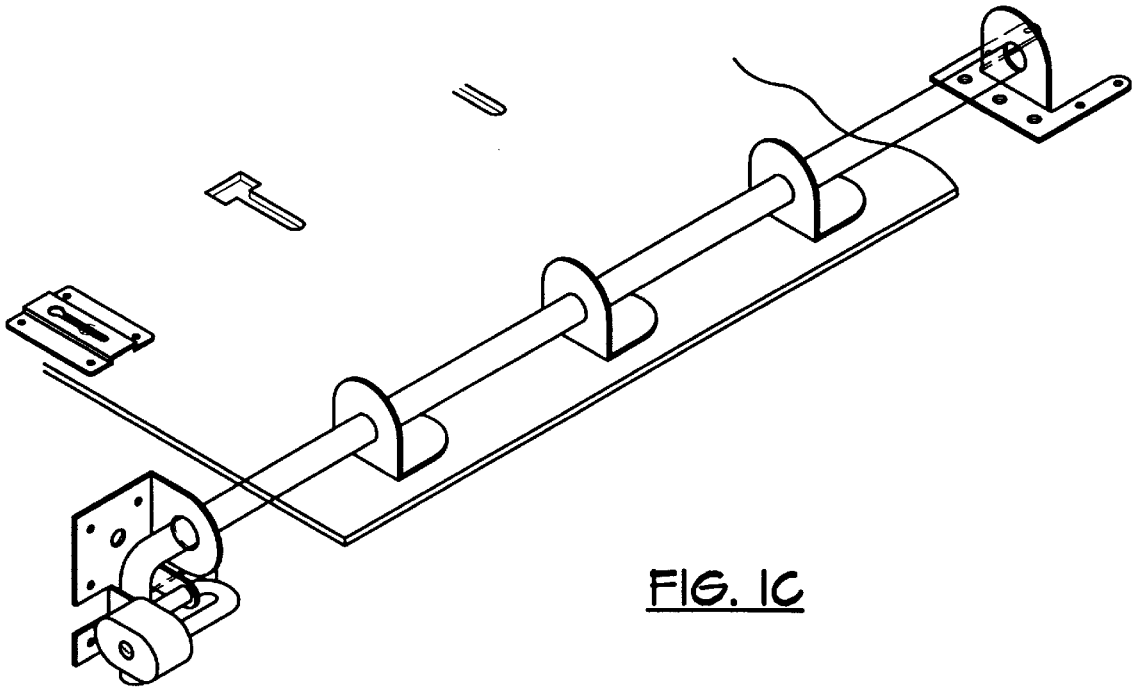
FIG. 1C is a perspective view of a system using the locking latch.

Refer now to FIG. 1A and 1B which are perspective drawings of a window on a wood-frame house, underlying a protective shutter cover 1 using different embodiments of the invention. On FIG. 1A, the shutter cover 1 is held securely above the window by horizontal sheet metal plates 7, stationary receiving brackets 7. Each stationary receiving bracket 7 having a receiving ledge 71 and a web 72 and 73 for attaching the bracket to a wall, and sheet metal hinges 3 comprising a planar web 31 and a hook 32. Each hook 32 having an arcuate upper portion 33 and a lower arcuate portion 34 describing a gap 35. The sheet metal plate 7 is attached to an outside wall above a window; the sheet metal hinge 3 is attached to a shutter cover 1 that protects the window. The shutter cover 1 is locked to the wall and below the window by sliding latches 61 and wing nuts 62 each latch describes a slot 67 for receiving a fastener 68 having a head 69. FIG. 1B shows a corrugated steel sheet 66 and related hardware, and is described in detail in FIGS. 25A, 29A–D, 24A, 22A and 23A. FIG. 1C is a perspective view of locking hardware and is described in detail on FIG. 25A.

Figure 2:
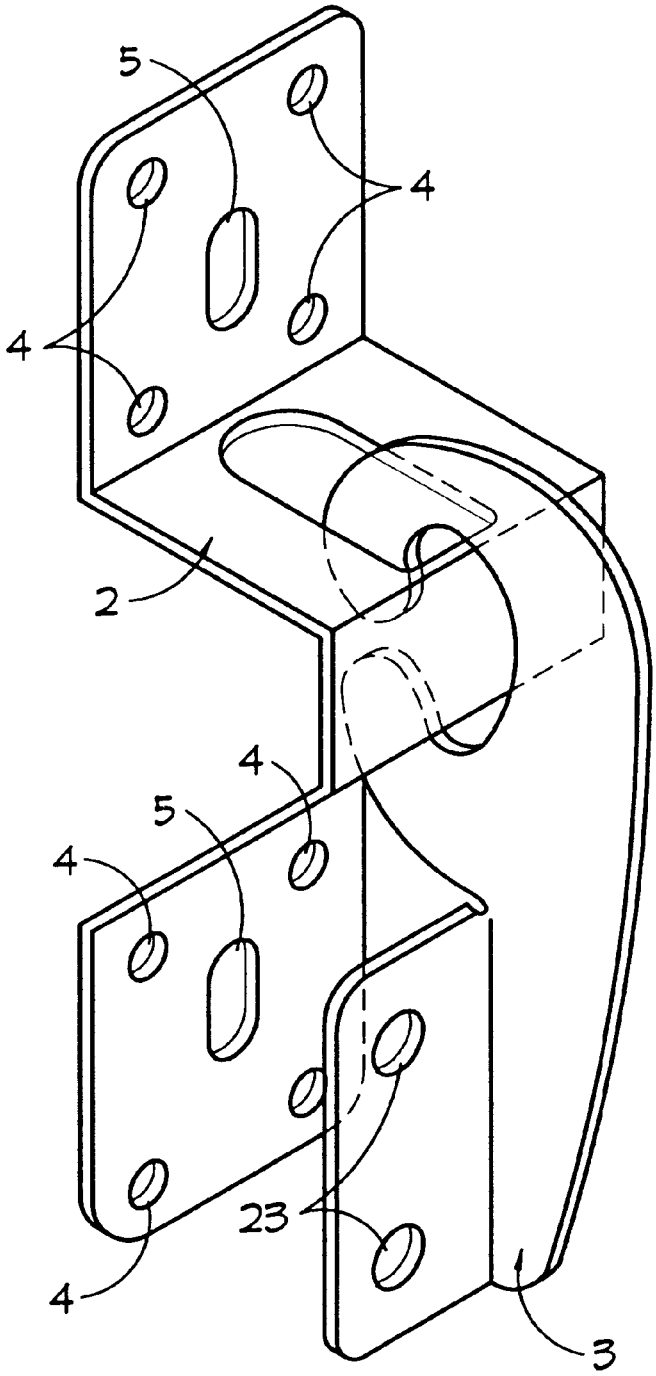
FIG. 2 is a perspective view of a sheet metal plate and sheet metal hinge.

FIG. 2 shows a close up view of a similar embodiment of the invention. A vertical sheet metal plate 2 is shown attached to the outside of a wood-frame house, above, below, or to the side of a window. Depending on the type of house, the vertical position allows nails, screws, and lag-bolts driven through the sheet metal plate 2, at nail holes 4 and lag bolt holes 5, to connect with structural members framing the window. Nails and lag-bolts are used to attach the plate 2 to a building.

Also shown in FIG. 2 is the sheet metal hinge 3. If the sheet metal plate 2 is installed above a window in this figure, then the sheet metal hinge 3 is shown in the down locked position with the sheet metal plate 2. A shutter cover 1 would be previously attached to the bottom part of the sheet metal hinge 3 by bolts and nuts, (omitted for clarity) through bolt holes 23.

Figure 3A:
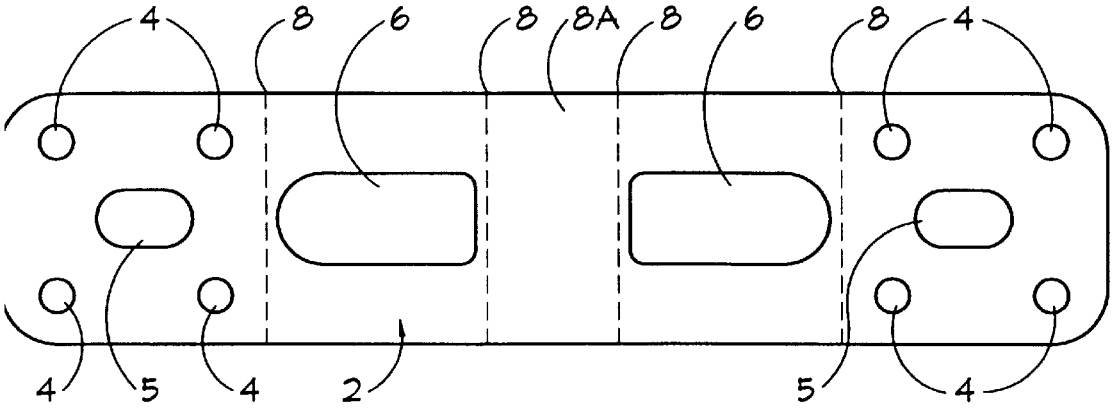
FIG. 3A is a flat pattern layout of a sheet metal plate.

Refer now to FIG. 3A which is a flat-pattern layout of a vertical sheet metal plate 2 prior to bending by standard tool and die methods. FIG. 3A shows that the sheet metal plate 2 has a generally rectangular shape, bend lines 8, nail holes 4, bolt holes 5, and hinge holes 6. The bend lines 8 are the preferred location for bending of the sheet metal.

Figure 3B:
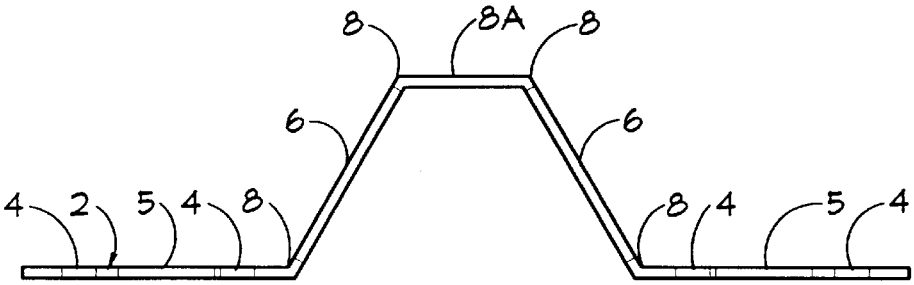
FIG. 3B is a side view of sheet metal plate.

FIG. 3B shows a side view of a sheet metal plate 2 after stamping and bending by standard tool-and-die methods. The bend lines 8 allow the middle bridge 8A of the sheet metal plate 2 to be spaced away from the house wall allowing clearance for attaching, locking, rotating, and detaching the sheet metal hinge 3 through the hinge holes 6. This distance away from the wall allows high air pressure to escape from the leeward side and sides of a house. The four radiuses, at the bend lines 8, work-hardens the steel and forms a trapezoidal shape, which is stronger against pushing and pulling forces during a hurricane.

FIG. 3B also shows the nail holes 4, bolt holes 5, and hinge holes 6 as dashed lines. This view shows how the bend lines 8 form the middle bridge 8A which supports and locks the sheet metal hinge 3, after it is attached to the hinge holes 6 at about 45° to the wall.

Figure 3C:
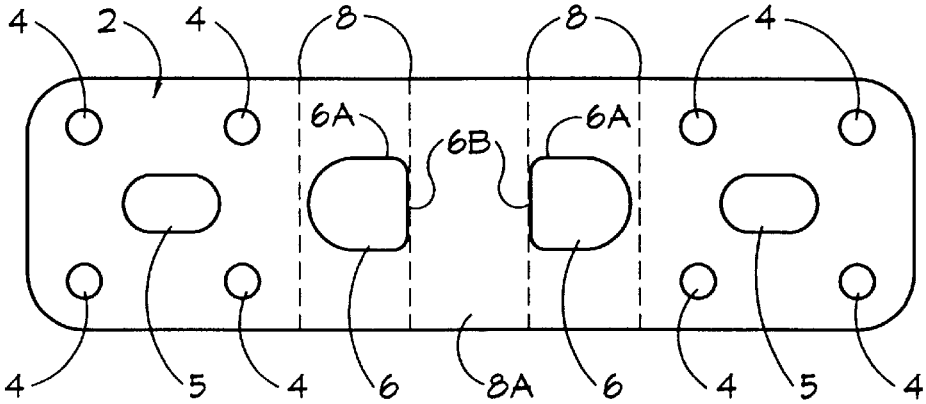
FIG. 3C is a front view of sheet metal plate.

FIG. 3C is a front view of a vertical sheet metal plate 2 after bending and looking through the hinge hole 6. The nail holes 4 and bolt holes 5 are shown as dashed lines. The bend lines 8 show how they form space for the hinge hole 6 to be used as an anchor for the sheet metal hinge 3. The bend lines 8 also form the middle bridge 8A which supports and locks the sheet metal hinge 3 when attached.

FIG. 3C shows a front view of a sheet metal plate 2 as it would look attached to an outside wall above or below a window, or above or to the side of a door, patio door or a garage door. Nails or screws in the nail holes 4 are used to attach the sheet metal plate 2 to an outside wood wall. Screws and lag bolts in the bolt holes 5 can be used to attach the sheet metal plate 2 to a wood or a concrete-block wall. The hinge holes 6 are used when a sheet metal hinge 3, with attached shutter cover 1, is connected to a sheet metal plate 2. The width 6A across the hinge hole 6 allows a sheet metal hinge 3 to be attached, rotated 180°, and locked against a wall. This width also allows the shutter cover 1 to allow some high pressure air to escape from the window opening. The height 6B across the hinge hole 6 allows leeway for inaccurate measurement, when attaching a sheet metal hinge 3 to a shutter cover 1. For an average size window, only two of the sheet metal plates 2 would be attached to the outside wall.

When two vertical sheet metal plates 2 are attached to a wall above a window the distance between them is measured and transferred onto a shutter cover 1 that is longer and wider than the underlying window or door. A sheet metal hinge 3 is bolted to the shutter cover 1 at both measured locations, but sometimes the measurements may not be accurate. The wide opening in the hinge hole 6 allows some leeway in measurements when installing the sheet metal hinge 3 onto a shutter cover 1. If a sheet metal hinge 3 is accurately installed on a shutter cover 1 and the shutter cover 1 shrinks, warps, or expands during storage then the sheet metal hinge 3 will still fit into the sheet metal plate 2. The wide opening in the hinge hole 6 allows free play at the sheet metal hinge, and lets high pressure air escape from around the shutter cover 1 on the leeward side and sides of a house.

Figure 4:
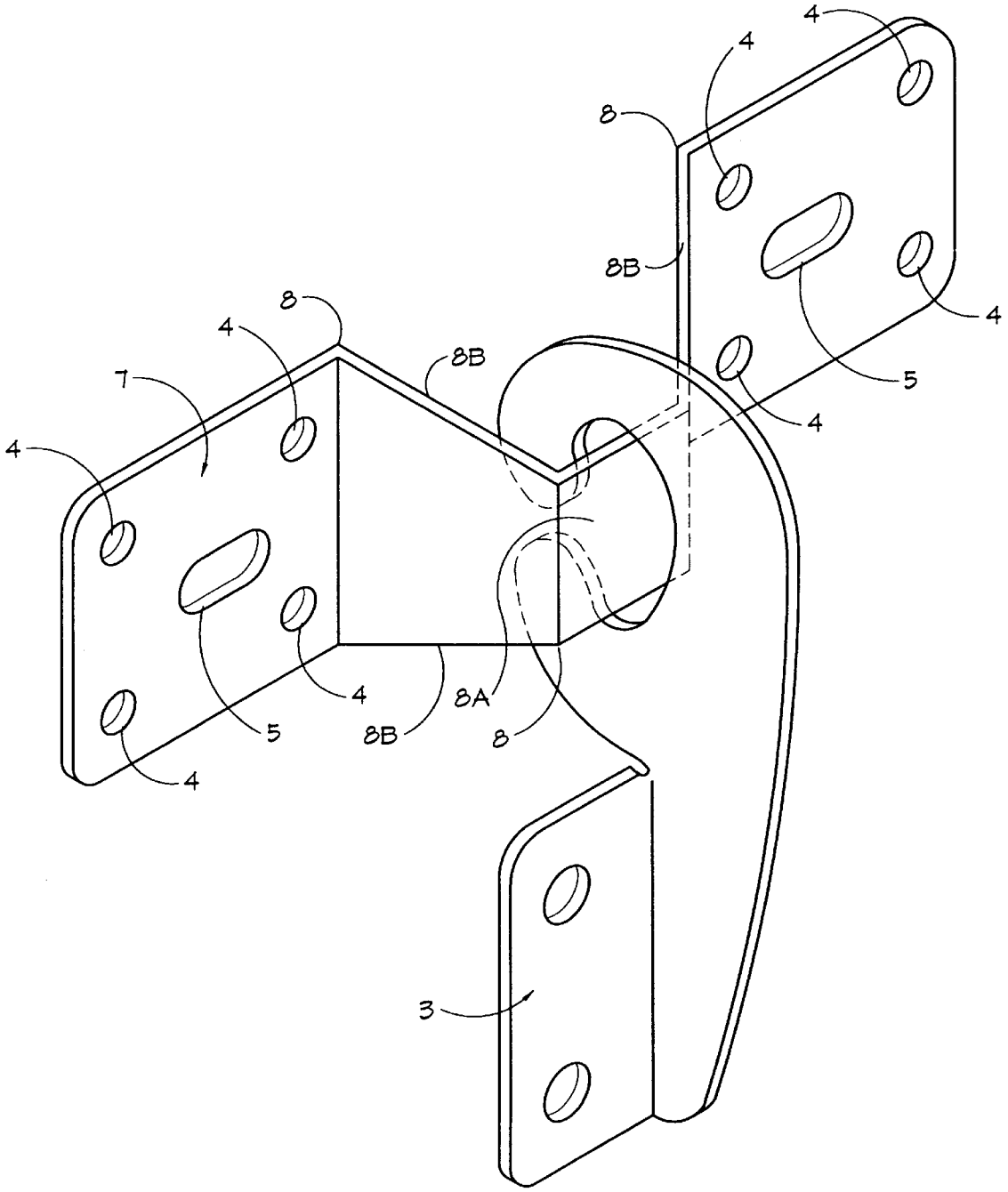
FIG. 4 is a perspective view of a sheet metal plate and sheet metal hinge.

Since wood-frame houses come in so many different varieties, a different embodiment is needed where space above a window is at a minimum. FIG. 4 shows a perspective view of a horizontal sheet metal plate 7 with an attached sheet metal hinge 3. The horizontal sheet metal plate 7 is similar to the vertical sheet metal plate 2 except for relief cuts 8B and no hinge holes 6.

FIG. 4 shows a perspective view of a horizontal sheet metal plate 7. The nail holes 4, bolt holes 5, and bend lines 8 are similar to the vertical sheet metal plate 2. A small trapezoidal-shaped area is cut out of either edge of the bridge 8A. This relief 8B provides sufficient area at the bridge 8A, so that a sheet metal hinge 3 can connect at a 45° angle, but will lock securely to the sheet metal plate 7 when the sheet metal hinge 3 is rotated completely up or down.

Figure 5B:
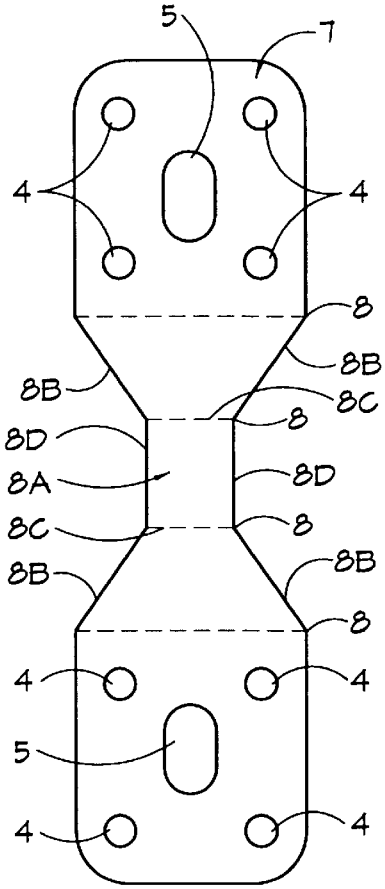
FIG. 5B is a front view of a sheet metal plate.
Figure 5A:
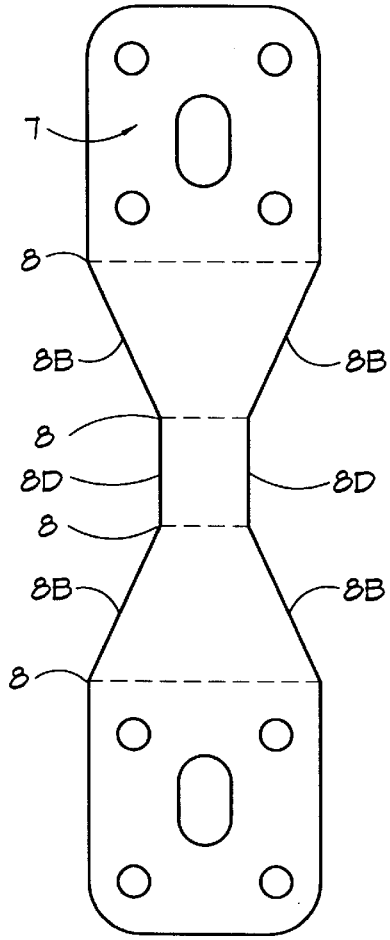
FIG. 5A is a flat pattern layout of a sheet metal plate.

Refer now to FIG. 5A, which is a flat-pattern layout of a sheet metal plate 7 prior to forming using standard tool-and-die methods. This view shows the trapezoidal area that is cut out to form the relief 8B and ample 8D. The sheet metal plate 7 is bent at the bend lines 8 using standard tool-and-die methods.

FIG. 5B is a front view of a horizontal sheet metal plate 7 after bending. This is similar to the vertical sheet metal plate 2 of FIG. 3C. Nails or screws through the nail holes 4, and lag bolts through the lag bolt holes 5 secure the sheet metal plate 7 to a wood or masonry wall. The bend lines 8 help make and support the bridge 8A so that a sheet metal hinge 3 can grapple onto the ample 8D and pivot across the stature 8C.

The stature 8C across the bridge 8A allows a sheet metal hinge 3 to connect, rotate, and lock in an up or down position. The ample 8D across the bridge 8A allows some leeway for inaccurate measuring when attaching a sheet metal hinge 6 to a shutter cover 1, similar to the hinge hole 3 of a vertical sheet metal plate 2.

Figure 5C:
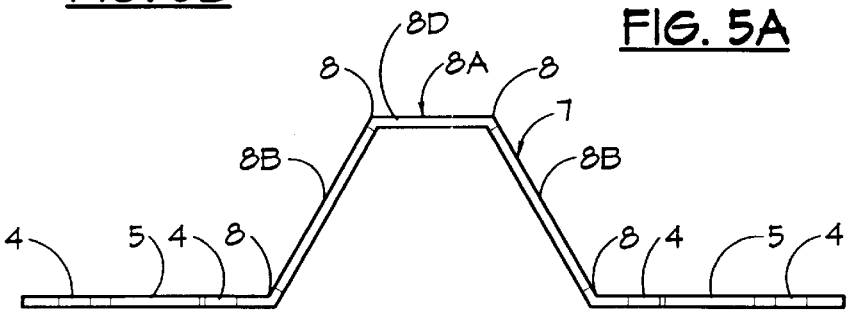
FIG. 5C is a side view of sheet metal plate.

FIG. 5C shows a side view of a horizontal sheet metal plate 7. The four radiuses at the bends 8 have the same benefits as on a vertical sheet metal plate 2. The cut out reliefs 8B fashion a strong trapezoidal shape to the sides that form the bridge 8A. The stature 8C across the bridge 8A, forms the means of attaching and locking a sheet metal hinge 3. The height of the bridge 8A, from where the base attaches to a wall, allows a sheet metal hinge 3 to connect, rotate, and lock on to the sheet metal plate 7, and allows the shutter cover 1 to bleed high pressure air from the leeward side of a house.

Figure 6A:
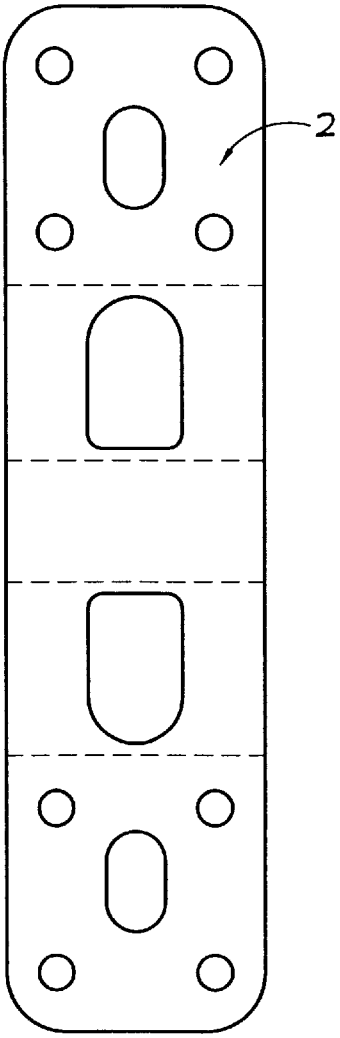
FIG. 6A is a flat pattern lay out of a vertical sheet metal plate.
Figure 6B:
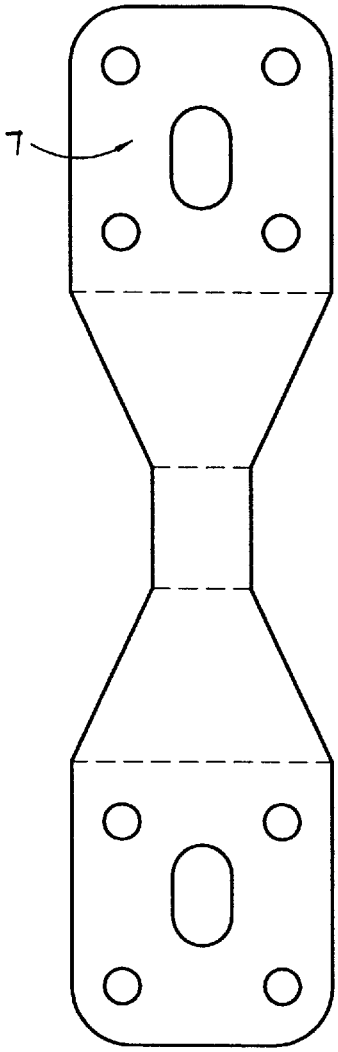
FIG. 6B is a flat pattern lay out of a horizontal sheet metal plate.
Figure 6C:
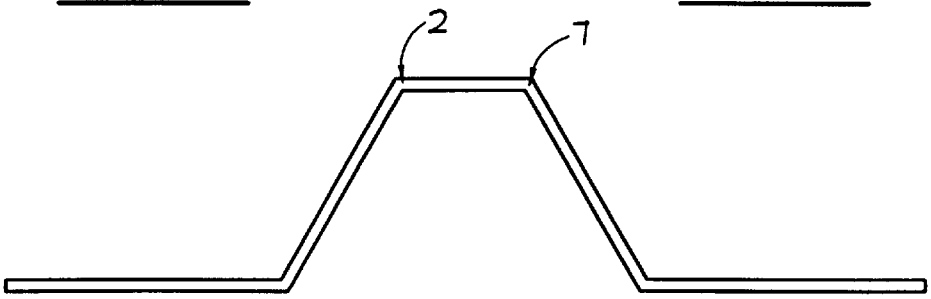
FIG. 6C is a side view of a horizontal and vertical sheet metal plate.

FIG. 6A shows a flat pattern lay out for cutting and forming a vertical sheet metal plate 2. FIG. 6B shows a flat pattern lay out for cutting and forming a horizontal sheet metal plate 7. FIG. 6C shows a side view of a vertical sheet metal plate 2 and a horizontal sheet metal plate 7, after bending. Since the two sheet metal plates are so similar, the same die can be used, with adjustments, to create both plates and will save manufacturing costs and lower costs to the consumer.

Figure 7A:
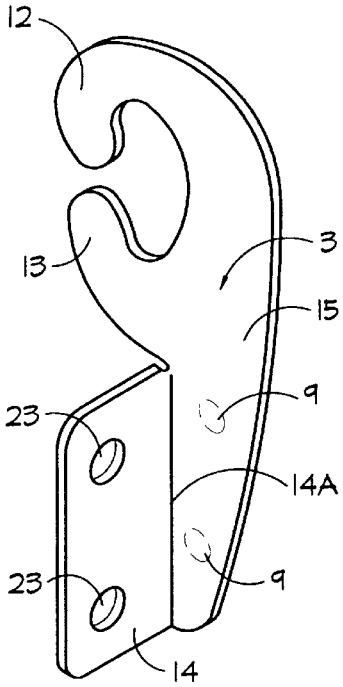
FIG. 7A is a perspective view of a left sheet metal hinge.

Refer now to FIG. 7A which shows a perspective view of a left-hand sheet metal hinge 3 prior to attaching onto a shutter cover 1. Bolts and nuts (not shown) attach the sheet metal hinge 3 to the shutter cover 1 through the bolt holes 23 on the base member 14. A right-angle bend 14A on the right side of the base member 14 forms the web member 15. The web member 15 contains alignment indentations 9 (on back side) for attaching a right-hand sheet metal hinge (see FIG. 7F); and top hook 12, and bottom hook 13.

When a sheet metal hinge 3 is fastened to a shutter cover 1, and a hurricane is expected, a homeowner can lift one end of the shutter cover 1 and can use the top hook 12 to grapple and fasten onto a sheet metal plate 2 or 7 that is fastened to a wall above, below, or to the side of a window, or to the side or above a door. Once that end of the shutter cover 1 is fastened, the other end of the cover is much lighter to lift since much of the weight is already suspended by the sheet metal plate 2 or 7.

Figure 7B:
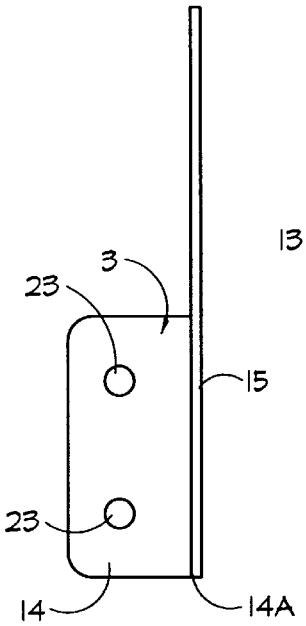
FIG. 7B is a back view of sheet metal hinge.

FIG. 7B shows a back view of a left-hand sheet metal hinge 3. The web member 15 is on the right and is seen edge-on along its thickness with alignment indentations 9 pressed in from the right side. The right-angle bend line 14A is along the left side of the web member 15 and contains the base member 14 with bolt holes 23.

Figure 7C:
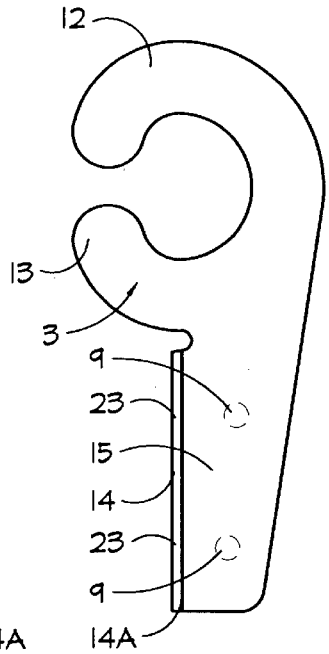
FIG. 7C is a side view of sheet metal hinge.

FIG. 7C shows a side view of a left-hand sheet metal plate 3. Hidden from view in the base member 14, facing the viewer, are bolt holes 23 for fastening to a shutter cover 1. The right-angle bend 14A forms the right side of the web member 15, seen here with the alignment indentations 9 pressed from the side opposite the viewer.

The top hook 12 and bottom hook 13 are shown in profile in FIG. 7C. The elliptical opening between the top hook 12 and bottom hook 13 helps the sheet metal hinge 3 grapple, latch, and lock onto a sheet metal plate 2 and 7. Although other shapes could be used, the preferred shape is elliptical. When a shutter cover 1 is fastened to a sheet metal hinge 3, and the top hook 12 is grappled at 45° and fastened to the height 6B of a vertical sheet metal plate 2 or the ample 8D of a horizontal sheet metal plate 7 above a window, the shutter cover 1 can be rotated down over the window- The top hook 12 and bottom hook 13 together fastening the sheet metal hinge 3 and attached shutter cover 1 securely above the window.

If sheet metal plates 2 or 7 are fastened below a window, the top hook 12 is still used to grapple and fasten onto the sheet metal plate 2 or 7 at 45°, but then the shutter cover 1 is rotated up at about 135° so that the weight of the shutter cover 1 is carried on the bottom hook 13. Both the top hook 12 and bottom hook 13 help fasten the shutter cover 1 securely to the bottom of the window. Latches, described later on, lock the shutter cover over the window.

Figure 7F:
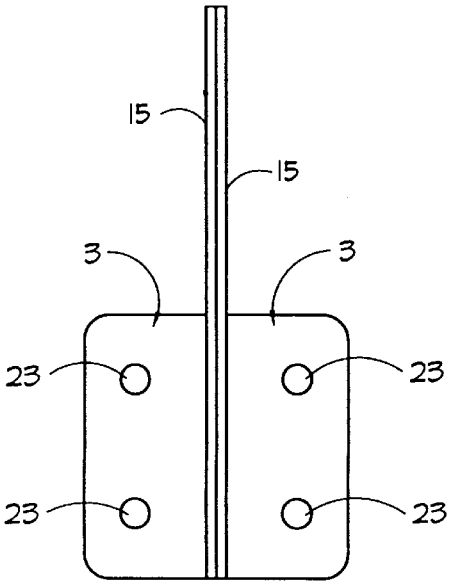
FIG. 7F is a back view of a left hinge and right hinge aligned together.
Figure 7D:
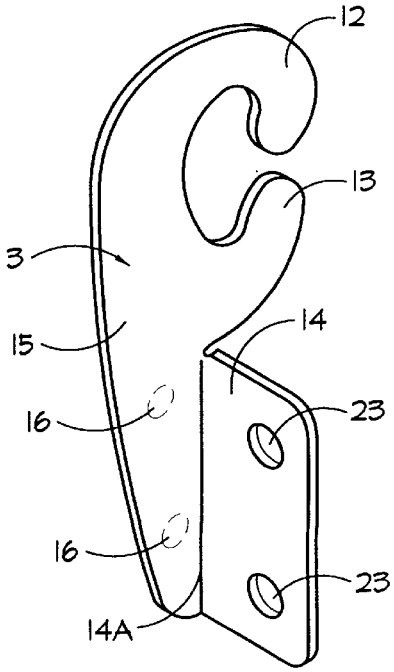
FIG. 7D is a perspective view of a right sheet metal hinge.

Refer now to FIG. 7D which shows a perspective view of a right-hand sheet metal hinge 3. The base member 14 is on the right and contains bolt holes 23 for attaching a shutter cover 1 with bolts and nuts. At the right angle bend 14A, the web member 15 has locating pins 16 pressed in from the right side. The web member 15, also has the top hook 12 and bottom hook 13.

Figure 7E:
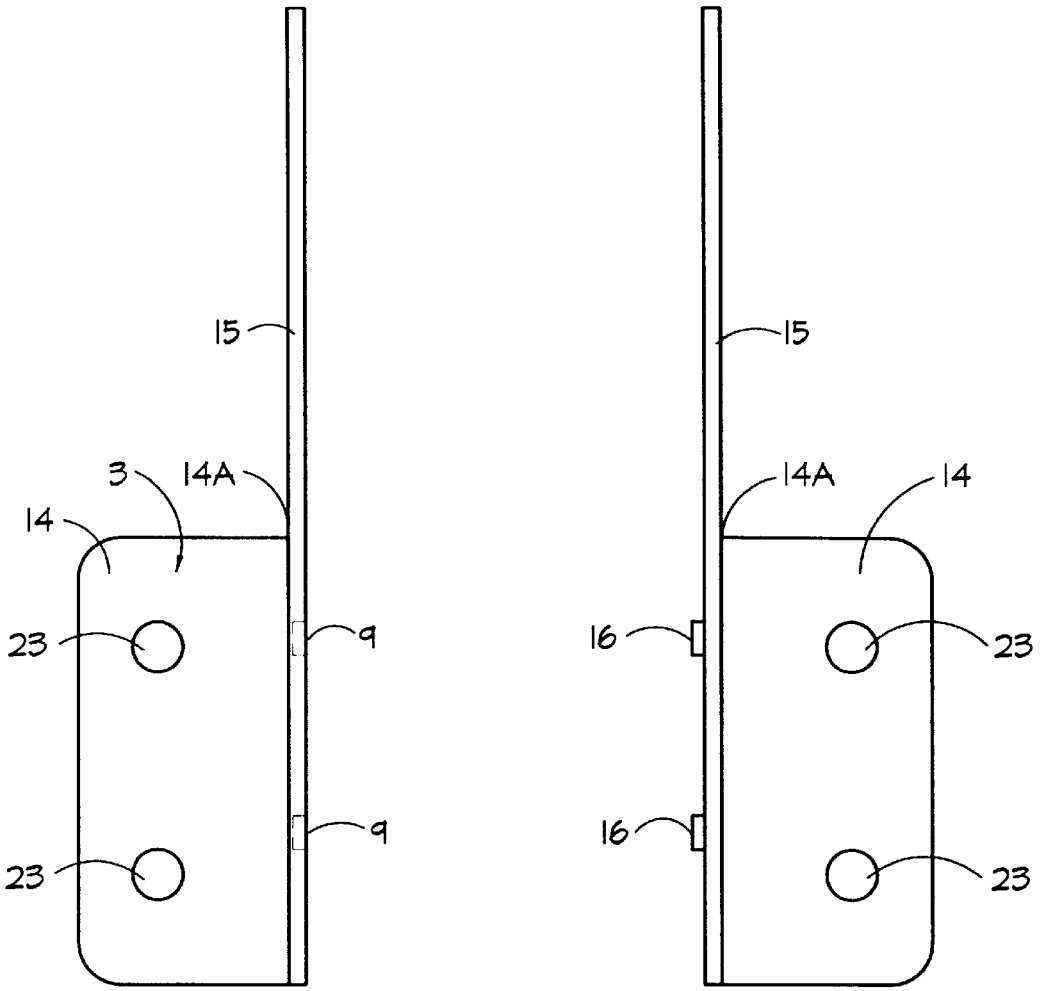
FIG. 7E is a back view of a left hinge and right hinge before alignment.

FIG. 7E shows a back view of a left-hand sheet metal hinge 3, on the left, and a right-hand sheet metal hinge 3, on the right, prior to aligning together for added strength. The locating pins 16 of the right-hand sheet metal hinge fit into the alignment indentations 9 of the left-hand sheet metal hinge so that the web members 15 are aligned together.

FIG. 7F shows how aligning the left- and right-hand sheet metal hinges, using locating pins 16 and alignment indentations 9 doubles the thickness of the top hook 12 and bottom hook 13, and doubles the surface area and number of bolts attached to a shutter cover 1. When a large surface must be covered, such as a picture window or patio door, a large shutter cover must be used. A large shutter cover can be very heavy, hence a left- and right-hand sheet metal hinge can be linked together on a large or thick shutter cover 1 for added strength.

Figure 8A:
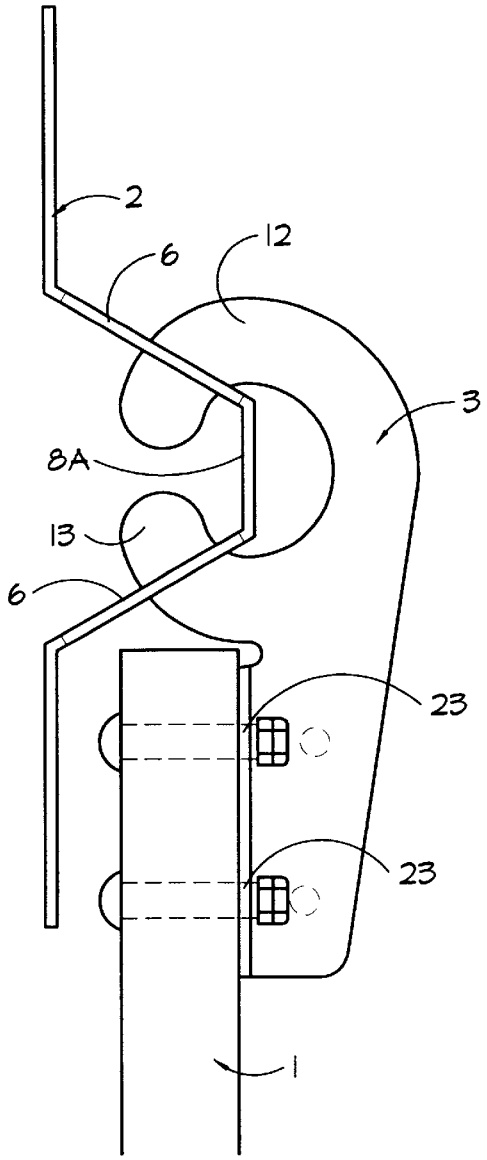
FIG. 8A is a side view of a right sheet metal hinge locked down.

FIG. 8A shows a vertical sheet metal plate 2 in one of its several designs, attached to the outside wall above a window. A left-handed sheet metal hinge 3 is shown bolted to a shutter cover 1 through the bolt holes 23. After holding the shutter cover 1 at about 45° to the wall, the sheet metal hinge 3 and attached shutter cover 1 grapple onto the bridge 8A and through the hinge hole 6 of the sheet metal plate 2 with the top hook 12. The sheet metal hinge 3 and attached shutter cover 1 then pivots down about 45° on the top hook 12, and the bottom hook 13 helps keep the shutter cover 1 in position and protecting the window. Latches keep the bottom part of the shutter cover 1 secured to the bottom part of the window.

Figure 8B:
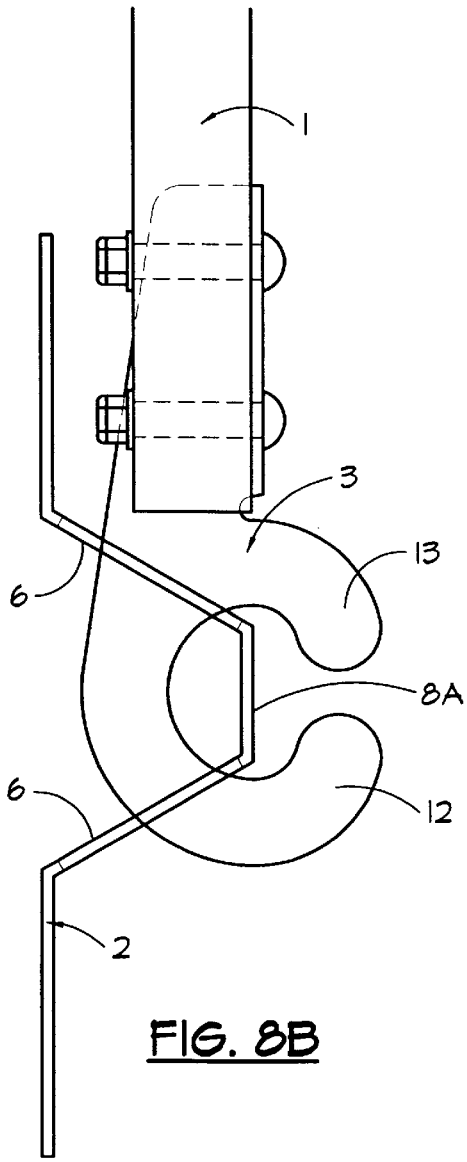
FIG. 8B is a side view of a right sheet metal hinge locked up.

FIG. 8B shows a vertical sheet metal plate 2 in another one of its several designs, attached to the outside wall below a window. A left-handed sheet metal hinge 3 is shown bolted to a shutter cover 1 through the bolt holes 23. After holding the shutter cover 1 at about 45° to the wall, the sheet metal hinge 3 and attached shutter cover 1 have grappled onto the bridge 8A and through the hinge hole 6 of the sheet metal plate 2 with the top hook 12. The sheet metal hinge 3 and attached shutter cover 1 then pivots up about 135° on the top hook 12, and the bottom hook 13 helps keep the shutter cover 1 in position and protecting the window. Latches keep the top part of the shutter cover 1 secured to the top part of the window.

Figure 9:
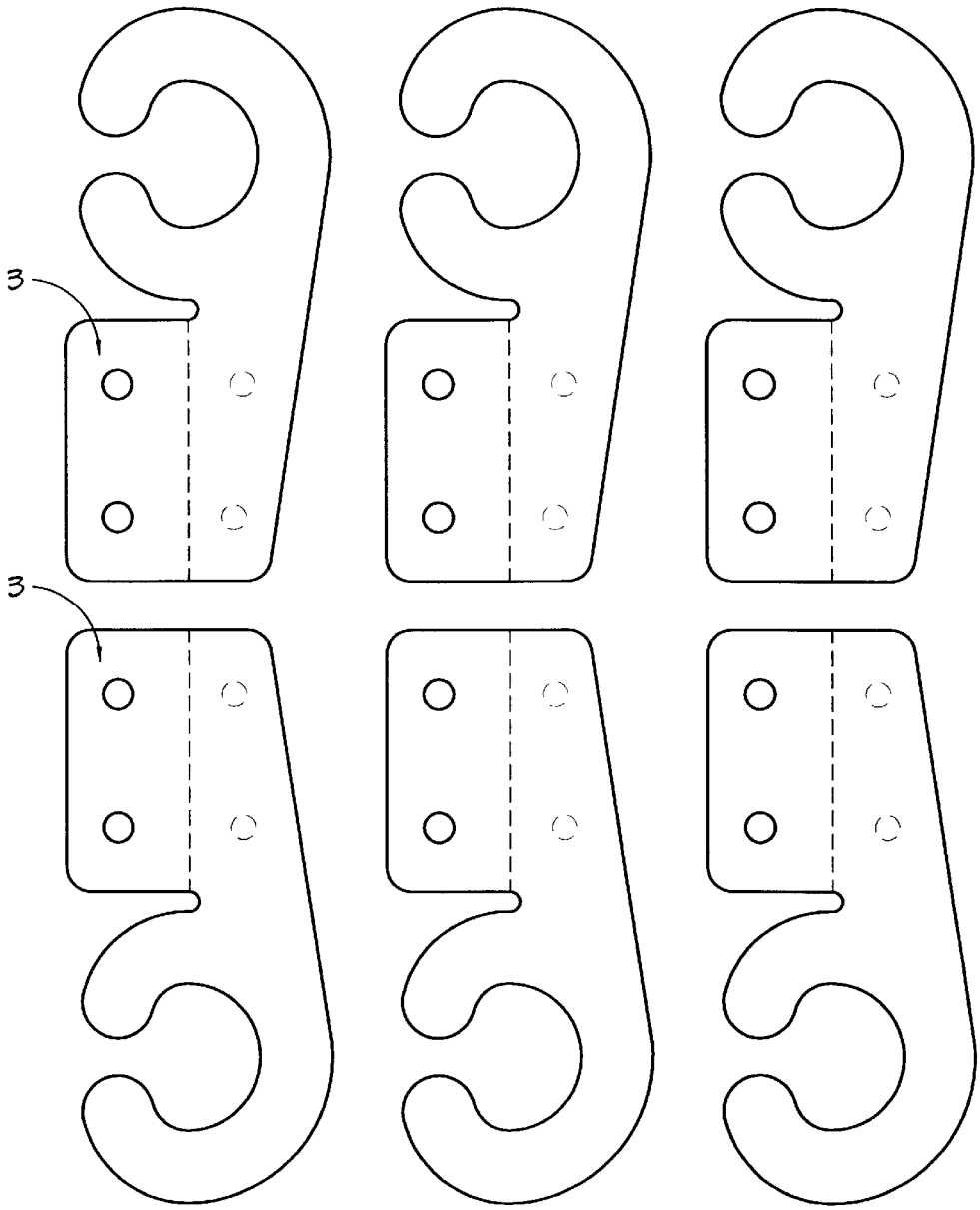
FIG. 9 is a flat pattern layout of left and right sheet metal hinges.

FIG. 9 shows a flat pattern layout for cutting and forming a left- and right-hand sheet metal hinge 3 in one operation.

A sheet metal hinge 3 (left- or right-hand) can be used to attach a shutter cover 1 to wood houses using a vertical sheet metal plate 2 or a horizontal sheet metal plate 7. A sheet metal hinge 3 can also be used to attach a shutter cover 1 to concrete, concrete-block, and brick houses using these sheet metal plates or other embodiments, that will be discussed later. The sheet metal hinge 3 will work on the side and the bottom of a window.

Figure 10A:
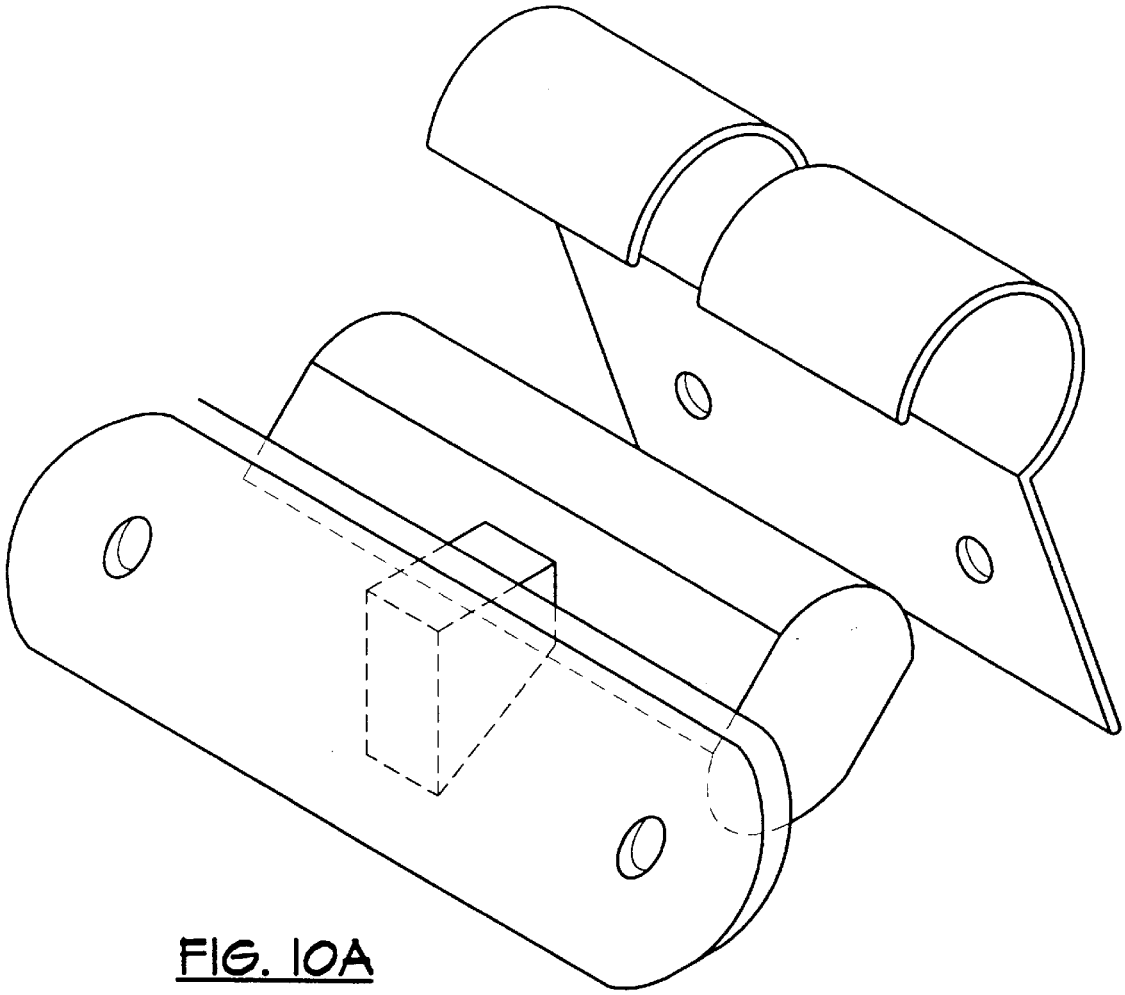
FIG. 10A is a perspective view of a cast metal plate and hook.

FIG. 10A shows another embodiment of this invention using a casting instead of stamped sheet metal. A cast metal hinge 18 about to latch onto a cast metal plate 17. A cast metal plate 17 and cast metal hinge 18 can be made of cast metal, forged metal, or molded plastic. This view shows the rear of a cast metal plate 17 which consists of a flat wall base 21 with bolt holes 5. The bolt holes 5 allow the wall base 21 to be attached with nails, screws, or lag bolts, to a wood or concrete-block wall, above, below, or to the side a window that would need protection from hurricane-force winds.

FIG. 10A also shows part of the front of a cast metal plate 17 with a round rod 19 affixed to the wall base 21 with a narrow channel 20. The round rod 19 is generally parallel to the wall base 21, and the rod acts as a guide to allow the slot 24 on the cast metal hinge 18 to latch and pivot together.

The two flat cuts 22 on the round rod 19 are at an approximate 45° angle from the wall base 21. These flat cuts 22 allow a cast metal hinge 18 to latch and slide down the round rod 19 when the cast metal hinge 18 and attached shutter cover 1 are positioned about 45° from the wall. The narrow channel 20 supports the round rod 19, keeps the cast metal hinge 18 from sliding left or right, and helps latch the cast metal hinge 18 when the cast metal plate 17 is locked up or down, or to the side of a window.

Figure 10D:
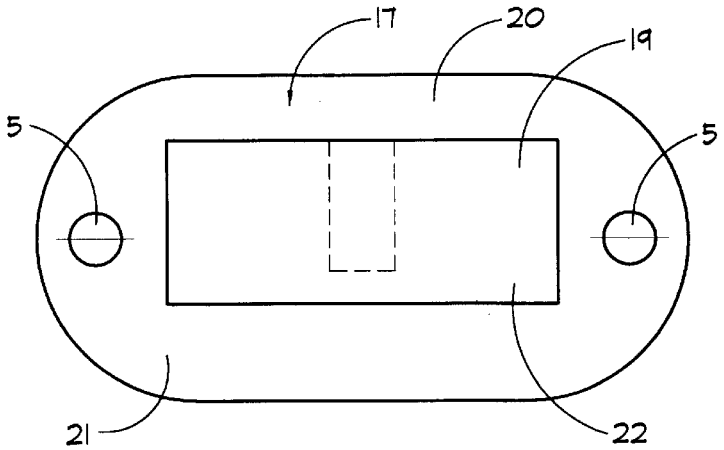
FIG. 10D is a front view of cast metal plate.
Figure 10B:
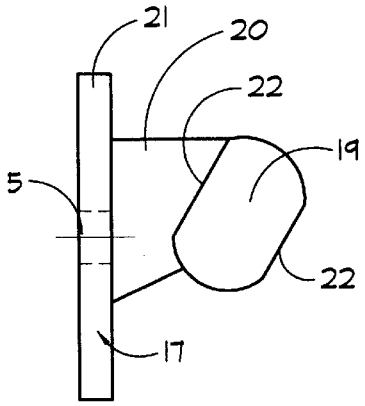
FIG. 10B is a side view of cast metal plate.

FIG. 10B shows a side view of the cast metal plate 17. The wall base 21 part of the plate faces left, where it would be mounted to a wall by nails, screws, or lag bolts through the holes 5 (dashed). The round rod 19 is on the right side and the flat cuts 22 are shown at an approximate 45° to the wall base 21. The narrow channel 20 is shown connecting the wall base 21 with the round rod 19. The height of the narrow channel 20, as seen in this view, allows the slot 24 of a cast metal hinge 18 to lock in a vertical plane, up and down, when attached together.

Figure 10C:
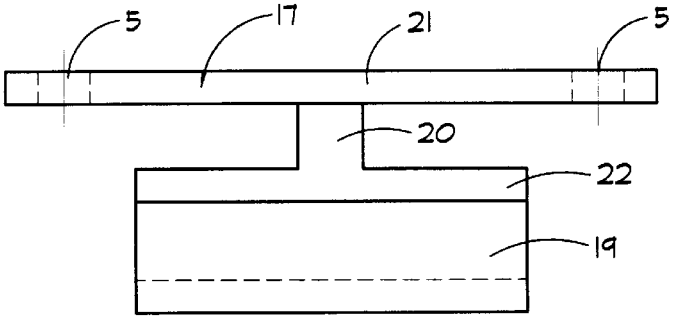
FIG. 10C is a top view of a cast metal plate.

FIG. 10C shows a top view of the cast metal plate 17 with the wall base 21 facing up. The round rod 19, with flat cuts 22, is shown mostly parallel to the wall base 21 and affixed to the wall base 21 by a narrow channel 20. The narrow channel is slightly thinner than the slot 24 in the cast metal hinge 18. This allows a cast metal hinge 18 to attach, rotate in a vertical plane, and lock together when closed up or down.

FIG 10D shows a front view of the cast metal plate 17. The round rod 19 faces out to the viewer and the flat cuts 22 are at the bottom of the round rod 19 and hidden from view on the backside. Lag bolts would attach the cast metal plate 17 to the wall through the bolt holes 5 on the wall base 21.

FIG. 10A shows a cast metal hinge 18 about to latch onto a cast metal plate 17. This cast metal hinge 18 can be made of forged metal, cast metal, sheet metal, or molded plastic. The hinge consists of a bottom web 29 with several bolt holes 23. The bolt holes 23 allow the bottom web 29 to be attached to a shutter cover 1 with nuts and bolts. Above the bottom web 29 is a shoulder 25 that provides strength to the hinge. Underneath and to the left of the shoulder 25 is the support ledge 28 (shown in greater detail in FIG. 10E) which helps support and center the top edge of a shutter cover 1. To the left of the support ledge 28 is a stop tab 30 that adds strength and forms a pad against the cast metal plate 17 when thin shutter covers 1 are closed against a window. The stop pad 30 also provides locking assistance when attached to the cast metal plate 17.

Above the shoulder is the outer hook 26 and inner hook 27 part of the round web 31 which forms the hinge axis. The inner hook 27 of the round web can fit onto the round rod 19 of the cast metal plate 17 and can swing 180° around the axis of the round rod 19. A slot 24, perpendicular to the hinge axis, along the approximate middle of the round web 31, allows the hinge to swing 180° around the narrow channel 20 of the cast metal plate 17. The slot 24, slightly wider than the narrow channel 20, also allows the cast metal hinge 18 to lock against the cast metal plate 17, when the cast metal hinge 18 is rotated down and when it is rotated up, or when the cast metal hinge 18 is mounted to the side of a window.

Figure 10E:
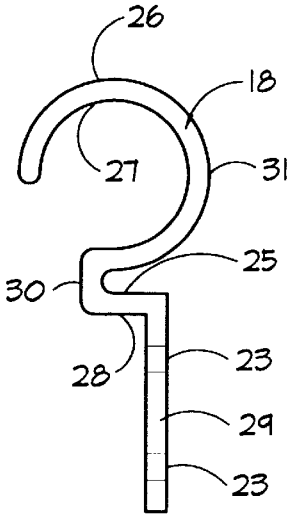
FIG. 10E is a side view of cast metal hinge.

FIG. 10E shows a side view of a cast metal hinge 18. The bottom web 29 is at the underside and shows bolt holes 23 as dashed lines. When cast metal plates 17 are attached to the wall above a window, and the distance between them is measured, a plywood sheet 1 is attached from the left side, as shown in this view, and slid up until the top edge is flush with the support ledge 28. After marked holes are drilled into the plywood sheet 1, bolts and nuts are used to attach it to the bottom web 29 using bolt holes 23.

In FIG. 10E, the shoulder 25, support ledge 28, stop pad 30, and round web 31 can be seen in profile. The lower right part of the shoulder 25 is connected to the bottom web 29 and forms the support ledge 28 and centering for the top edge of a plywood sheet 1. The fold in the shoulder 25 adds strength against twisting and torquing. The left edge of the shoulder adds strength and forms a stop pad 30 against the cast metal plate 17, when both are locked together. The upper part of the stop pad 30 forms the lower part of the round web 31. This part adds strength and helps lock the cast metal hinge 18 to the cast metal plate 17 when used above or below a window.

FIG. 10E shows the round web 31 as a cross-section of the axis of rotation if it were attached to a cast metal plate 17. The diameter of the inner hook 27 is slightly larger than the outside diameter of the round rod 19 of the cast metal plate 17. This allows the round web 31 of the metal hinge to rotate 180° around the round rod of the metal plate. The outer hook 26 has clearance between the wall base 21 and round rod 19 when rotated.

Figure 10F:
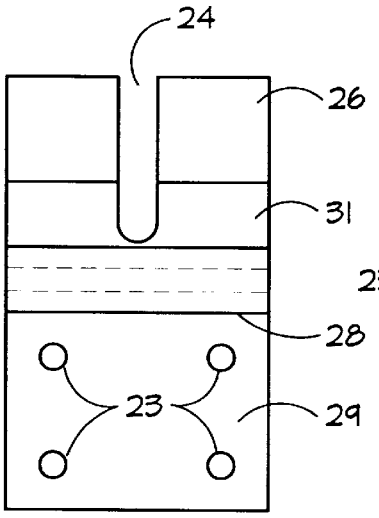
FIG. 10F is a front view of cast metal hinge.

FIG. 10F is a front view of a cast metal hinge 18 from the left side of FIG. 10E. At the base, the bottom web 29 contains bolt holes 23 for attaching plywood sheets 1. Above the support ledge 28, is the stop pad 30 that adds strength and forms the stop against a cast metal plate 17. Above the stop pad, part of the inner hook 27 of the round web 31 is seen. The slot 24 is shown completely cutting through the outer hook 26 and inner hook 27 of the round web. This slot 24 is slightly wider than the narrow channel 20 shown in FIG. 10C. This allows the slot 24 to rotate around the narrow channel 20 and keeps the cast metal hinge 18 from moving left or right along the axis of the round rod 19, once the cast metal plate 17 and cast metal hinge 18 are locked together.

Figure 10G:
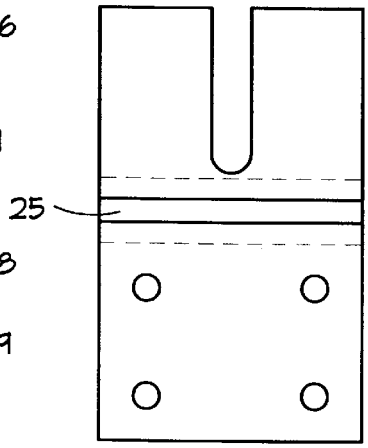
FIG. 10G is a back view of a cast metal hinge.

FIG. 10G shows a back view of a cast metal hinge 18 with shoulder 25 and slot 24. FIG. 10A shows the cast metal hinge 18 starting to latch onto a cast metal plate 17 at about 45°. The cast metal plate 17 is installed above the window in this case. The cast metal hinge 18, and attached shutter cover 1 (not shown), would grapple the cast metal plate 17 and start to slide down the flat cuts 22 until it is free of the flat cuts 22 and able to pivot around the round rod 19.

FIG. 8A would be similar to a side view of a cast metal hinge 18 after it has pivoted down about 45° on the round rod 19 of the cast metal plate 17. The attached shutter cover 1 (not shown) now covers the window, and can be locked with latches.

FIG. 8B would be similar to a side view of a cast metal plate 17 that is installed below a window. A cast metal hinge 18 has latched as shown in FIG. 8A, but has pivoted on the round rod 19 about 180° upward. The attached shutter cover 1 (not shown) now covers the window, and can be locked by latches.

On concrete, brick, and concrete-block constructed houses, different embodiments of the invention may be easier to install.

Figure 11A:
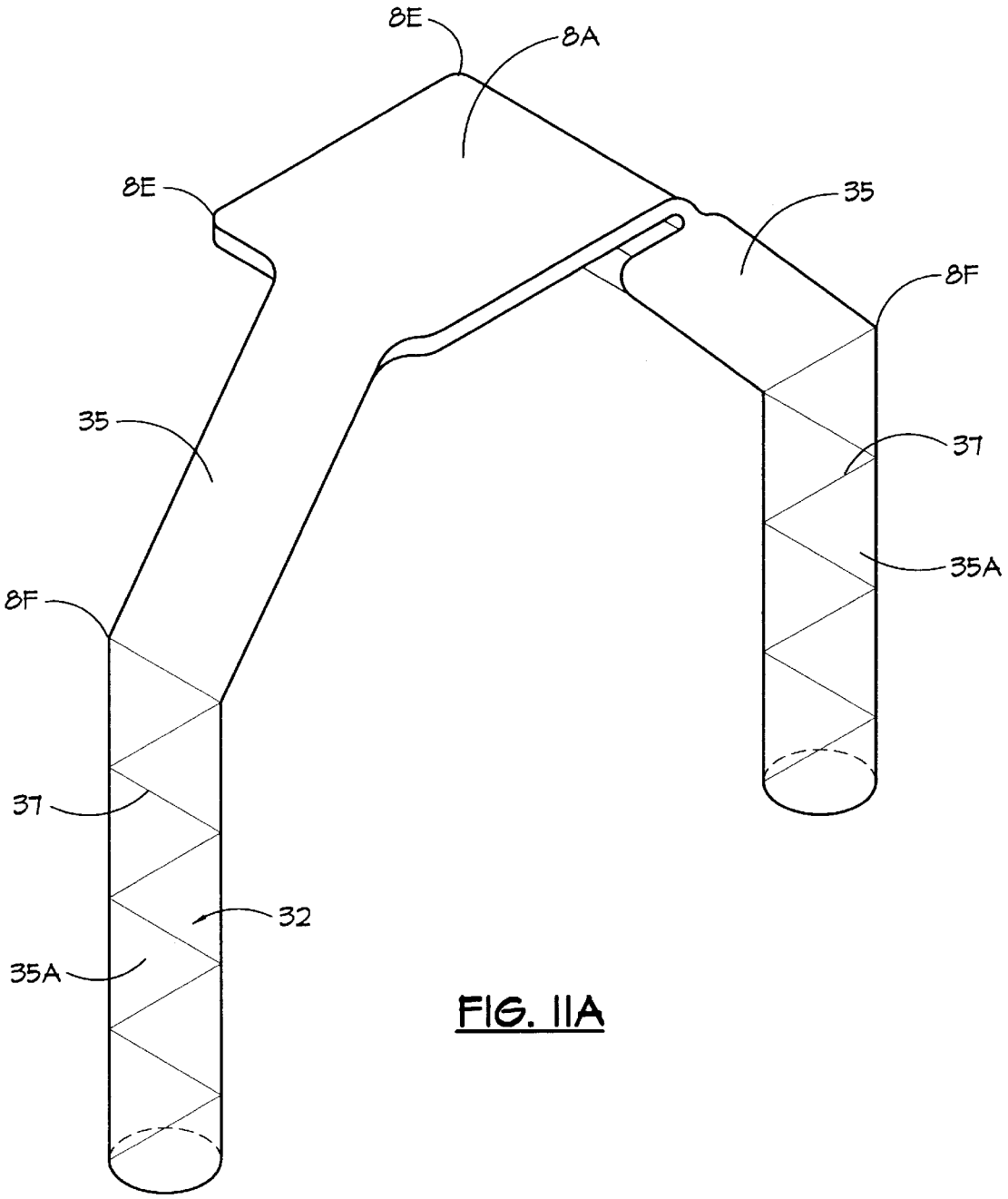
FIG. 11A is a perspective view of a metal staple.

FIG. 11A shows a perspective view of a metal staple 32. The bridge 8A is flattened metal with angled droops 8E at either end of the bar. At the end of each angled droop 8E is a solid bar member 35; both bar members 35 are about equal in length and width. A bear bend 8F, with a smaller angle than the angled droop 8E, permits the lengthened bar members 35A to be about right-angled to the bridge 8A.

Use of the staple is simple. Two holes, slightly wider than a lengthened bar member 35A and knurled 37C, and approximately the same distance apart as the lengthened bar members 35A, are drilled into the concrete, concrete-block, or bricks above a window using a carbide drill. The holes are partly filled with standard epoxy and the lengthened bar members 35A are inserted into the holes. The knurled 37C give the epoxy extra surface area and extra holding power to the bar members.

If the holes drilled into the masonry were mis-drilled, slightly further apart or closer together than the lengthened bar members 35A, the lengthened bar members can be bent out or pushed in slightly to compensate for the inaccurately measured drill-holes. The bends at the angled droops 8E and bear bend 8F allow the lengthened bar members 35A to be bent in or out slightly. The bend at the bear bend 8F prevents the metal staple 32 from being inserted too far into the drilled holes.

Figure 11B:
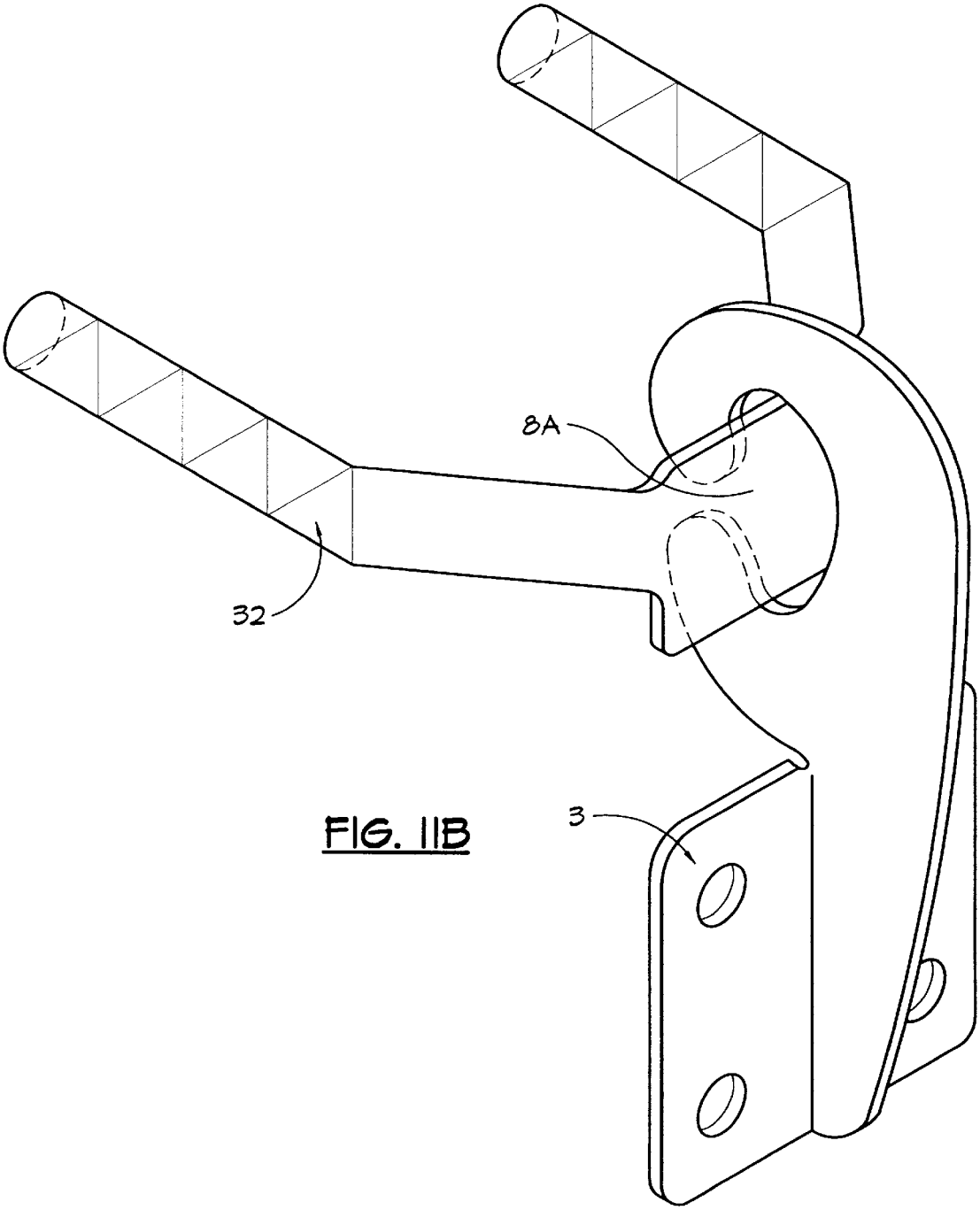
FIG. 11B is a perspective view of a metal staple and sheet metal hinge.

FIG. 11B shows the metal staple 32 as it would be attached into masonry above a window. The staple could also be attached to the side or bottom of the window similar to a horizontal sheet metal plate 7. FIG. 11B also shows how a sheet metal hinge 3, with attached shutter cover 1 (not shown), is latched onto the metal staple 32. The sheet metal hinge 3 could also rotate about 180° around the bridge 8A to protect a window that was above the metal staple 32.

Figure 11E:
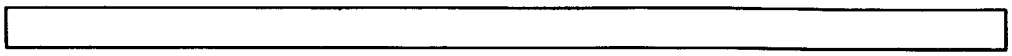
FIG. 11E is a side view of flat pattern layout of a metal staple.
Figure 11F:
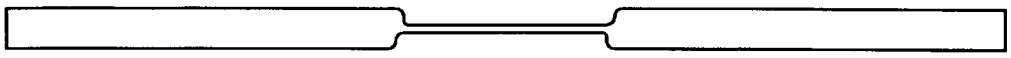
FIG. 11F is a side view of flat pattern layout after flattening.
Figure 11G:
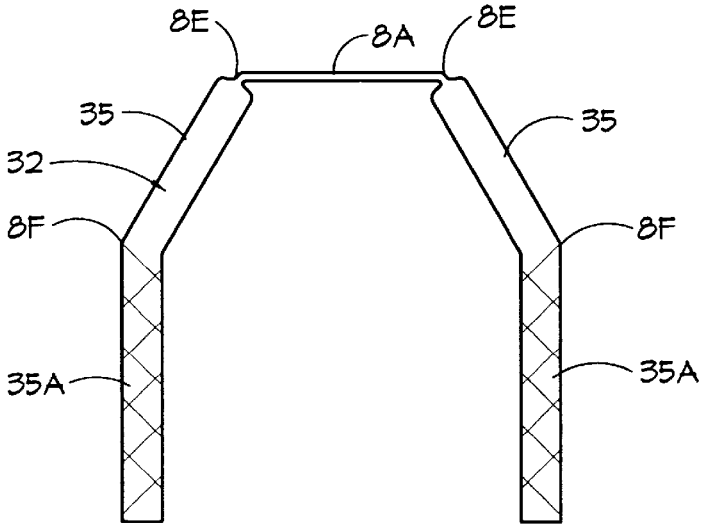
FIG. 11G is a side view of a metal staple.
Figure 11C:
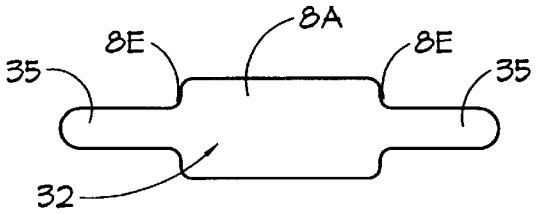
FIG. 11C is a front view of a metal staple.

FIG. 11C is a front view of the metal staple 32 showing the bridge 8A as it would be seen when the lengthened bar members 35A are attached to the wall of a house. The height of the bridge 8A, as seen in this view, is about as wide as the stature 8C on the bridge 8A of the horizontal sheet metal plate 7 shown in FIG. 5B. The width of the bridge 8A is slightly wider than the ample 8D of the bridge 8A on a sheet metal plate 7. The metal staple 32 is attached in a horizontal position above or below a window, similar to a horizontal sheet metal plate 7.

Figure 11D:
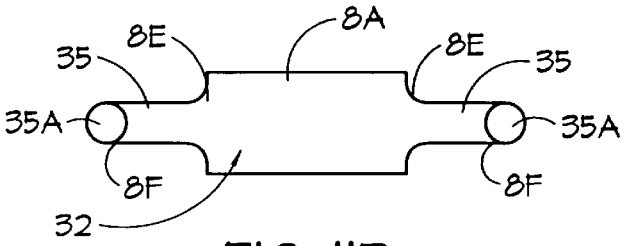
FIG. 11D is a rear view of a metal staple.

FIG. 11D shows a back view of a metal staple 32, showing the roundness of the lengthened bar members 35A, as they would be inserted into holes drilled into masonry.

FIG. 11E shows a flat-pattern layout for a metal staple 32. The preferred means is round bar stock prior to being flattened and bent by standard tool-and-die methods. The diameter of the round bar stock is thicker than the opening between the top hook 12 and the bottom hook 13 of a sheet metal hinge 2.

FIG. 11F shows the metal staple 32 after the bridge 8A has been flattened by standard tool-and-die methods.

FIG. 11G shows a side view of a metal staple 32, after the bends have been completed by standard tool-and-die methods.

Figure 12A:
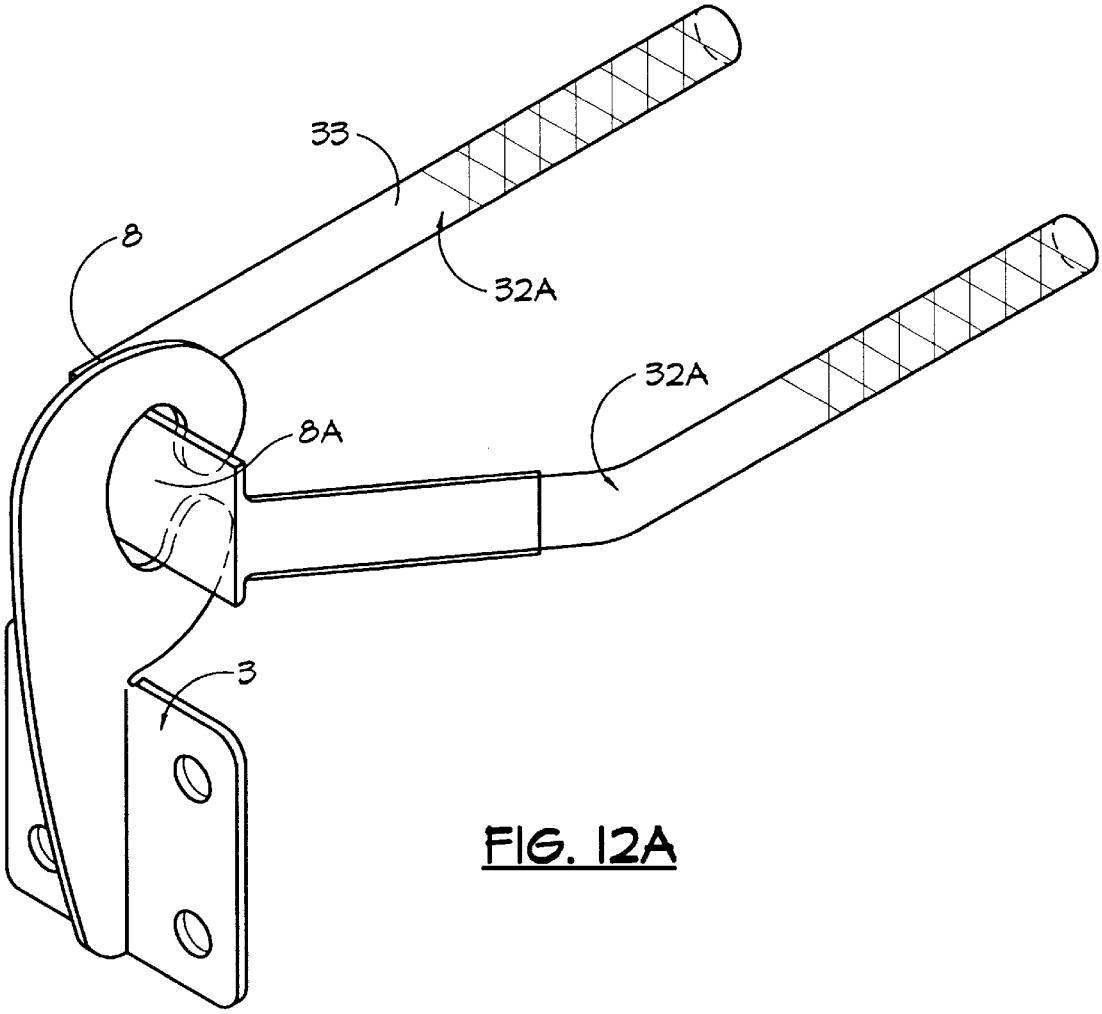
FIG. 12A is a perspective view of an adjustable metal staple.
Figure 12B:
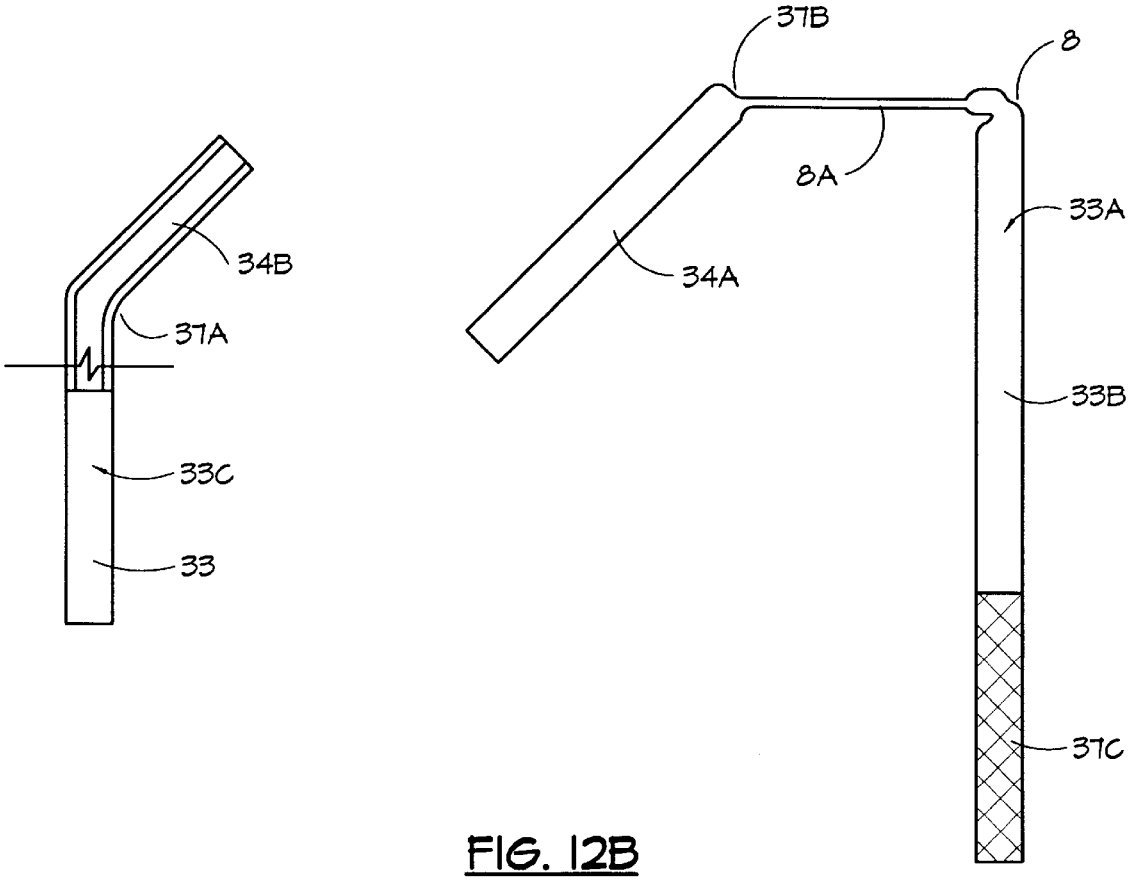
FIG. 12B is a side view of both parts of an adjustable metal staple.

FIG. 12A shows a perspective view of an adjustable metal staple 32A, as it would be inserted into a wall, with a sheet metal hinge 3 attached to the bridge 8A.

FIG. 12 shows side views of the two parts of an adjustable metal staple 32A. There are two parts to the adjustable metal staple 32A; on the right side is a male staple 33A, with a right angle bend 8 near the top of the mostly straight shaft 33B with grip knurled 37C along the bottom to form a tight bond with the epoxy. After the bend 8, the bar is flat, forming a bridge 8A. The bridge 8A is similar to the bridge 8A on a metal staple 32. After the bridge 8A, a shallow bend 37B forms the staff 34A.

On the left side of the adjustable metal staple 32A is the female staple 33C. The female staple 33C is mostly void. The top part of the female staple 33C contains the hollow 34B, with a modest bend 37A, similar to the shallow bend 37B on the male staple 33A, forming the bottom cranny 33D.

The diameter of the staff 34A on the male staple 33A, fits and slides easily into the hollow 34B of the female staple 33C. The staff 33B and cranny 33D are about equal in diameter.

Use of the staple is simple. Two holes, slightly larger than the staff 33B and cranny 33D are drilled into the concrete, concrete-block, or bricks above a window using a carbide drill. The holes are partly filled with standard epoxy and the shaft 33B and cranny 33D are inserted into the holes, while connected at the staff 34A and hollow 34B.

Drilling holes that are exactly distant from each other is difficult to do in concrete, concrete-block, and bricks because the small stones imbedded in the concrete and mortar slightly deflect the drill bit. With the staff 34A sliding into the hollow 34B, the distances between the shaft 33B and the cranny 33D do not have to be exact as they can slide in an out to meet the distance drilled into the concrete.

As an example, if the distance recommended drilled between the two holes for the adjustable metal staple 32 is 4 inches. If, because one hole was drilled in a brick and the other hole was drilled into the mortar between bricks, the holes are actually 4½ inches apart, the staff 34A and hollow 34B could be pulled apart ½ inch and the shaft 33B and cranny 33D could then be inserted into the drilled holes. The length of the staff 34A and hollow 34B are of such length as to allow for almost any error of drilling tolerance for the holes.

Figure 12C:
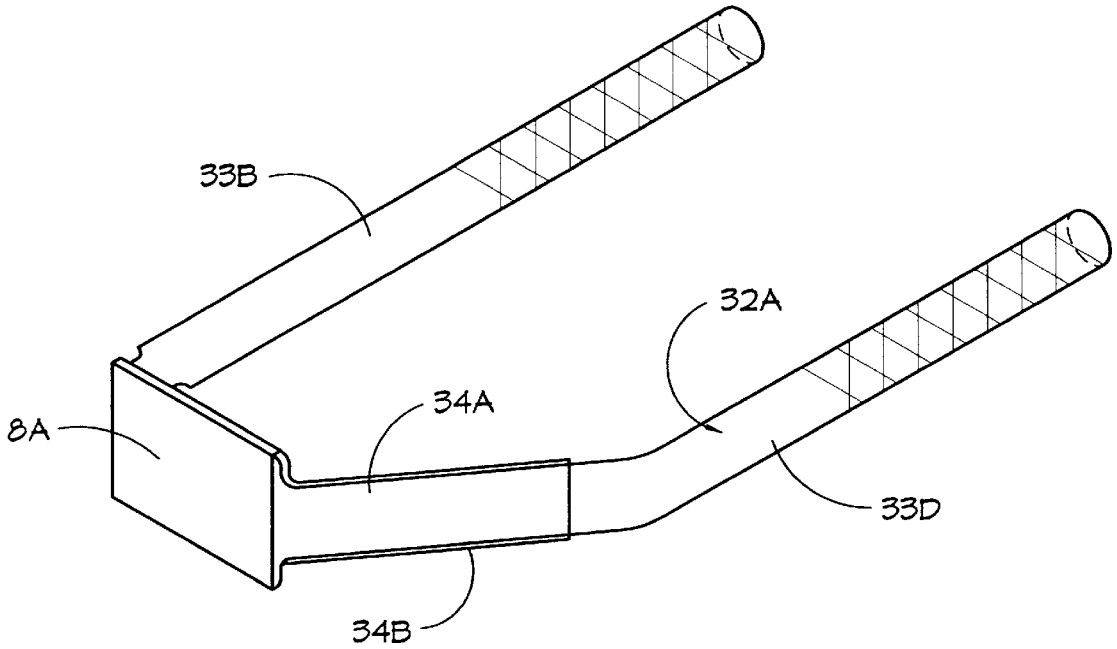
FIG. 12C is a perspective view of an adjustable metal staple.

FIG. 12C is a perspective view of the adjustable metal staple 32A. The width of the bridge 8A as seen in this view is about as wide as the stature 8C on the bridge 8A of the horizontal sheet metal plate 7 shown in FIG. 5B. As the metal staple 32 is attached in a horizontal position above a window, similar to a horizontal sheet metal plate 7, a shutter cover 1, with a sheet metal hinge 3 attached, could be fastened to the adjustable metal staple 32A in the same fashion. The thickness of the bridge 8A is thinner than the opening between the top hook 12 and bottom hook 13 of a sheet metal hinge 3. This means that a shutter cover 1, with sheet metal hinge 3 attached, can be grappled with the top hook 12 locked with the bottom hook 13. The latching would be very secure and the sheet metal hinge 3 could rotate down, or up if the adjustable metal staple 32A or metal staple 32 were inserted below a window.

Figure 12D:
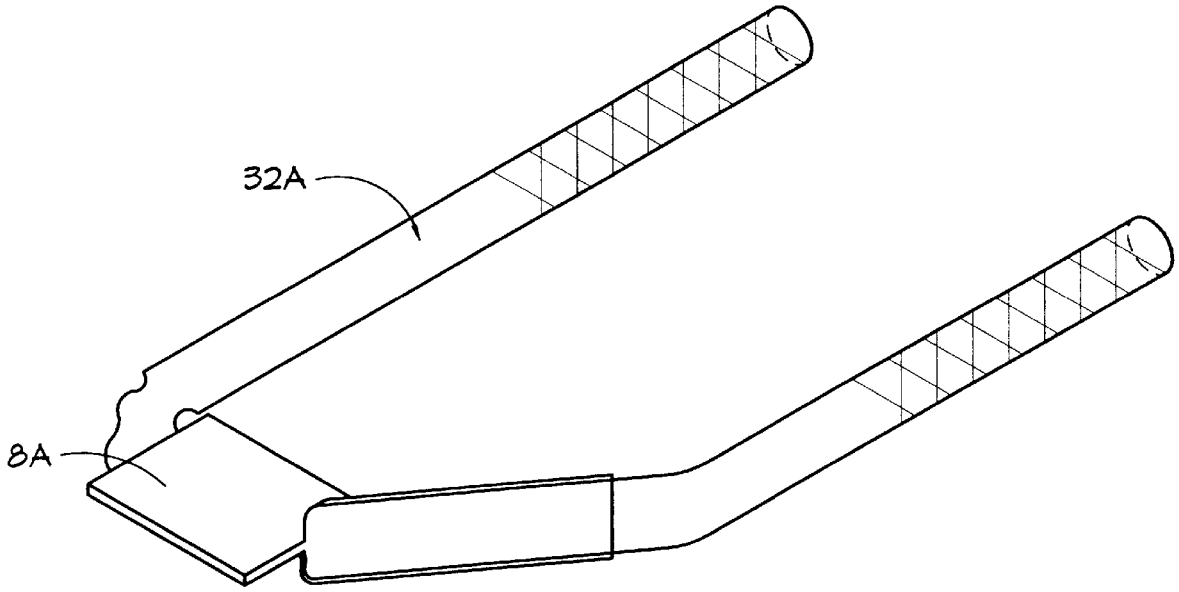
FIG. 12D is a perspective view of an adjustable metal staple with flattened bridge.

FIG. 12D shows a perspective view of a adjustable metal staple 32A, showing the staff 34A after insertion into the hollow 34B. The bridge 8A has been flattened edgewise in this view so that the adjustable metal staple 32A could be used to hang a shutter cover 1 from a balcony, above a patio door that needed protection. Sheet metal hinges 3 can then be used to latch a shutter cover 1 onto the adjustable metal staple 32A, in the same fashion as a sheet metal plate 7.

Figure 12E:
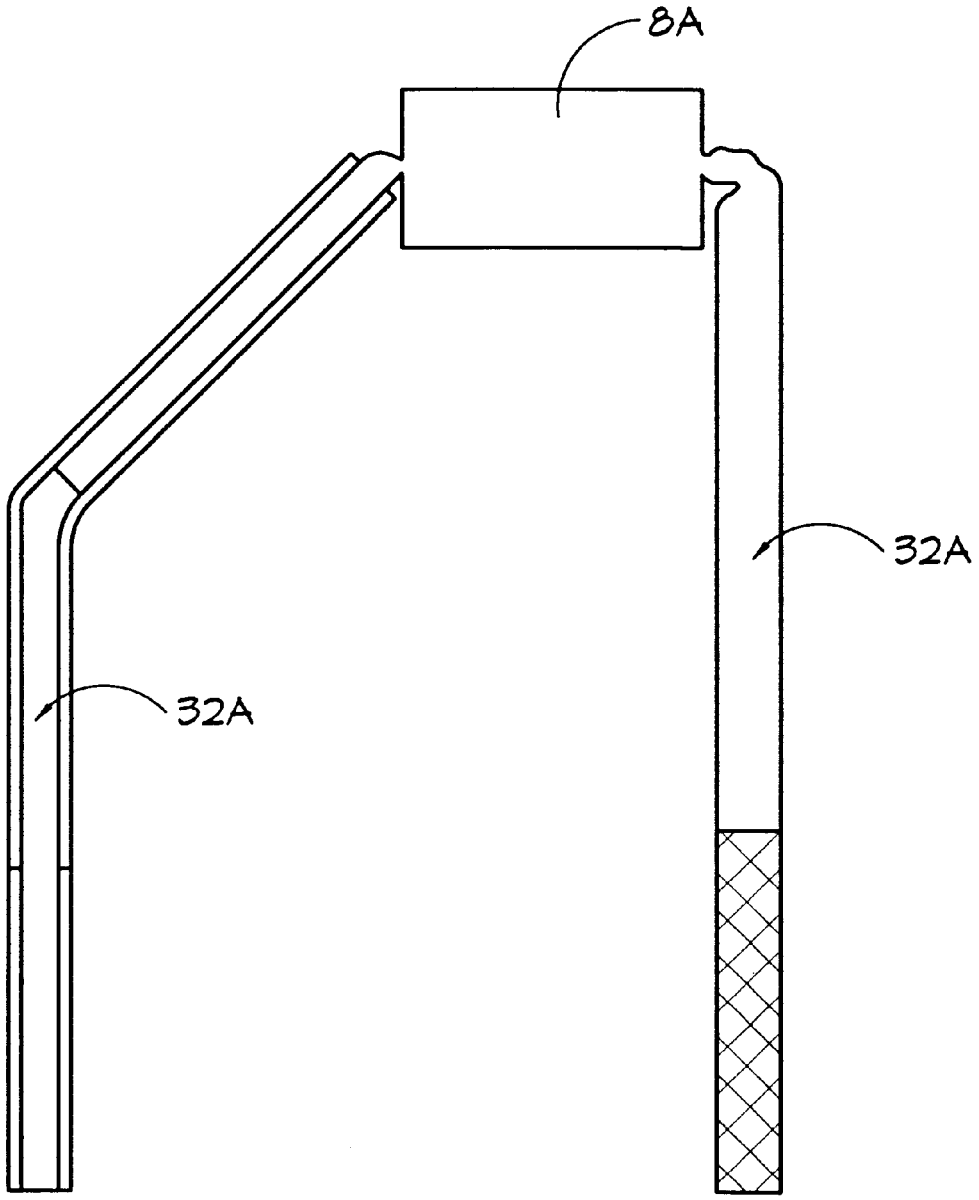
FIG. 12E is a side view of an adjustable metal staple with flattened bridge.

FIG. 12E is a side view of an adjustable metal staple 32A with the bridge 8A in a vertical position as shown in FIG. 12D.

The adjustable metal staple 32A is very simple and could be cast, forged, or formed from rod stock. The preferred method is steel rod, and the bridge 8A is flattened, and bent at the bends by standard tool-and-die methods. The knurled 37C could be rolled.

Another embodiment for concrete or concrete-block houses is the scalloped metal plate 36. Since two holes of an exact measured distance are hard to drill into concrete, a sheet metal plate using just one drilled hole is another embodiment.

Figure 13D:
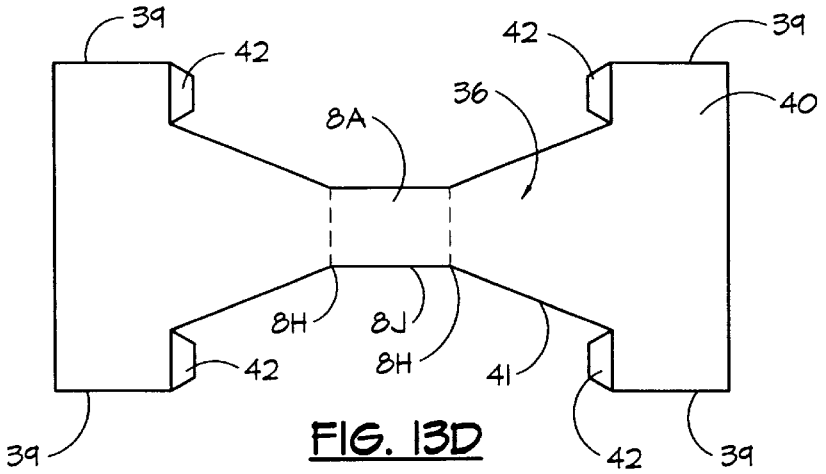
FIG. 13D is a flat pattern layout for scalloped metal plate.
Figure 13A:
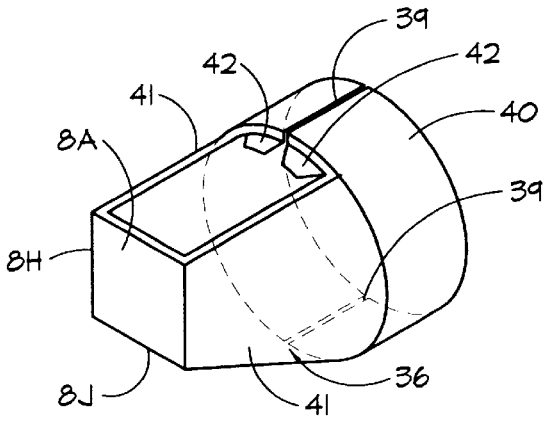
FIG. 13A is a perspective view of a scalloped metal plate.

FIG. 13A shows a perspective drawing of a scalloped metal plate 36 that would be inserted into a core circle drilled into concrete or masonry. A core drill would leave the middle part of the core attached to the concrete, relinquishing only a circle of concrete removed from the building. Standard epoxy is inserted into the core circle and the cylindrical core 40 of the scalloped metal plate 36 is inserted.

An expansion slot 39 on either side of the cylindrical core 40, made during the forming process (see FIG. 13D), helps form a tight fit in the drilled core circle of a concrete wall. The stops 42 keep the cylindrical core from descending too far into the drilled core circle and help form a tight bond with the epoxy. The stops 42 could be bent in or out, but preferably are bent in.

Connected to, and above the cylindrical core 40, a tower 41 is formed that bends into a bridge 8A. The bridge forms a liberal 8H having the same width as the stature 8C on the bridge 8A of a horizontal sheet metal plate 7 from FIG. 5B. The width of the bridge 8A and the height of the tower 41 allow the top hook 12 and bottom hook 13 of a sheet metal hinge 3 to latch together with the scalloped metal plate 36. The length across the span 8J allows a latched sheet metal hinge 3 to have side clearance and allows some installation slop when the scalloped metal plate 36 is attached to a wall.

Figure 13C:
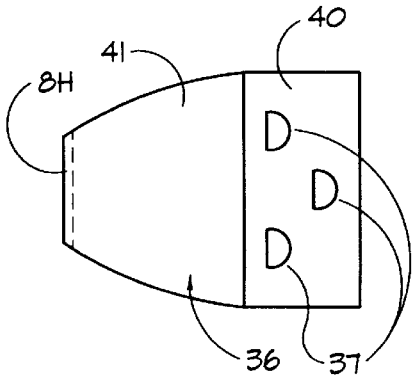
FIG. 13C is a side view of a scalloped metal plate.
Figure 13B:
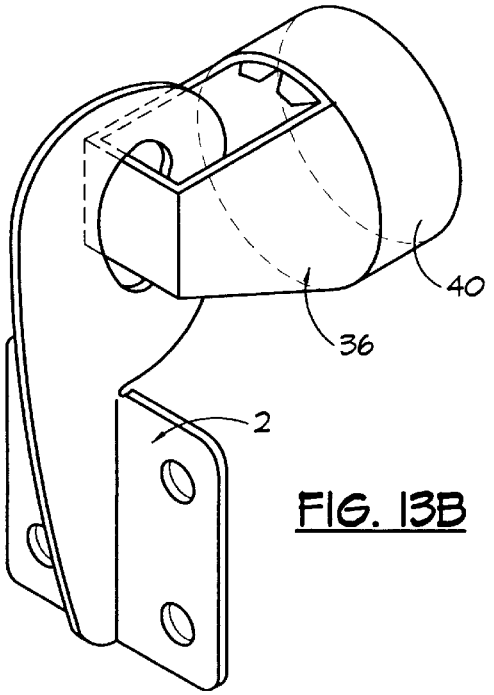
FIG. 13B is a perspective view of a scalloped metal plate and sheet metal hinge.

FIG. 13B shows how a sheet metal hinge 3 would be latched onto a scalloped metal plate 36. This would be if the scalloped metal plate 36 was inserted above a window. If the scalloped metal plate was attached below a window, the sheet metal hinge 3 and attached shutter cover 1 would rotate or pivot upwards approximately 180°. The sheet metal hinge 3 and attached shutter cover 1 would latch onto the scalloped metal plate 36 at approximately 45°.

FIG. 13C shows a side view along the tower 41 of a scalloped metal plate 36. This view also shows the width of the liberal 8H part of the bridge 8A, and part of the cylindrical core 40. In order to form a tighter and more secure bond with the epoxy in the drilled core hole, holes or scallops 37 could be punched into the cylindrical core 40.

The scallops 37, similar to the cutting edges of a cheese grater, and facing so that they would slide in easily, but grip the outer core wall if the scalloped metal plate 36 had a force pulling it out. The scallops 37 would grip the edge of the core circle and form a tighter bond with the epoxy.

FIG. 13D shows a flat pattern layout for a scalloped metal plate 36 before forming by standard tool-and-die methods. This view shows the cylindrical core 40 before forming the expansion slots 39, and stops 42. The tower 41 connects the cylindrical core 40 with the bridge 8A. The bridge 8A shows the bend line at the liberal 8H and the width of the bridge 8A at the span 8J.

Figure 14A:
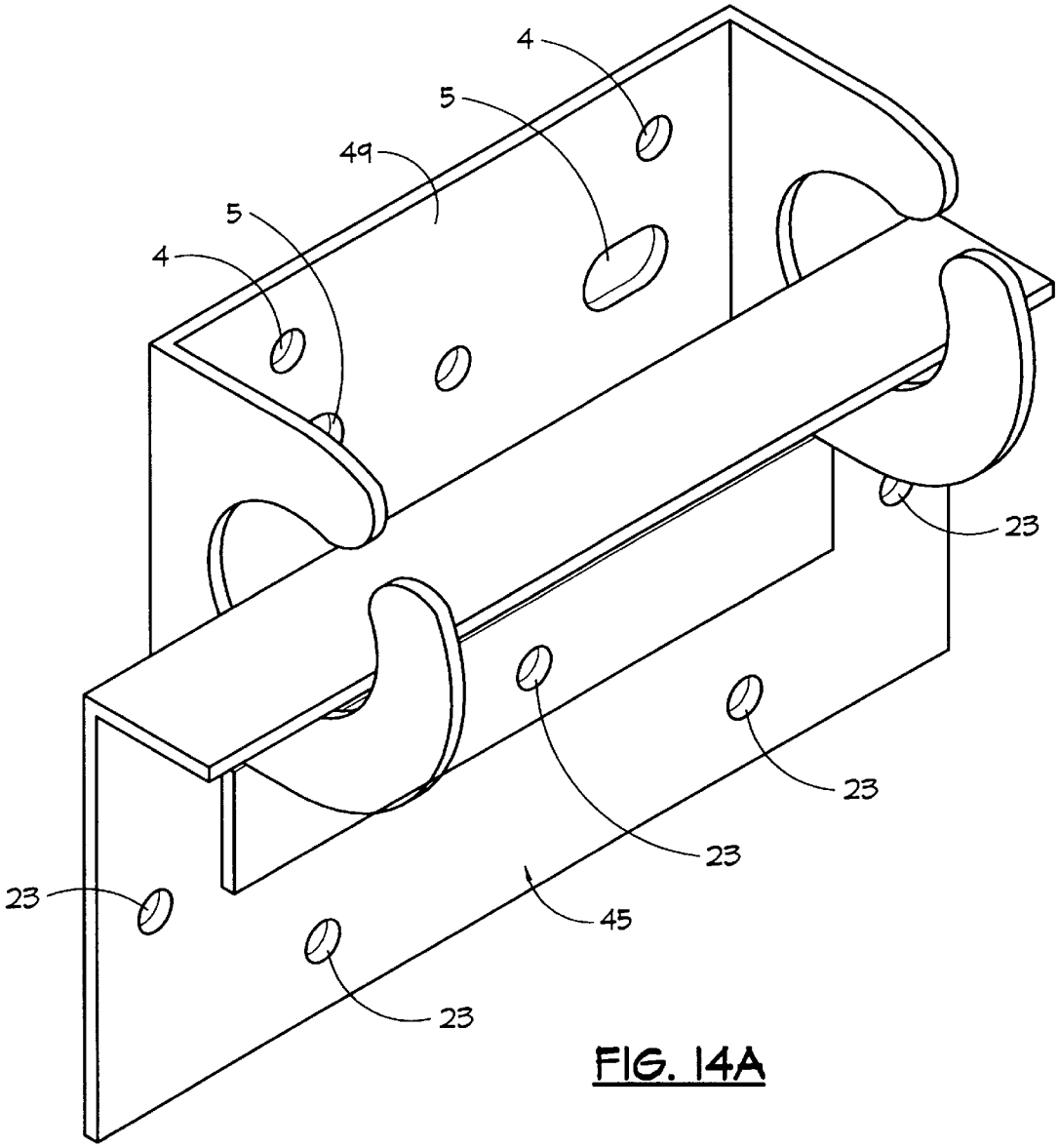
FIG. 14A is a perspective view of a handle plate and handle hook.

Refer now to FIG. 14A which shows a perspective view of a handle plate 45 latched onto a handle hook 49. This embodiment is different than the previous shutter connectors in that the hook is attached to the wall of the house and the plate is attached to the shutter cover 1. Although many types of shutter covers can be used with this heavy-duty embodiment, the preferred shutter cover is made of plywood. Bolt holes 23, lag bolt holes 5, and nail holes 4 are shown on this perspective.

Figure 14B:
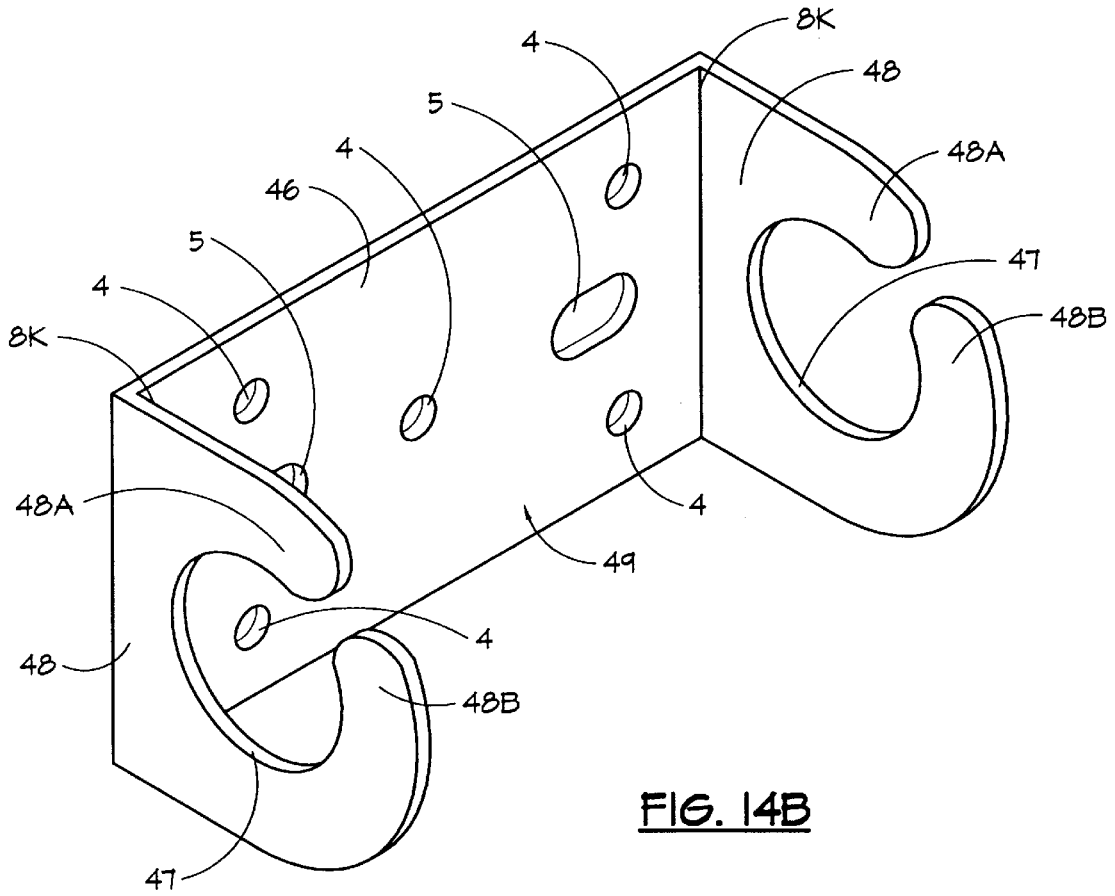
FIG. 14B is a perspective view of a handle hook.

FIG. 14B shows a perspective of the handle hook 49. The backing 46 has lag bolt holes 5 and nail holes 4 in order to be attached to a wall above, below, or to the side of a window; especially large windows such as store fronts, picture windows, or patio doors. At either end of the backing 46, liberty bends 8K, at approximately right angles, form jay hooks 48, with top jay hooks 48A, side jay hooks 48B, and pivot opening 47.

Figure 14E:
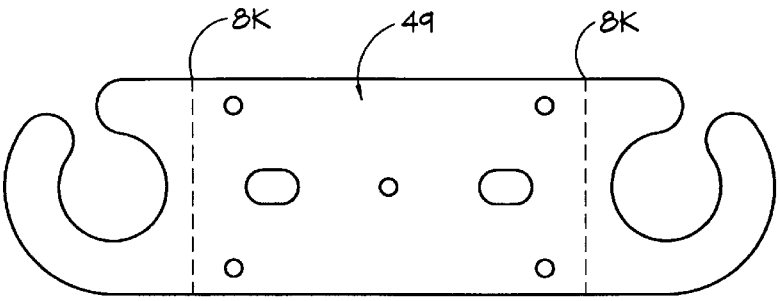
FIG. 14E is a flat pattern layout of a handle hook.
Figure 14C:
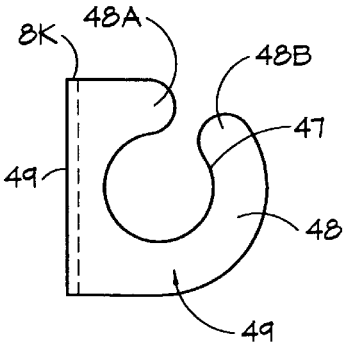
FIG. 14C is a side view of handle hook

FIG. 14C shows a side view of a handle hook 49. The top jay hook 48A of the jay hook 48, is attached to the backing 46 and forms a small opening at about the one o'clock position. The side jay hook 48B provides the other side of the opening, which opens into the pivot opening 47. The pivot opening 47 is approximately circular in shape and is wide enough to accommodate the handle bar 50 of a handle plate 45.

Figure 14D:
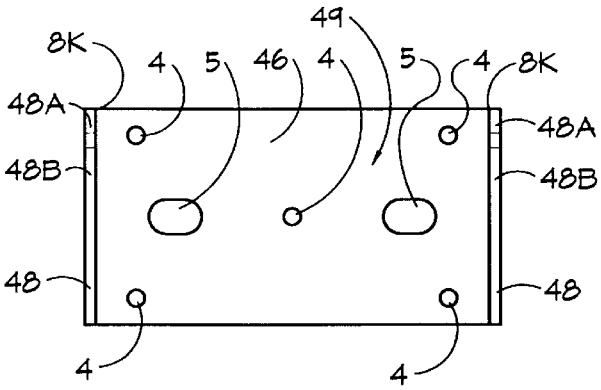
FIG. 14D is a front view of a handle hook.

FIG. 14D shows a front view of a handle hook 49, as it would be attached to a wall by nails and lag bolts driven through the nail holes 4 and lag bolt holes 5. The backing 46 has lag bolt holes 5 and nail holes 4 in order to be attached to a wall above, below, or to the side of a window. At either end of the backing 46, liberty bends 8K, at approximately right angles, form jay hooks 48, with top jay hooks 48A and side jay hooks 48B.

FIG. 14E shows a flat pattern layout of a handle hook 49 as it would be stamped from sheet metal, by standard tool-and-die methods, prior to bending at the liberty bends 8K.

Figure 15A:
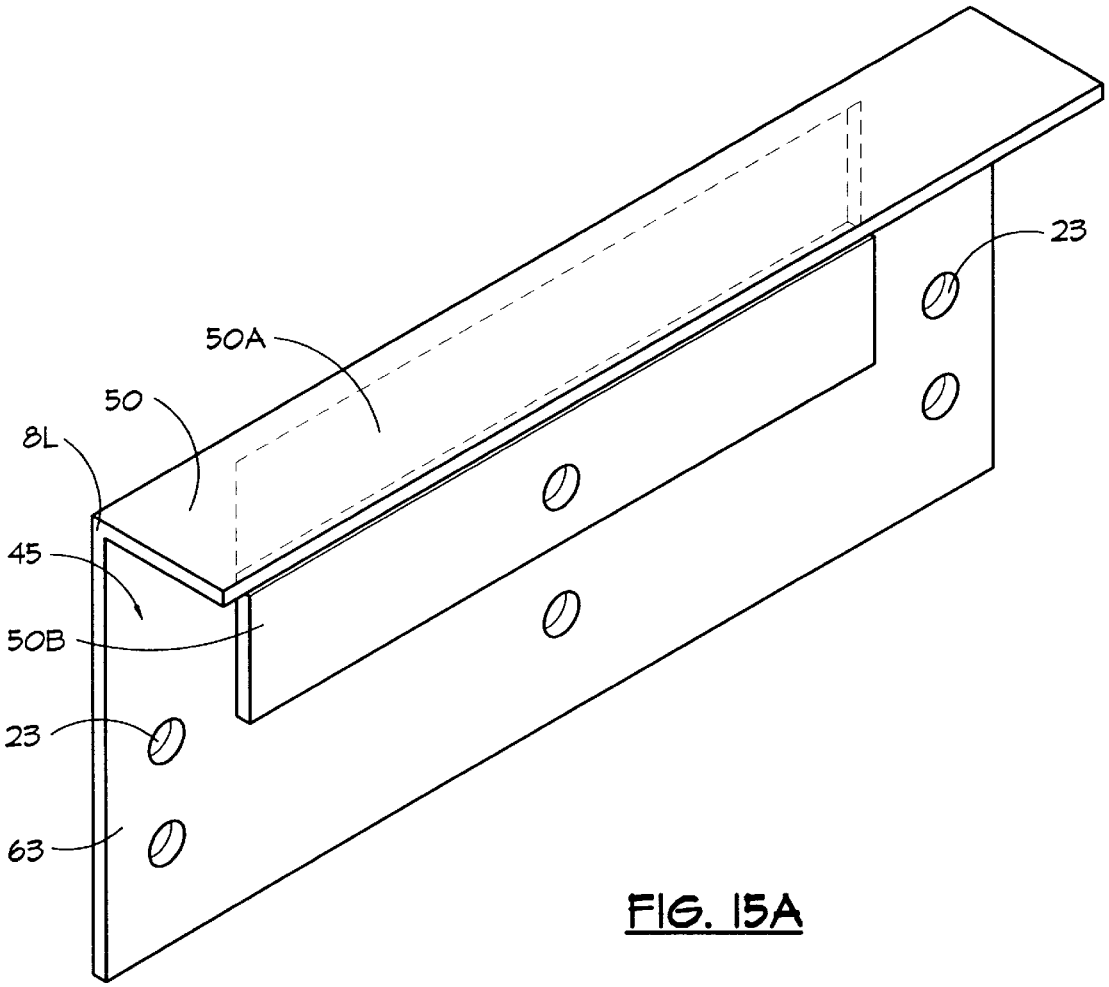
FIG. 15A is a perspective view of a handle plate.

FIG. 15A shows a perspective view of a handle plate 45, that is shown latched onto a handle hook 49 in FIG. 14A. The top part of the handle plate 45 has a handle bar 50, that is bent at an approximately right angle to the backbone 63 of the plate. The handlebar 50 is bent at the corner bend 8L.

Underneath the handlebar, but hidden in this view, is the window 50A. This window 50A is formed by cutting and bending down the window flap 50B. The window flap 50B could be bent to the rear or eliminated, but it adds some strength. The window 50A is a handle that the homeowner can use to carry and install the handle plate 45, and attached shutter cover 1, onto a handle hook 49.

The length of the window 50A opening is slightly larger than the distance between the jay hooks 48 of a handle hook 49. The width of the window 50A opening allows a side jay hook 48B to latch into the window 50A at about a 45° angle and pivot down.

The handle hook 49 and handle plate 45 will lock together, and disengage, only when the handle plate 45 and attached shutter cover 1 are at about 45° . The handle plate 45, and attached shutter cover 1, and handle hook 49 are now latched together, as shown in FIG. 14A. Latches would hold the other part of the shutter cover to the wall. The bottom of the backbone 63 contains bolt holes 23 that would be used to attach a plywood sheet or other flat material for a shutter cover 1. If the handle hook 49 were installed below a window, the handle plate 45 would still latch at about 45°, but would swing up about 135° to cover the window above the handle hook 49.

If the window to be covered were a store window that went almost to the ground, the handle bar 50 could be bent at about 45° at the corner bend 8L,instead of about 90°. This would allow the handle plate 45, and attached shutter cover 1, to latch onto the handle hook 49 at about 90° from vertical. This allows the shutter cover 1 to clear the sidewalk and will still swing up about 90° and lock tight.

Figure 15B:
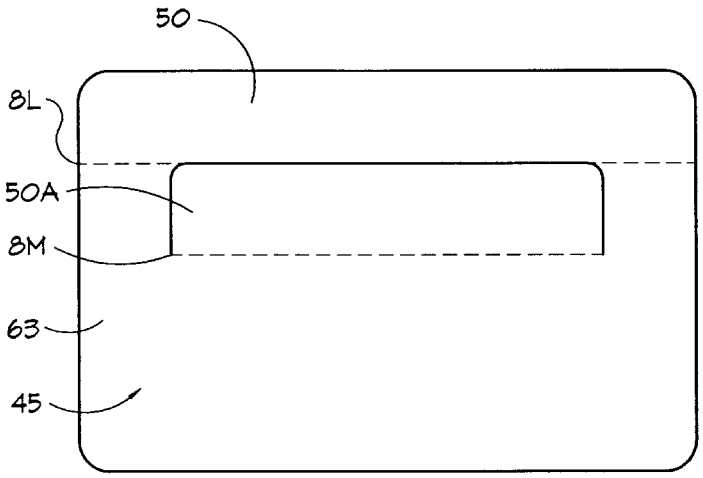
FIG. 15B is a flat pattern layout of a handle plate.

Refer now to FIG. 15B which is a flat pattern layout of a handle plate 45 before bending. This shows the handle bar 50 at the top before being bent to the rear at an approximately right angle at the corner bend 8L. The window 50A will be cut on three sides, and bent at the window bend 8M.

The backbone 63 will have bolt holes 23 punched. The tool-and-die for this plate can be used for other plates.

Figure 15C:
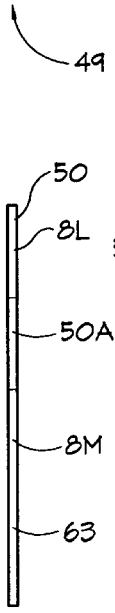
FIG. 15C is a side view of a handle plate before bending.

FIG. 15C shows a side view of a flat pattern layout of a handle plate 45 before bending. This shows where the bend lines for the corner bend 8L and window bend 8M will occur.

Figure 15D:
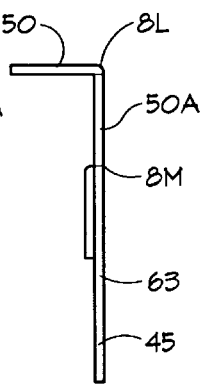
FIG. 15D is a side view of a handle plate after bending.

FIG. 15D shows a side view of a handle plate 45 after bending. The handle bar 50 is now at the correct angle after bending at the corner bend 8L. The window 50A has been opened by cutting, and bending the resulting cutout at the window bend 8M. The backbone 63 has the bolt holes 23 punched out.

Figure 16A:
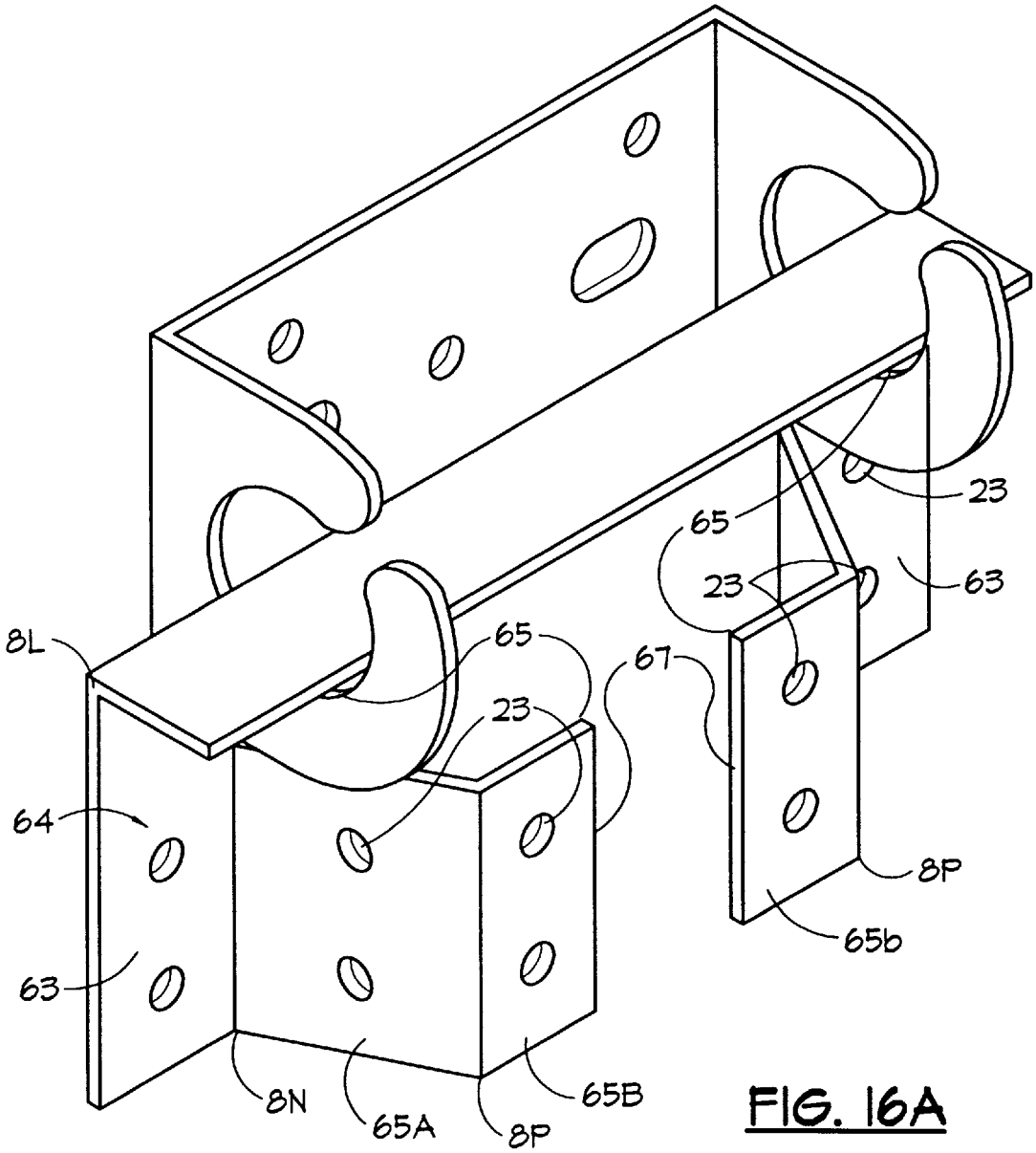
FIG. 16A is a perspective view of a corrugated handle plate.

Refer now to FIG. 16A which shows a different embodiment of the handle hook 45. The corrugated handle plate 64 is mostly similar to the handle hook 45 except that the backbone 63 has corrugation tabs 65. The corrugated handle plate 64 is designed for corrugated steel 66 as the shutter cover 1. A handle bar 50, similar in size and shape to one on the handle plate 45, is bent at an approximately right angle at the corner bend 8L. The handle bar 50 latches onto a handle hook 49 in the same fashion as a handle plate 45 and can rotate in the same manner.

The corrugation tabs 65 are bent out in the same pattern as the ribs of the corrugated steel sheet 66. The corrugation tabs 65 are bent out from the backbone 63 at the valley bends 8N. This forms a slope tab 65A that would be attached to the slope 68B of corrugated steel sheet 66 with bolts through bolt holes 23. At the end of the slope tabs 65A, bends at the hill bend 8P form hill tabs 65B. The hill tab 65B is now approximately parallel to the backbone 63. Bolts through the bolt holes 23 attach the hill tab 65B to the hill 68C of corrugated steel sheet 66 (see FIG. 16B). The augmentation 67, developed when the corrugation tabs 65 are cut and formed, provides some fit adjustment if the corrugated steel sheet 66 is bent or deformed.

At the backbone 63, bolts through the bolt holes 23 attach on to similar holes in the valley 68A of a corrugated steel sheet 66. The bolt holes 23 on the backbone 63 are spaced similar to the bolt holes 23 on a sheet metal hinge 3, and the pre-drilled holes in the valley 68A of a corrugated steel sheet 66 match with holes on the backbone. This allows the corrugated steel sheet 66 to be used as a shutter cover 1 with a sheet metal hinge 3 and sheet metal plates 2 and 7.

Bolts through the corrugation tabs 65 and the backbone 63 makes for easy fastening and a very strong attachment from the corrugated handle plate 64 to corrugated steel sheet 66. The corrugated steel sheet 66 is pre-formed to the correct shape, and is pre-drilled for the correct bolt pattern. The corrugated steel sheet 66 is cut to the correct length and width to fit beyond the window or door that is to be protected.

Figure 16B:
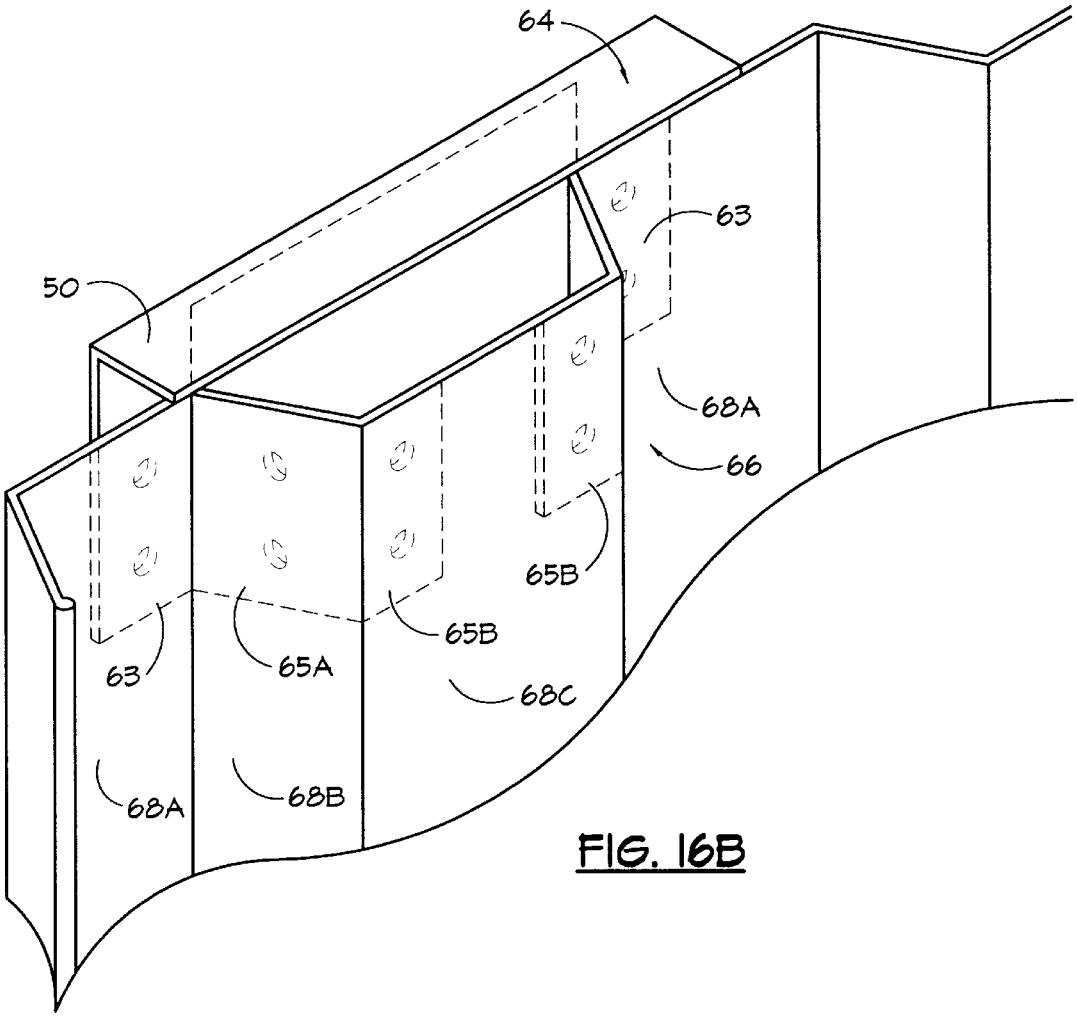
FIG. 16B is a perspective view of a corrugated handle plate attached to steel sheet.

FIG. 16B shows a perspective view of a corrugated handle plate 64 that is bolted (bolts omitted for clarity) to a corrugated steel sheet 66. This view shows how the corrugated handle plate 64 "nests" into the corrugated steel sheet 66. The backbones 63 line up behind the valleys 68A; the slope tabs 65A line up with the slope 68B; the hill tabs 65B line up with the hill 68C, and all the bolt holes 23, from the corrugated handle plate 64 and the corrugated steel sheet 66 line up.

All the bolts, attaching points, and metal bends, make for a very strong shutter cover 1. The corrugated handle plate 64, and attached corrugated steel sheet 66, are now ready to be latched onto a handle hook 49.

If the handle hook 49 is installed over a window or door, or to the side, the corrugated handle plate 64, and attached corrugated steel sheet 66, are latched together with the handle bar 50 from the corrugated handle plate 64, and the jay hooks 48 from the handle hook 49. The handle bar 50, and the jay hooks 48 latch together at about 45° and then pivot down, or to the side, to protect a window or door.

If the handle hook 49 is installed below a window, the corrugated handle plate 64, and attached corrugated steel sheet 66, are flipped over so that the corrugated steel plate 66 faces the window. Then the rear of the handle bar 50 is latched onto the jay hooks 48 of the handle hook 49, at about 45°, and the corrugated handle plate 64 is pivoted up about 135°. The corrugated steel sheet 66 is now in correct position to protect a window.

Figure 16C:
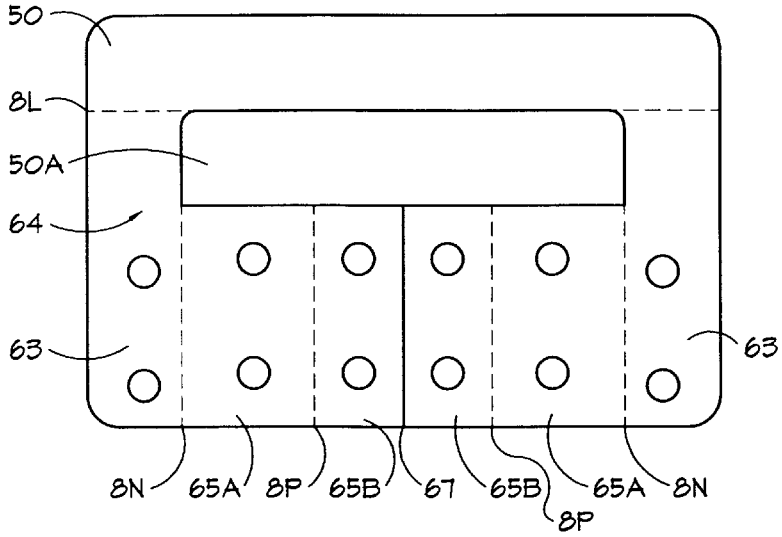
FIG. 16C is a flat pattern for a corrugated handle plate.

FIG. 16C is a flat pattern layout of a corrugated handle plate 64 before forming by standard tool-and-die methods. The handle bar 50 will be bent at an approximate right angle, toward the viewer, at the corner bend 8L. The window 50A is cut completely out, instead of being bent over like on the handle plate 45. The bend lines at the valley bends 8N and the hill bends 8P form the slope tabs 65A and hill tabs 65B when bent. The cut at the augmentation 67 separates the two hill tabs 65B. The corrugated handle plate 64 and handle plate 45 can use the same tool and die, with slight modifications, saving manufacturing costs and costs to the consumer.

Figure 16D:
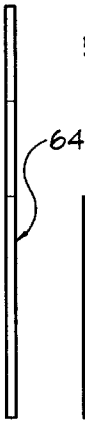
FIG. 16D is a side view of a corrugated handle plate prior to bending.

FIG. 16D shows a side view of a flat pattern layout of a corrugated sheet metal plate 64 prior to forming.

Figure 16E:
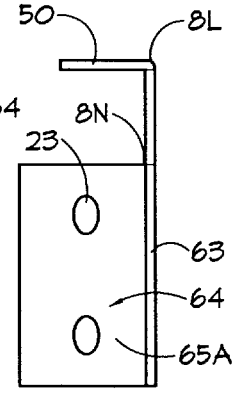
FIG. 16E is a side view of a corrugated handle plate after bending.

FIG. 16E shows a side view of a corrugated sheet metal plate 64 after forming. The handle bar 50 is at an approximate right angle from a bend at the corner bend 8L. Looking edge on at the backbone 63, the hill tab 65A, with bolt holes 23, is shown bent out from a bend at the valley bend 8N.

Figure 16G:
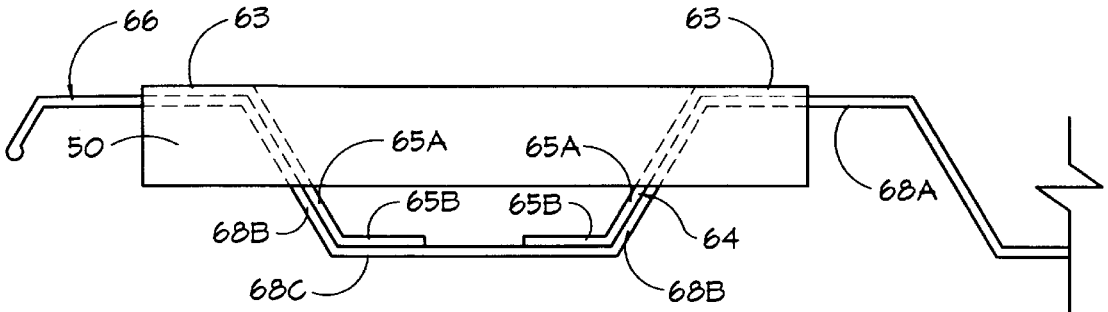
FIG. 16G is a top view of a corrugated handle plate.
Figure 16F:
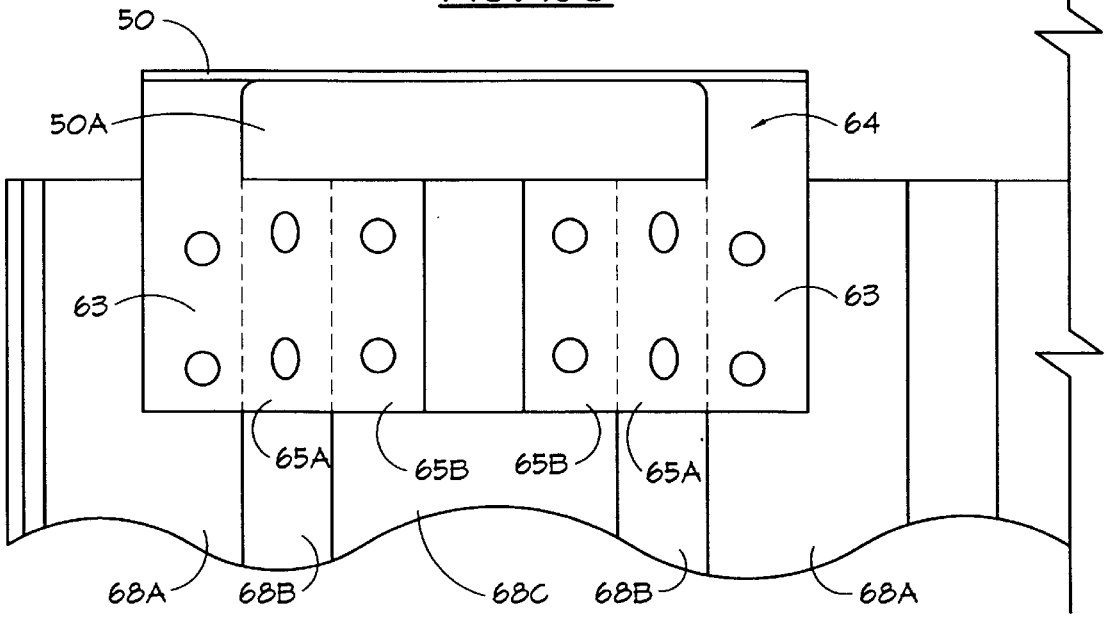
FIG. 16F is a rear view of a corrugated handle plate.

FIG. 16F is a rear view of a corrugated handle plate 45 and attached corrugated steel sheet 66. This view looks through the window 50A and rear edge of the handle bar 50 and shows how the corrugated handle plate 64 "nests" onto the corrugated steel sheet 66. The backbones 63 line up behind the valleys 68A; the slope tabs 65A line up with the slope 68B; the hill tabs 65B line up with the hill 68C, and all the bolt holes 23, from the corrugated handle plate 64 and the corrugated steel sheet 66 line up.

FIG. 16G is a top view of a corrugated handle plate 45 and attached corrugated steel sheet 66. This view shows the top of the handle bar 50 and how the corrugated handle plate 64 "nests" onto the corrugated steel sheet 66. The backbones 63 line up behind the valleys 68A; the slope tabs 65A line up with the slope 68B; and the hill tabs 65B line up with the hill 68C.

In newer condominiums and some apartment houses, several windows may be constructed where there is no framing around the window. A window may be set next to the support beams of a ceiling, wall support, or divider between apartments on a balcony. If the windows are on the second story or higher, shutters can be installed on the inside of the window. Any of these fasteners may be used inside a house, depending on the material, wood or masonry, that the home is made from. An inside shutter may not protect the window, but will help prevent rain, wind, and debris from entering the interior.

Sometimes, a sheet metal plate (vertical) 2 or sheet metal plate (horizontal) 7 can not be installed above, below, or to either side of a window, inside an apartment or condominium.

Figure 17A:
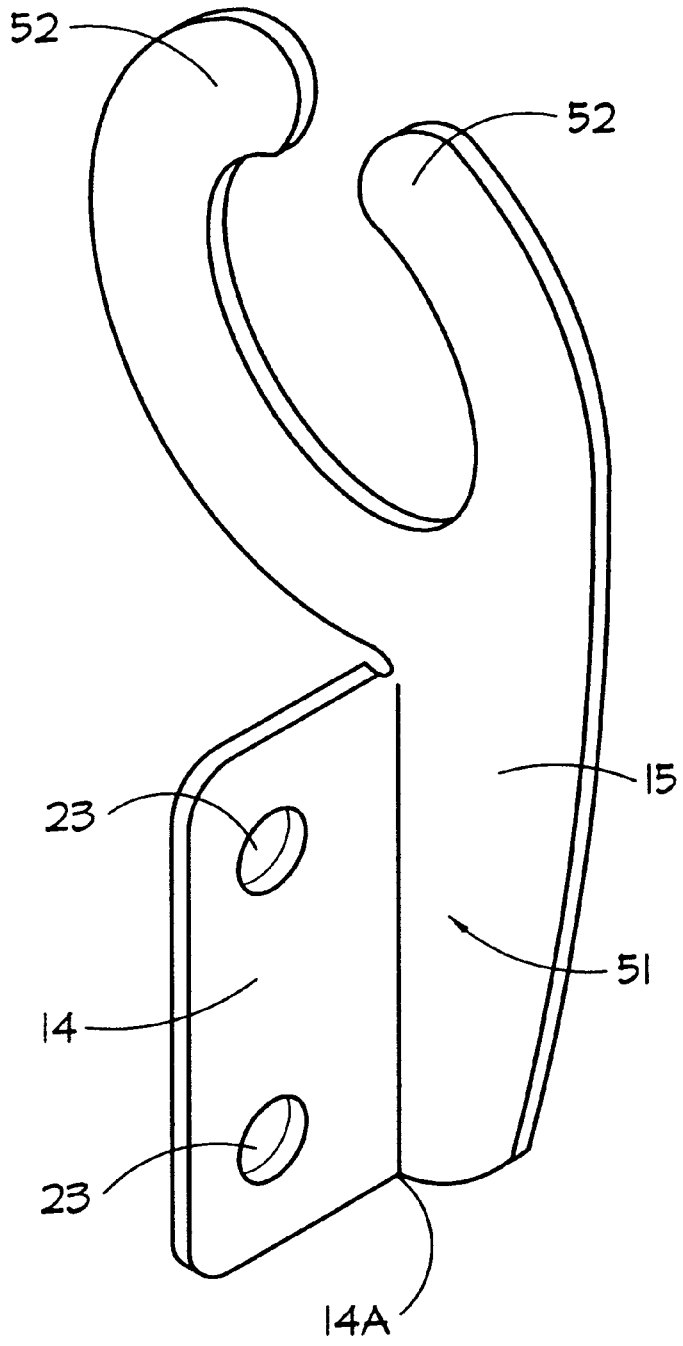
FIG. 17A is a perspective view of a ceiling hook.

Refer now to FIG. 17A which shows a perspective view of a ceiling hook 51. The ceiling hook 51 is similar to a sheet metal hook 3. The top hook 12 and bottom hook 13 of a sheet metal hinge 3 have been rotated approximately 90°, so that the hooks now face up. The base member 14 of the ceiling hook 51 is the same as a sheet metal hook 3. Bolts and nuts (not shown) attach the ceiling hook 51 to a shutter cover 1 through bolt holes 23 on the base member 14. A right-angle bend 14A on the right side of the base member 14 forms the web component 15A. The web component 15A contains alignment indentations 9 (on back side) for attaching a left and right ceiling hook 51 together, and hanging hooks 52 on the top.

FIG. 17A shows a perspective view of a ceiling hook 51, installed to a shutter cover 1 (not shown) that has been trimmed to cover the window from the inside. The ceiling hook 51 contains two facing hanging hooks 52 at the top with a small space between them. The small space allows the ceiling hook 51 to latch onto a ceiling plate 53 at about a 45° angle and rotate down to lock tight, similar to a sheet metal hinge 3, when hanging vertically against a window. The ceiling hook 51 can be used inside and outside a house. Some patio doors on condominiums have no clearance above the door. If a metal staple 32 is inserted in a vertical position, into the concrete slab of the patio floor above, then the bridge 8A, of the metal staple 32, is horizontal. This allows a ceiling hook 51 to latch onto the metal staple 32.

The lower part of the ceiling hook 51 has a web component 15A that is similar to the web member 15 of a sheet metal hinge 3. A right-angle bend 14A forms the base member 14 that has bolt holes 23 for attaching onto a plywood sheet 1. The ceiling hook 51 can be cut from sheet metal and bent 90° at the right angle bend 14A.

A ceiling plate 53 can be installed to the ceiling joist and top plate above a window or door. With a ceiling plate 53 (FIG. 18A) installed, a ceiling hook 51 and attached plywood sheet 1 can be installed from the inside of a house. A shutter installed inside the house will keep rain, wind, and wind-blown missiles from entering the apartment. The shutter cover 1, held tight against the window or glass door, may prevent the wind and air pressure from blowing the glass in or out.

When a ceiling hook 51 is fastened to a shutter cover 1, and a hurricane is expected, a homeowner can lift one end of the shutter cover 1 and can use the hanging hook 52 to grapple and fasten onto a ceiling plate 53 that is anchored to the ceiling and wall above a window or above a patio door. Once that end of the shutter cover 1 is fastened, the other end of the cover is much lighter to lift since much of the weight is already suspended by the ceiling plate 52. Latches would hold the bottom part of the shutter cover closed.

Figure 17B:
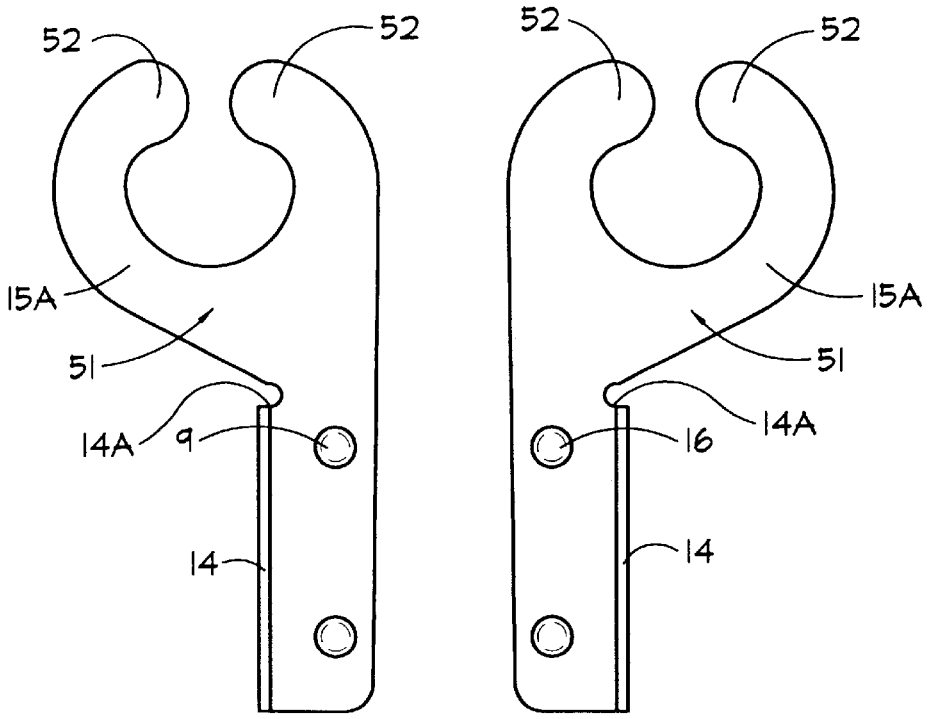
FIG. 17B is a side view of a left and right-handed ceiling hook.
Figure 18A:
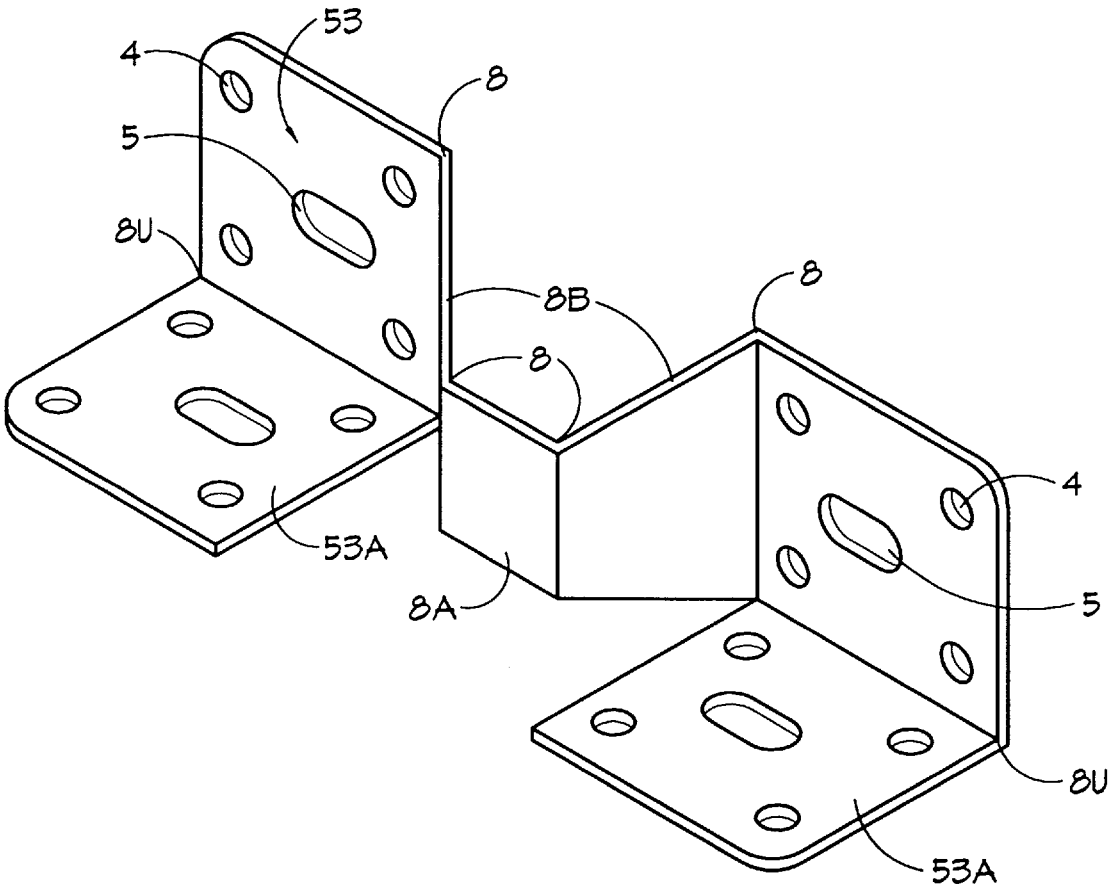
FIG. 18A is a perspective view of a ceiling plate.

FIG. 17B shows a side view of a right- and left-hand ceiling hook 51. Hidden from view in the base member 14, facing the viewer, are bolt holes 23 for fastening to a shutter cover 1. The right-angle bend 14A forms the web component 15A. The elliptical opening between the hanging hooks 52 helps the ceiling hook 52 grapple, latch, and lock onto a ceiling plate 53 (FIG. 18A). Although other shapes could be used, the preferred shape is elliptical. When a shutter cover 1 is fastened to a ceiling hook 51, and a hanging hook 52 is grappled at 45° and fastened to the ceiling plate 53 above a window or patio door, the shutter cover 1 can be pivoted down over the window or patio door.

Figure 17C:
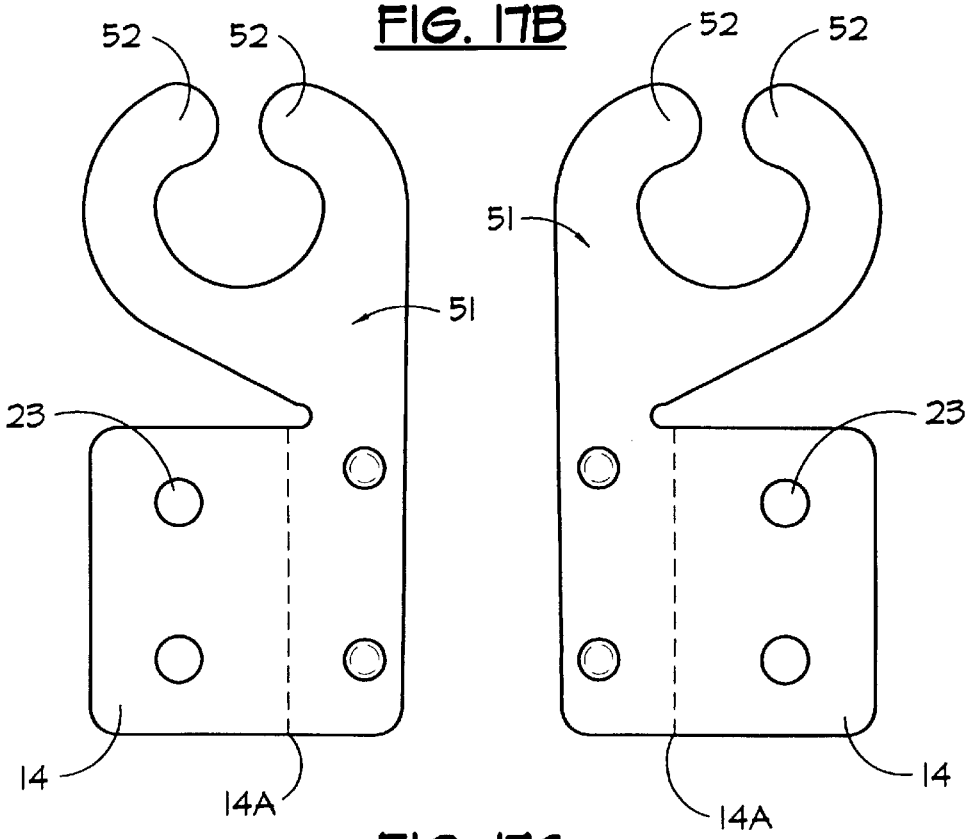
FIG. 17C is a flat pattern layout for left and right-handed ceiling hooks.

FIG. 17C shows a flat pattern layout of left- and right-hand ceiling hooks 51. The base member 14 contains bolt holes 23 for attaching a shutter cover 1 with bolts and nuts. The right angle bend 14A will form the web component 15A that has the hanging hooks 52.

Figure 17D:
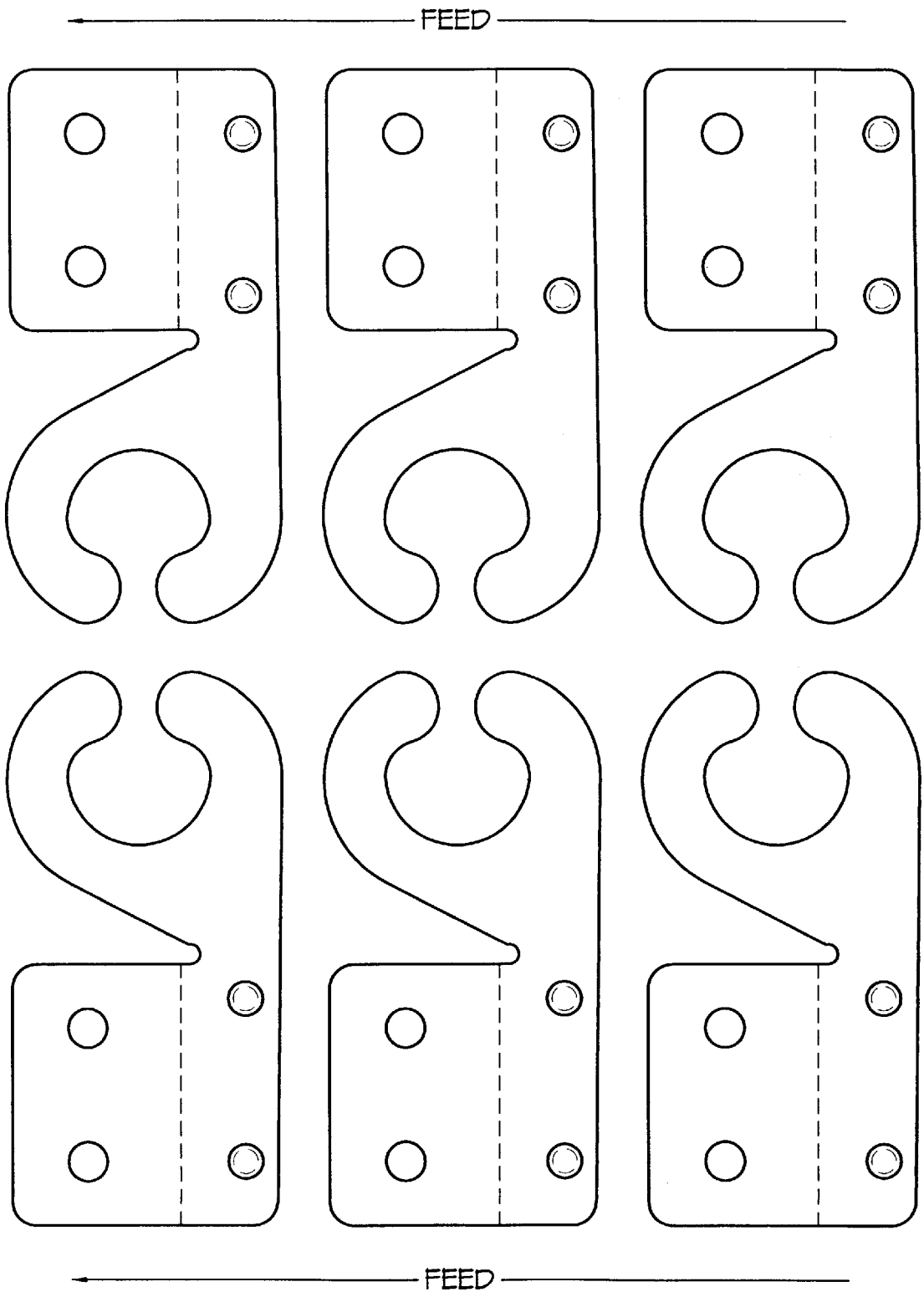
FIG. 17D is a flat pattern layout for forming left and right-handed ceiling hooks.

FIG. 17D shows the flat pattern layout for a ceiling hook 51 prior to being formed by standard tool-and-die stamping. The ceiling hook 51 is sent in for stamping in direction indicated.

Refer now to FIG. 18A which shows a perspective view of a ceiling plate 53 for latching a ceiling hook 51. The ceiling plate 53 is similar to a horizontal sheet metal plate 7, except the bridge 8A is offset to one side, and top plate tabs 38 are added to each side at approximate right-angle bends at the veer bend 8U. Nails or screws through the nail holes 4, and lag bolts through the lag bolt holes 5 secure the ceiling plate 53 to a wood or masonry wall above a window or door, inside a house. The bend lines 8 help make and support the bridge 8A so that a ceiling hook 51 can grapple onto the ample 8D and pivot across the stature 8C.

The stature 8C across the bridge 8A allows a ceiling hook 51 to connect, rotate, and lock in a vertical position. The ample 8D across the bridge 8A allows some leeway for inaccurate measuring when attaching a ceiling hook 51 to a shutter cover 1, similar to the hinge hole 3 of a vertical sheet metal plate 2.

FIG. 18A is a perspective view of a ceiling plate 53. The ceiling plate 53 is similar to a horizontal sheet metal plate 7, but has added top plate tabs 38 and the bridge 8A is offset. The ceiling plate 53 would be installed inside a house above a window or door.

The veer bend 8U would be placed in the corner where the ceiling meets the wall. A common stud-finder could be used to find the ceiling joist, and nails and lag bolts would be used to fasten the top part of the ceiling plate 53 to the ceiling joist. Nails and lag bolts would attach the top plate tab 38 to the structural top plate of the wall. FIG. 17A does not show how a ceiling hook 51 is latched and locked in position on a ceiling plate 53.

Figure 18C:
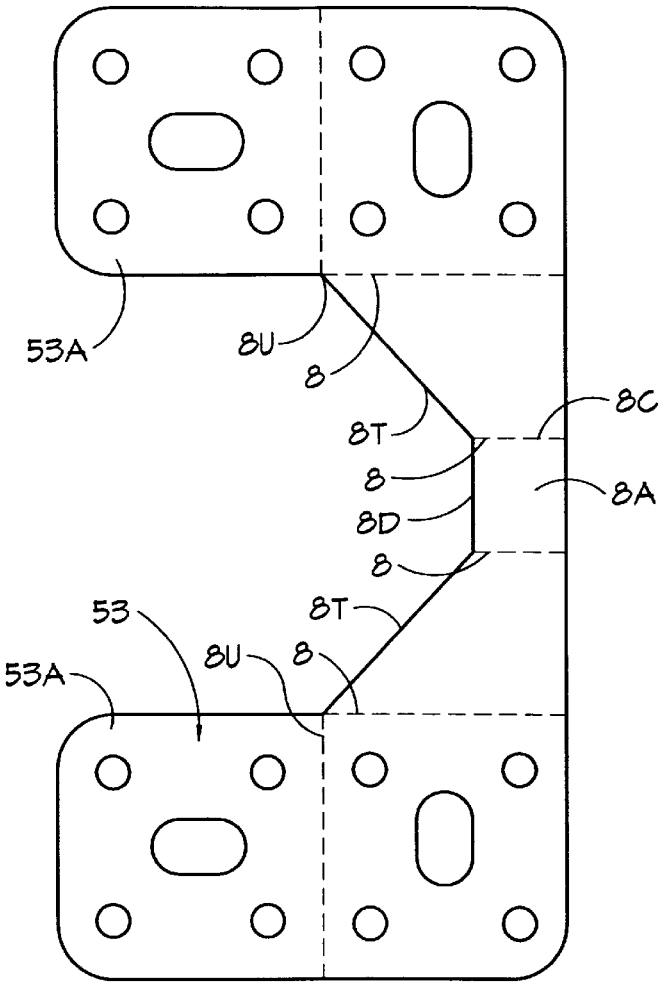
FIG. 18C is a flat pattern layout of a ceiling plate.
Figure 18B:
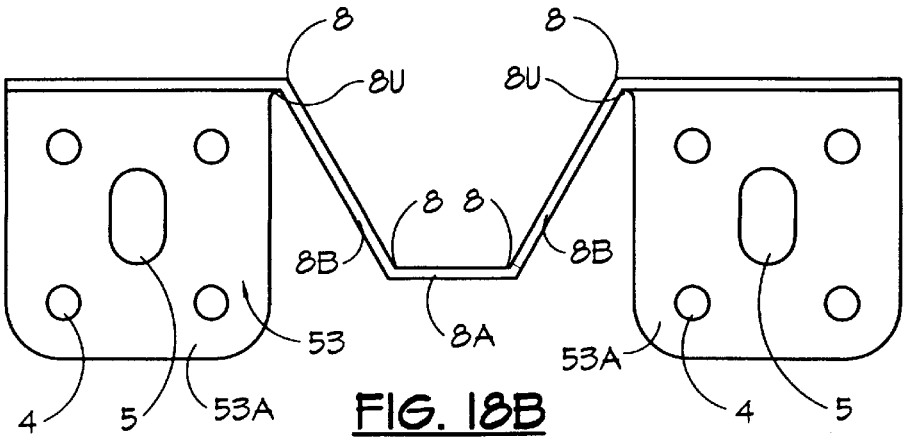
FIG. 18B is a side view of a ceiling plate.

FIG. 18B is a side view of a ceiling plate 53. The four radiuses at the bends 8 have the same benefits as on a horizontal sheet metal plate 7. The cut out balances 8T and ample 8D fashion a strong trapezoidal shape to the sides that form the bridge 8A. The stature 8C across the bridge 8A, forms the means of attaching and locking a ceiling hook 55. The height of the bridge 8A, from where the base attaches to a wall, allows a ceiling hook 51 to connect, and lock on to the ceiling plate 53, and allows the shutter cover 1 to protect the inside of a house or apartment from hurricane damage.

FIG. 18C is a flat-pattern layout of a ceiling plate 53 prior to forming using standard tool-and-die methods. This view shows the triangular area that is cut out to form the balance 8T and ample 8D. The ceiling plate 53 is bent at the bend lines 8 using standard tool-and-die methods.

Figure 19B:
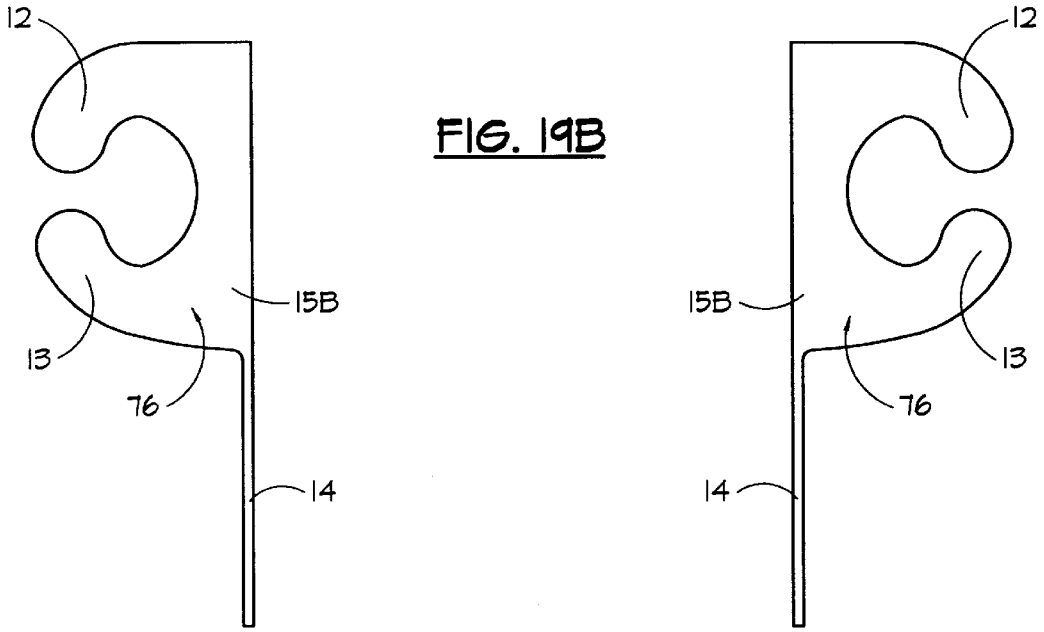
FIG. 19B is a side view of a double hook.
Figure 19A:
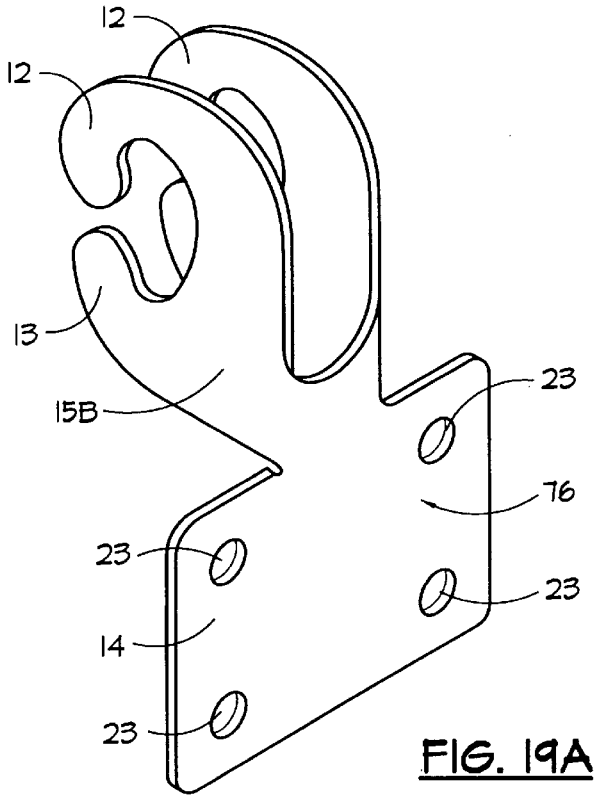
FIG. 19A is a perspective view of a double hook.

Refer now to FIG. 19A which shows a perspective view of a double hook 76. The double hook contains two parallel-facing top hooks 12 and bottom hooks 13 with a small space between them. The small space allows the double hook 76 to latch onto a double plate 77 (FIG. 19E) at about a 45° angle and lock tight vertically against a window or door. The double hook 76 looks like a sheet metal hinge 3, except that the double hook 76 is more brawny.

The double hook 76 is a heavy-duty fastener for heavy shutter covers 1. The double hook 76, and its companion the double plate 77, have larger surface areas for more nails, bolts, and lag bolts to fasten to more structural framing around a window or door. The double hook 76 and double plate 77 would be suitable for holding a massive and heavy shutter cover 1 for a large picture window or patio door.

Bolts and nuts (not shown) attach the double hook 76 to a shutter cover 1 through the bolt holes 23 on the base member 14. The web segment 15B, on top of the base member 14, contains right-angle bends 14A, near the center of the web segment 15B, that contains the top hooks 12 and bottom hooks 13.

When a double hook 76 is fastened to a shutter cover 1, and a hurricane is expected, a homeowner can lift one end of the shutter cover 1 and can use the top hook 12 to grapple and fasten onto a double plate 77 that is fastened to a wall above, below, or to the side of a window, or to the side or above a door. Once that end of the shutter cover 1 is fastened, the other end of the cover is much lighter to lift since much of the weight is already suspended by the double hook 76.

FIG. 19B is a side view of a double hook 76. The top hook 12 and bottom hook 13 are shown in profile. The elliptical opening between the top hook 12 and bottom hook 13 helps the double hook 76 grapple, latch, and lock onto a double plate 76. Although other shapes could be used, the preferred shape is elliptical.

When a shutter cover 1 is fastened to a double hook 76, and the top hook 12 is grappled at 45° and fastened to the height 6B of a double plate 77 above a window, the shutter cover 1 can be pivoted down over the window. The top hook 12 and bottom hook 13 together fastening the double hook 76 and attached shutter cover 1 securely above the window.

If double plates 77 are fastened below a window, the top hook 12 of the double hook 76 is still used to grapple and fasten onto the double plate 77 at 45°, but then the shutter cover 1 is rotated up at about 135° so that the weight of the shutter cover 1 is carried on the bottom hook 13. Both the top hook 12 and bottom hook 13 help fasten the shutter cover 1 securely to the bottom of the window. Latches, described later on, lock the shutter cover over the window.

Figure 19C:
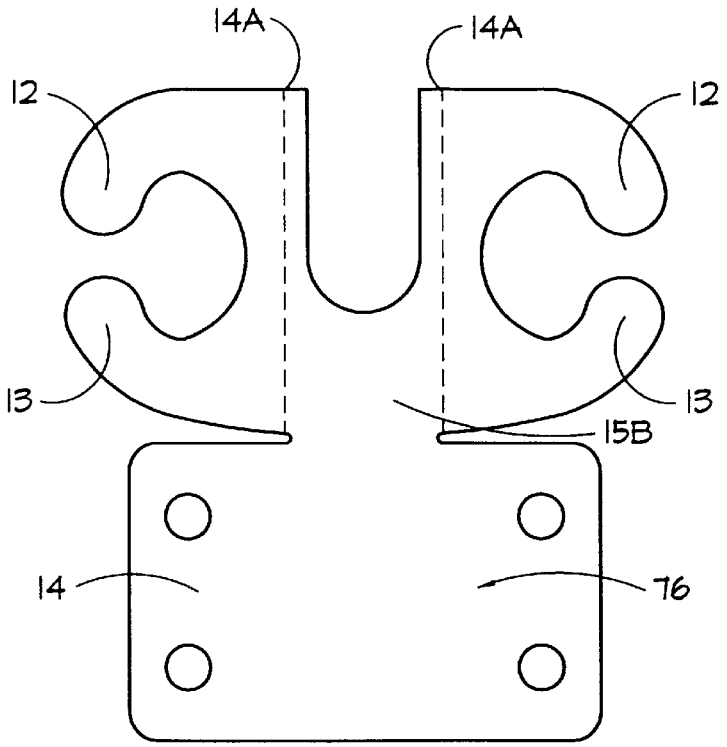
FIG. 19C is a flat pattern layout of a double hook prior to bending.

FIG. 19C is a flat pattern layout of a double hook prior to forming. The two top hooks 12 and bottom hooks 13 are bent toward each other at about right-angles along the right-angle bends 14A.

Figure 19D:
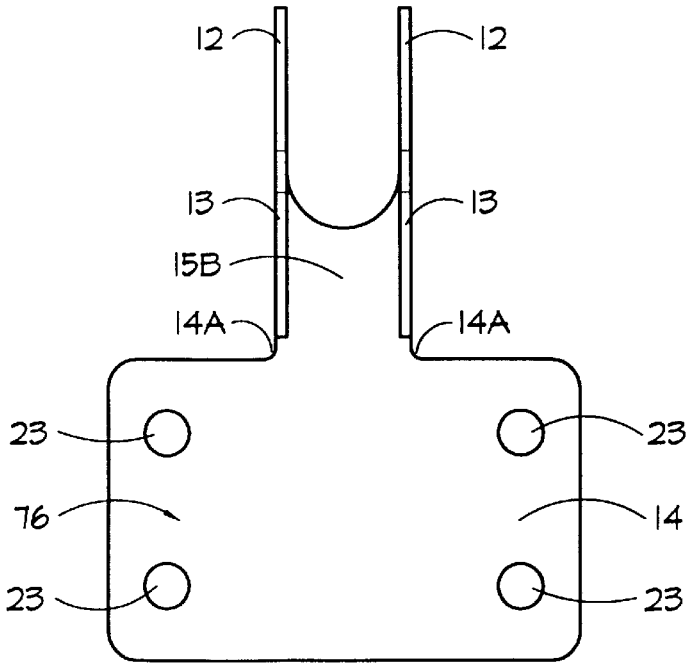
FIG. 19D is a front view of a double hook.

FIG. 19D shows a front view of a double hook 76 after bending. The top hooks 12 and bottom hooks 13 are now parallel and in line. The web segment 15B, between the bottom hooks 13 helps stiffen and strengthen the double hook 76. The base member 14 has bolt holes 23.

Figure 19E:
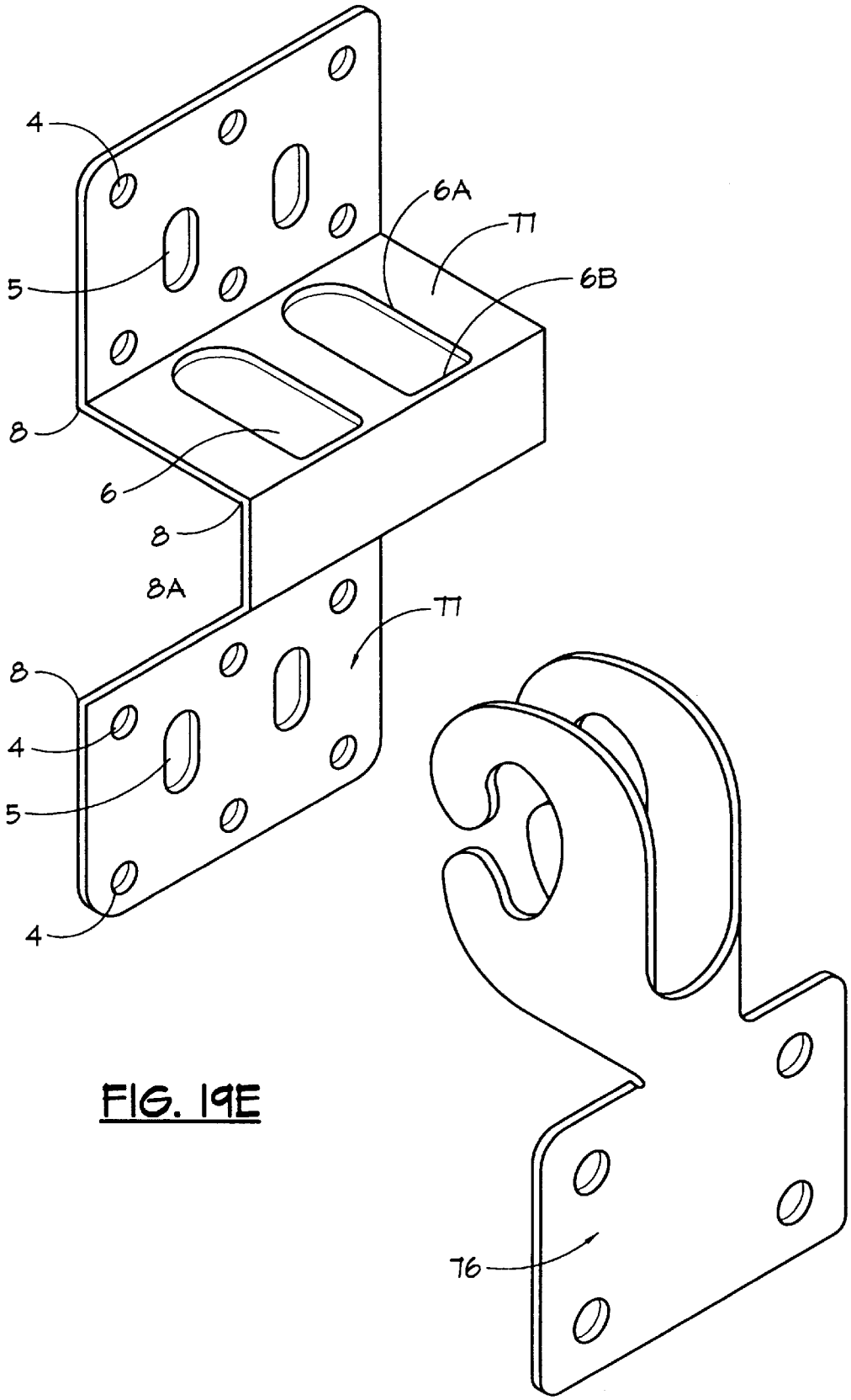
FIG. 19E is a perspective view of a double hook and double plate.

FIG. 19E is a perspective view of a double hook 76 about to grapple and latch onto a double plate 77. The double plate 77 is the same as a vertical sheet metal plate 2, except the double plate 77 is about twice as wide. The double plate 77 is shown as it would be attached to the outside of a wood-frame house, above, below, or to the side of a window or door. Depending on the type of house and framing, the vertical position allows nails, screws, and lag-bolts driven through the double plate 77, at nail holes 4 and lag bolt holes 5, to connect with structural boards framing the window. The bend lines 8 form the middle bridge 8A which supports and locks the double hook 76 when attached.

The bend lines 8 show how they form space for the hinge hole 6 to be used as an anchor for the double hook 76. The width 6A across the hinge hole 6 allows a double hook 76 to be attached, rotated 180°, and locked against a wall. This width also allows the shutter cover 1 to allow some high pressure air to escape from the window opening. The height 6B across the hinge hole 6 allows some leeway for inaccurate measurement, when attaching a double hook 76 to a shutter cover 1.

Figure 19G:
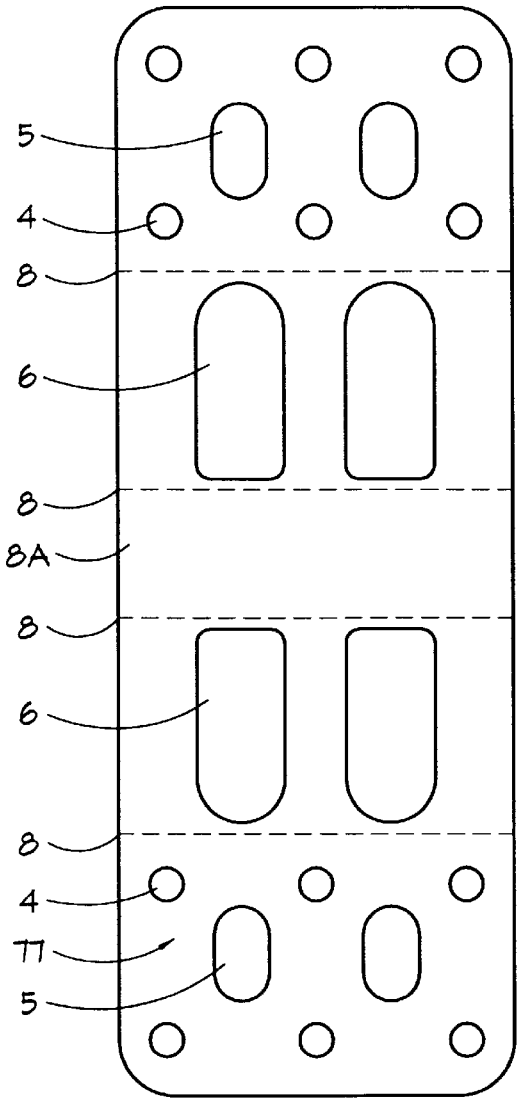
FIG. 19G is a flat pattern layout of a double plate.
Figure 19F:
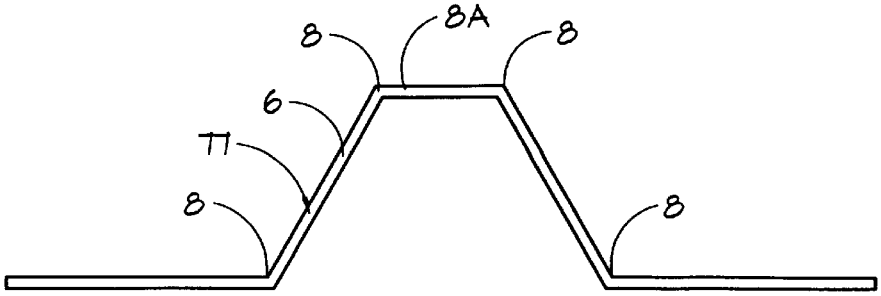
FIG. 19F is a side view of double plate.

FIG. 19F shows a side view of a double plate 77. The bend lines 8 forming the bridge 8A, and the profile, are the same as for a vertical sheet metal plate 2.

FIG. 19G shows a flat pattern layout for a double plate 77 before forming along the bend lines 8. The flat pattern lay out is similar to a flat pattern layout for a sheet metal plate 2, except the double plate is wider.

Figure 19H:
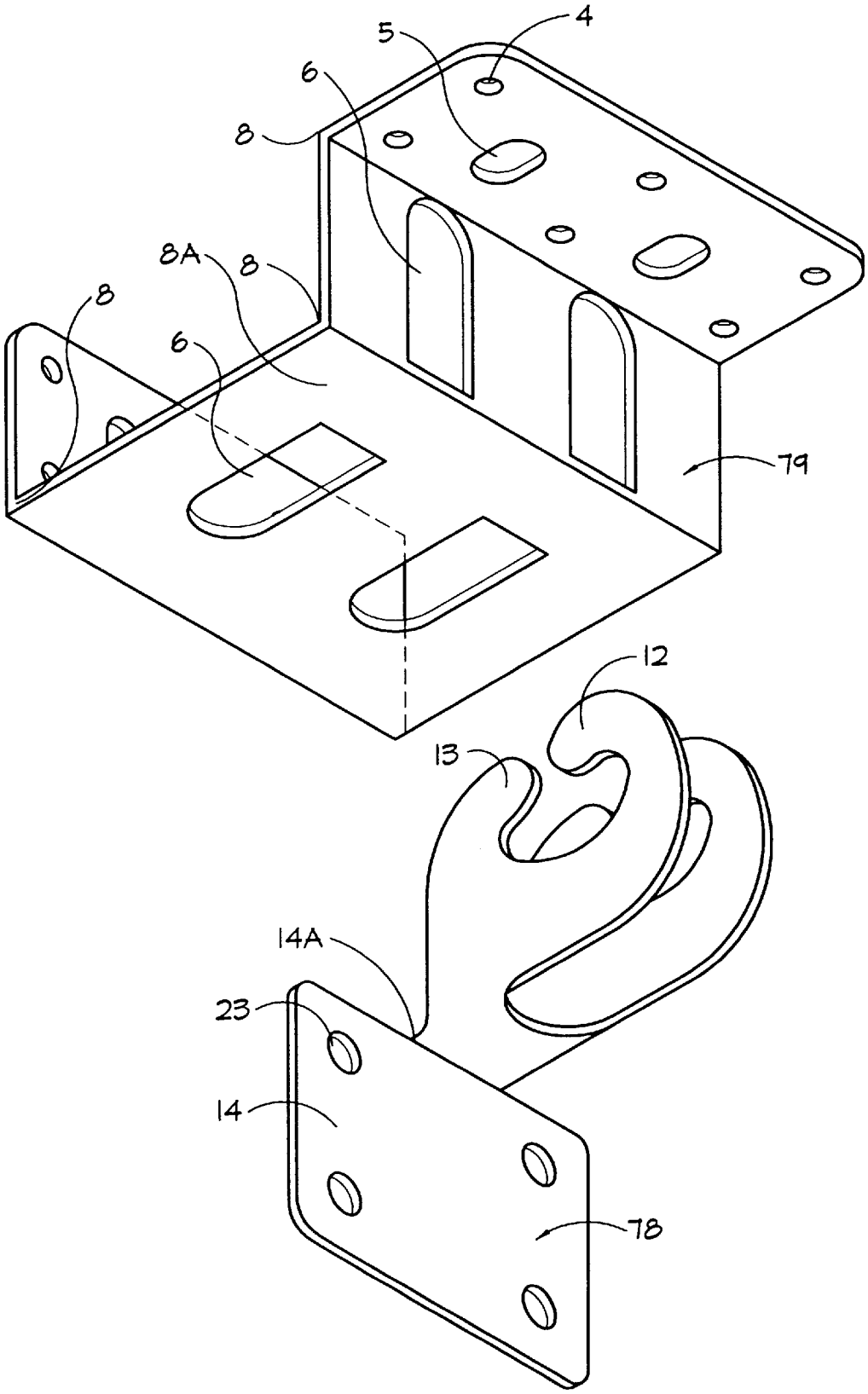
FIG. 19H shows a perspective view of a double ceiling hook and double ceiling plate.

FIG. 19H shows a perspective view of a double ceiling hook 78 about to grapple and latch onto a double ceiling plate 79. The double ceiling hook 78 combines the double top hooks 12 and bottom hooks 13 from a double hook 76, and bends them at an approximate right angle at the right angle bend 14A. This forms a modification similar to a ceiling hook 51, but is stronger due to the double top hooks 12 and bottom hooks 13. The base member 14 is wider than a ceiling hook 51 and has wider-spaced bolt holes 23. The double ceiling hook 78 has all the advantages of a ceiling hook 51, but is stronger. The same tool-and-die used for the double hook 76 could be used, with slight forming modifications, to make the double ceiling hook 78.

The double ceiling plate 79 has been modified from a double plate 77 to tit inside ail apartment, preferably above a patio door or large picture window. The double ceiling plate 79 has been bent at different angles along the bend lines 8 in order to fit on the ceiling and on to the top plate above a window or patio door. The same tool-and-die could be used to make the double plate 77 and double ceiling plate 79, with slight modifications of the forming process. The double ceiling plate 79 has all the advantages of a ceiling plate 53, but is stronger.

On some houses, windows on the gable end may not have a thick header above the window to support the fasteners of this invention. Some windows on post and beam house do not have wall studs on the side or below a window. A washer will help transfer the forces acting on a point and spread out the load.

Some homeowners can not lift a heavy sheet of ¾-inch plywood used as a shutter cover, and would want to have a thinner sheet of plywood. A thin plywood sheet would still function to keep wind and rain from the house, would still bleed high-pressure air from the house, and would keep most wind-blown missiles from breaking through. To prevent the sheet metal hinge 3 from pulling out of thin plywood a washer should be used.

Figure 20A:
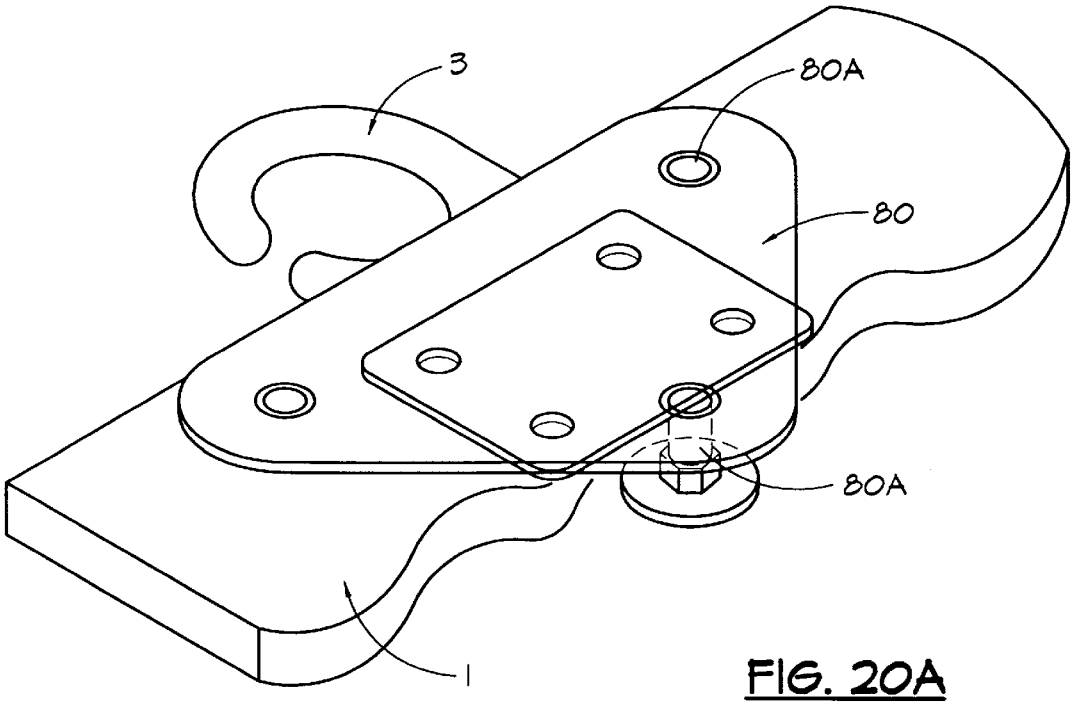
FIG. 20A is a perspective view of a triangle-shaped washer.

Refer now to FIG. 20A which shows a triangular-shaped washer 80. The triangular shape helps spread out lateral forces and makes the tool-and-die process more efficient, having less material waste. The washer 80 is shown installed on the rear of a thin-wood shutter cover 1.

Carriage bolts 80A and nuts secure the washer 80 to the shutter cover 1. Carriage bolts 80A don't protrude against the window and do not have to be held from the other side to be tightened. The carriage bolts 80A fit into square carriage holes 80B on the washer 80. FIG. 20A shows a thin shutter cover 1 sandwiched between a sheet metal hinge 3 on the bottom, and a washer 80 on the top. This helps keep bolts from the sheet metal hinge 3 from pulling through the thin wood.

In the same manner the washer 80 could be installed on thin sheathing, for gable ends or sides of a house, especially post and beam houses. The washer 80 would be installed inside the house, near a window, and the sheet metal hinge 3 would be installed on the outside of the house. This would sandwich the wall sheathing between the washer 80 and the sheet metal hinge 3. It would strengthen the wall and prevent the wall sheathing from being ripped out by strong winds.

Figure 20B:
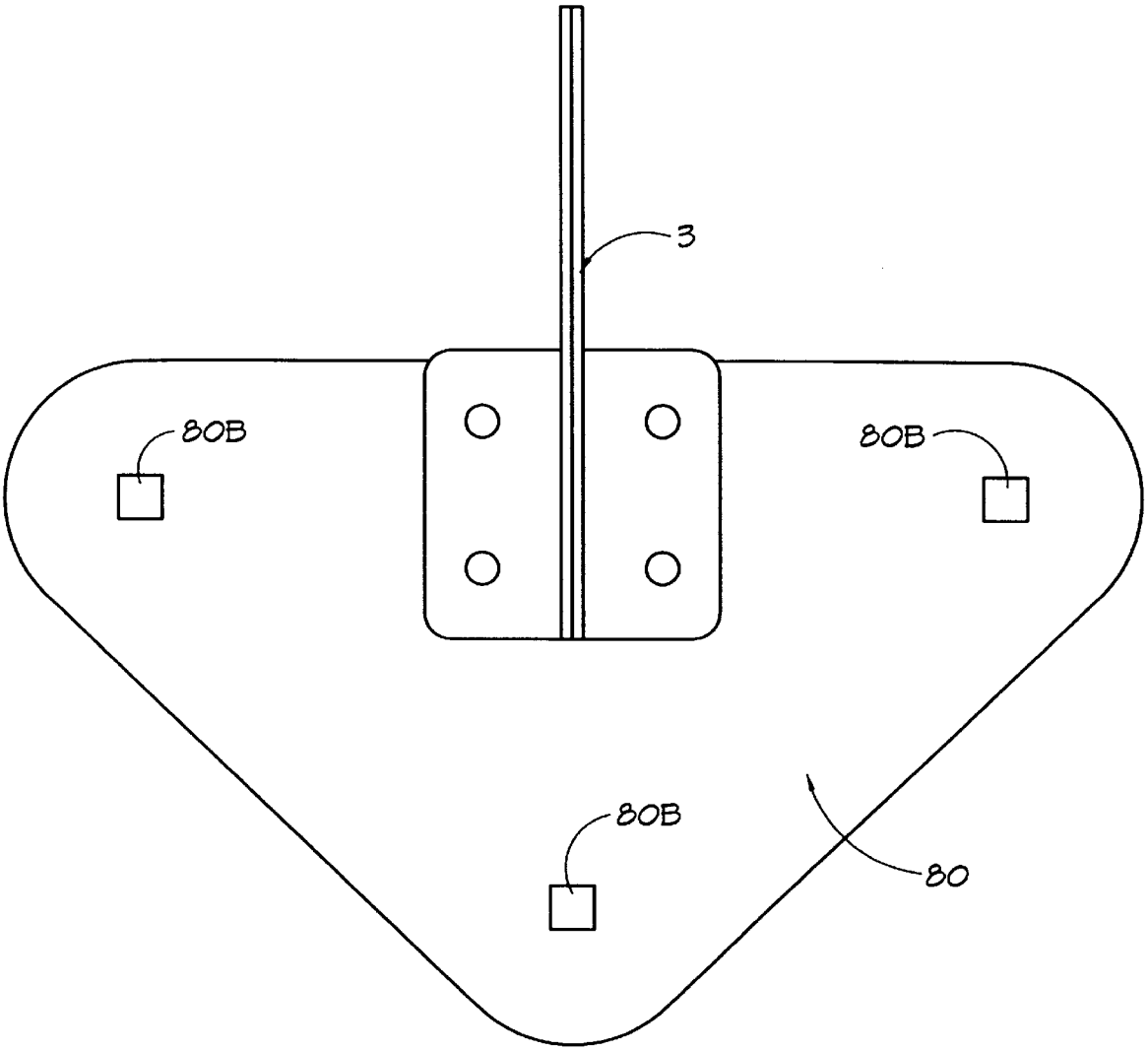
FIG. 20B is a front view of washer and sheet metal hinge.

FIG. 20B is a front view of a washer 80 showing where the carriage bolts 80A would go into the square carriage holes 80B.

Figure 20C:
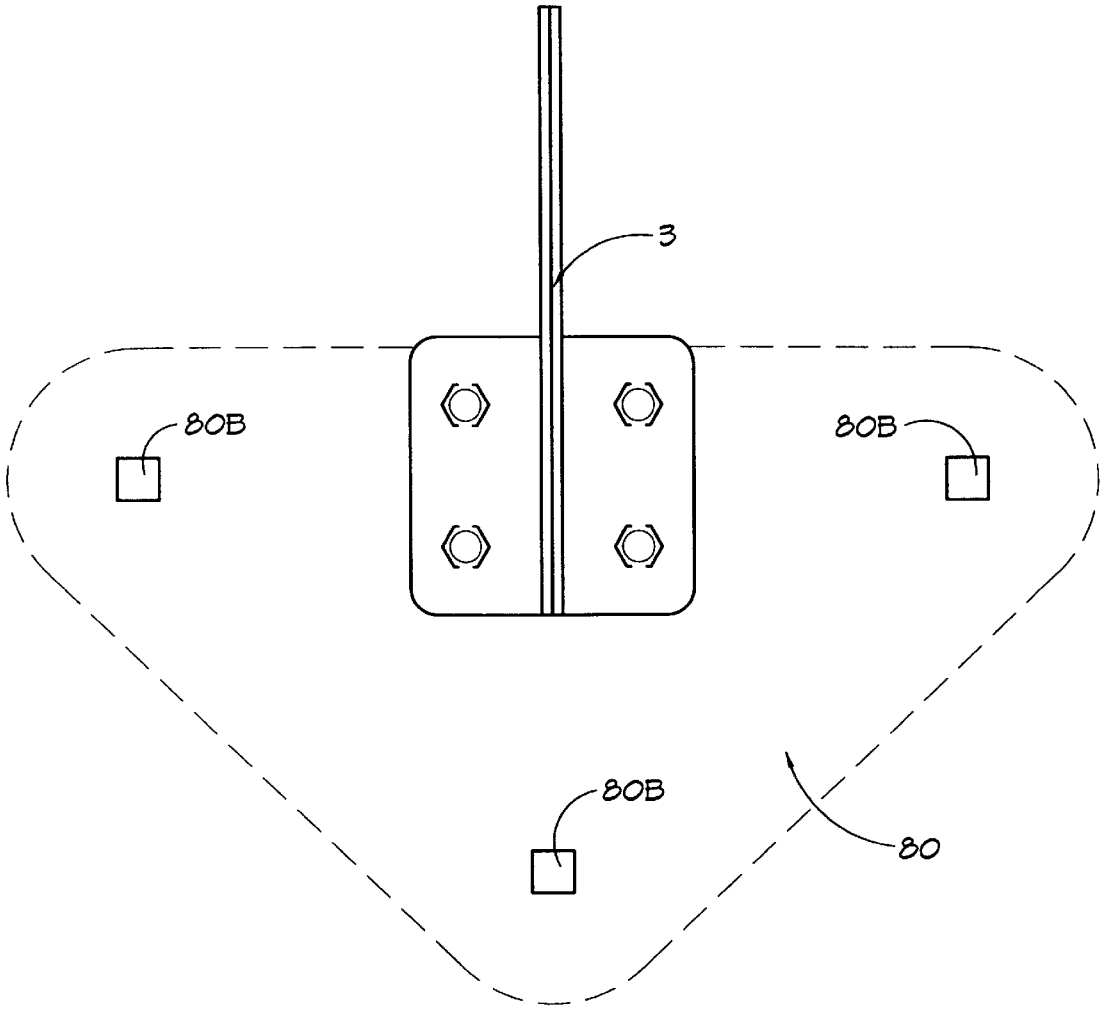
FIG. 20C is a back view of washer and sheet metal hinge.

FIG. 20C is a back view showing where nuts would go onto the carriage bolts 80A. The nuts are installed onto the carriage bolts on the sheet metal hinge 3, but not shown on the washer 80.

Figure 20D:
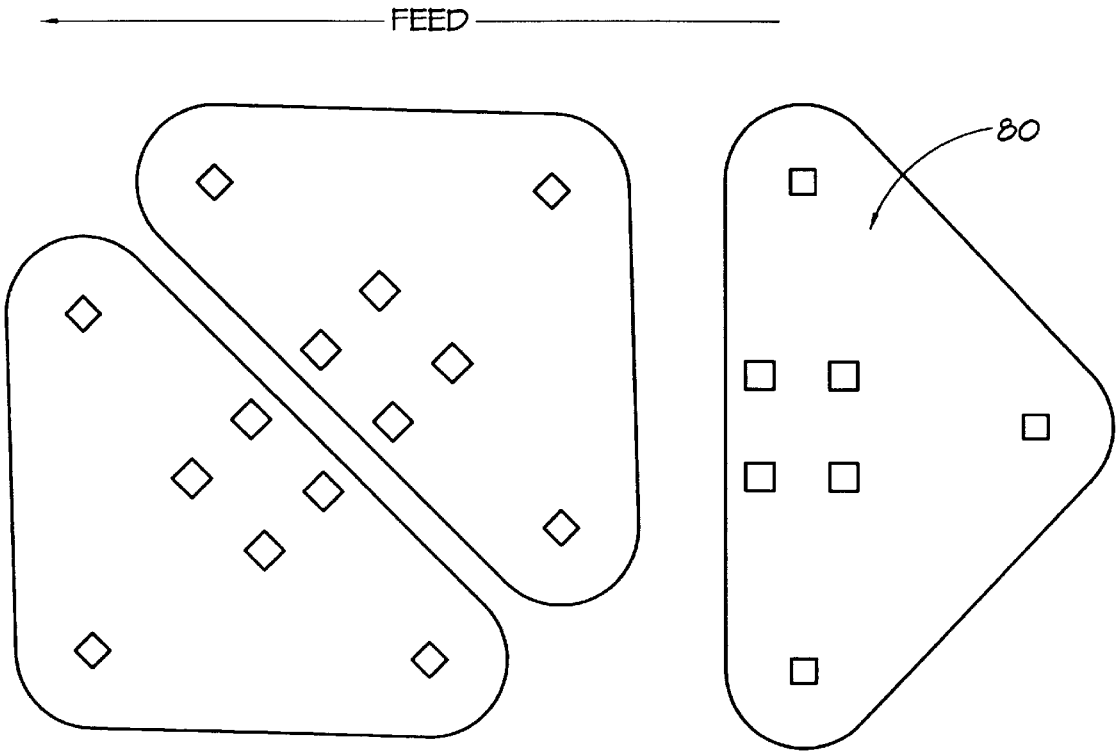
FIG. 20D is a flat pattern layout washer.

FIG. 20D is a flat pattern layout of a washer 80. The washer 80 and carriage holes 80B would be formed by standard tool-and-die methods. This view shows little loss of material during forming.

Latches

There are many types of available simple latches that can be used to lock the unsupported end of the plywood sheet, but they must be as strong as the plates and hinges of this invention. Two or more locks would be preferred, as they can match the strength of the two fasteners attached to the plywood sheet 1.

The shutter cover 1 shown in FIG. 1A is locked down by a sliding latch 61 and wing nuts 62. This latch works well on plywood, when used as a shutter cover. The latch is secured from outside the house, when the shutter cover is installed over the outside of a window.

Figure 21C:
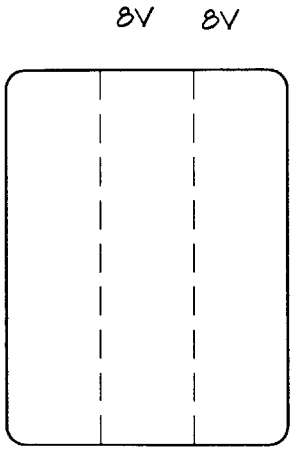
FIG. 21C is a flat pattern layout of a sliding latch.
Figure 21B:
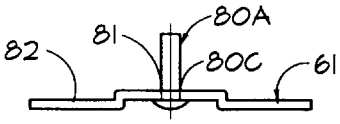
FIG. 21B is a side view of a sliding latch.
Figure 21A:
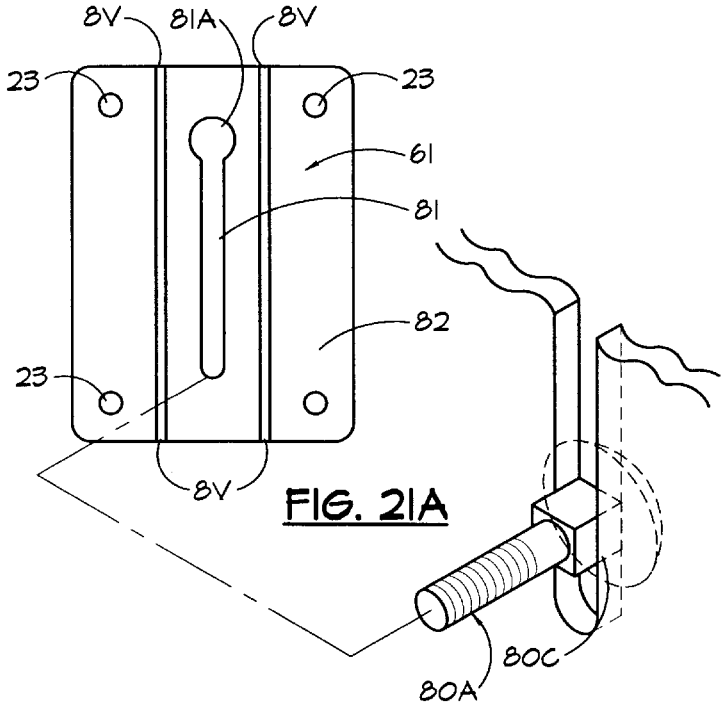
FIG. 21A is a perspective view of a sliding latch.

FIG. 21A is a perspective of a sliding latch 61. The sliding latch 61 contains lag bolt holes 5, and a mainstay 82 that has a raised keyway 81 in the center. The raised keyway 81 is elevated from shallow bends at the solution bend 8V. The keyway 81 has a keyway opening 81A that is slightly bigger than the head of a carriage bolt 80A. The bottom part of the keyway 81 is just wide enough to let the square shank 80C of a carriage bolt 80A slide up and down, but won't let the head of the carriage bolt 80A through. The elevated part of the raised keyway 81 permits the head of the carriage bolt 80A to slide up and down.

Once the carriage bolt 80A is inserted into the keyway opening 81A, and slid down, the head of the carriage bolt 80A prevents the carriage bolt 80A from pulling away from the sliding latch 61. The threads of the captured carriage bolt 80A are pulled through a drilled hole in the shutter cover 1, and a wingnut 62 is tightened down on the carriage bolt, as shown in FIG. 1A.

FIG. 21B is a side view of a carriage bolt 80A inserted and slid down the keyway 81, into the locked position, in the sliding latch 61. The square shank 80C of the carriage bolt 80A allows the carriage bolt 80A to slide, and the head of the carriage bolt 80A prevents detachment.

FIG. 21C is a flat pattern layout of a sliding latch 61. This view shows the sliding latch 61 before the keyway 81 and keyway opening 81A are cut out of the metal. Bends at the solution bends 8V, from the mainstay 82, form the raised keyway 81, all using standard tool-and-die methods.

Figure 21F:
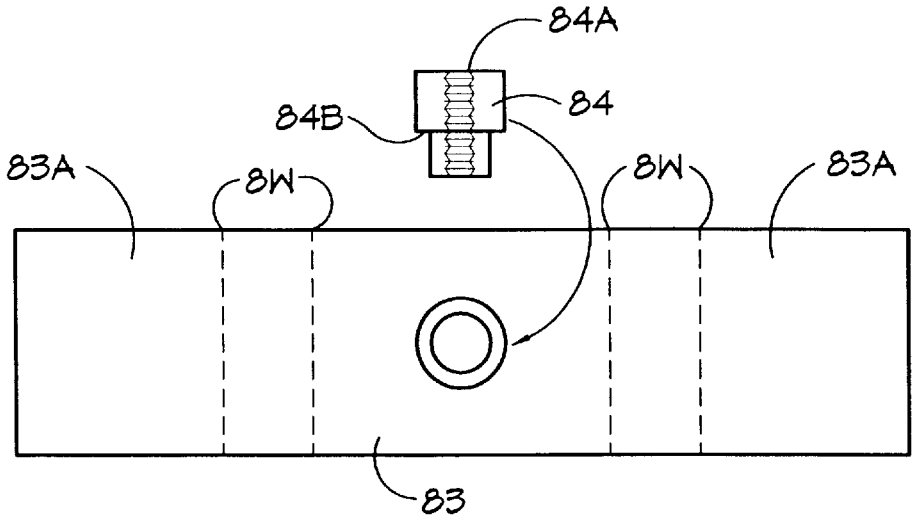
FIG. 21F is a front view of flat pattern layout of a wingnut.
Figure 21G:
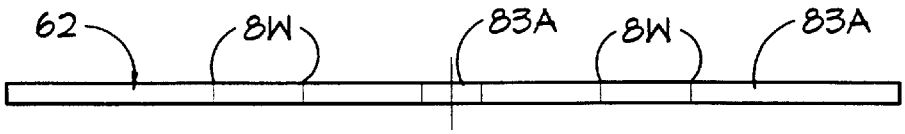
FIG. 21G is a side view of a flat pattern layout of a wingnut.
Figure 21E:
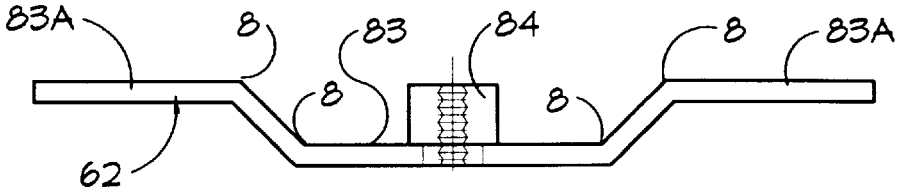
FIG. 21E is a side view of a wingnut.
Figure 21D:
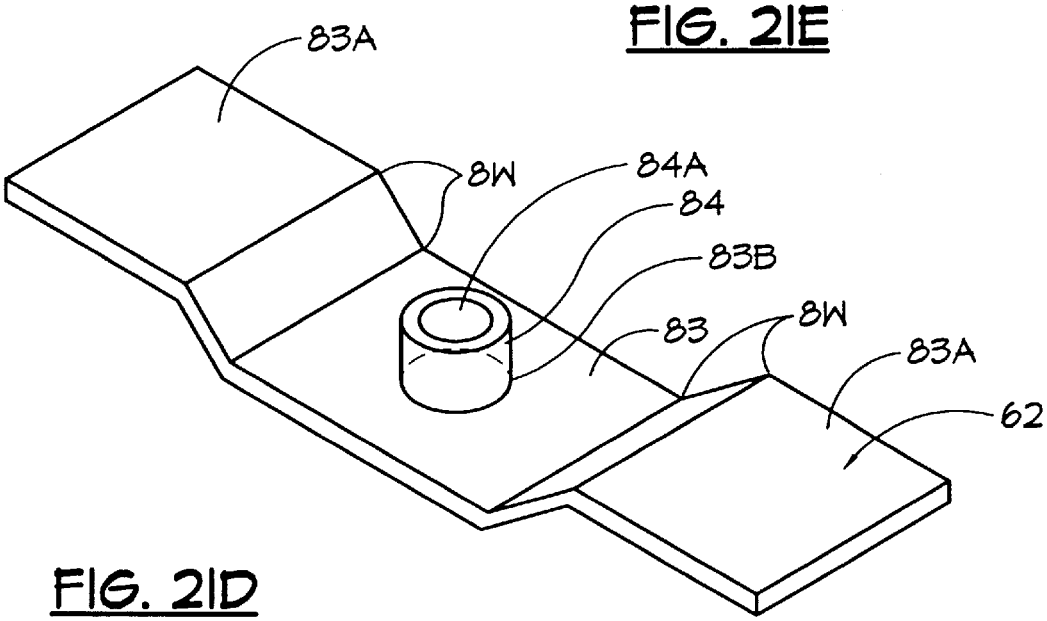
FIG. 21D is a perspective view of wingnut.

FIG. 21D shows a perspective view of a wingnut 62. The wingnut consists of a footing 83 with shallow bends at the core bends 8W forming wings 83A to either side. A footing hole 83B, in the middle of the footing 83, accepts a pressed-in screw stud 84. The screw stud 84 has threads 84A inside, and a lip 84B on the bottom.

FIG. 21E shows a side view of a wingnut 62. The screw stud 84 is in the footing hole 83B, in the middle of the footing 83. Bends at the core bends 8W form the wings 83A.

FIG. 21F is a flat pattern layout of a wingnut 62 prior to forming at the core bends 8W. This view shows how the screw stud 84 is pressed into the footing hole 83B from above. The threads 84A of the screw stud 84 accepts the carriage bolt 80A of the sliding latch 61. When the wingnut 62 is tightened down against a carriage bolt 80A, the carriage bolt 80A pulls the lip 84B of the screw stud 84 tighter against the footing hole 83B.

FIG 21G shows a side view for the flat pattern layout of a wingnut 62 prior to forming the core bends 8W and footing hole 83B.

Operation of the sliding latch 61 and wingnut 62 is simple. The sliding latches 61 are attached to the outside wall, preferably on the studs that frame the window, as shown on FIG. 1A. The sliding latches 61 are installed with the keyway opening 81A facing up. Two or more sliding latches 61 can be used, depending on the size of the window. For fitting, the shutter cover 1 is swung down over the window, and a carriage bolt 80A is inserted in the keyway opening 81A and slid down the keyway 81. The position of the threads is marked on the shutter cover 1 and a hole is drilled for the threads. Then the shutter cover 1 is stored.

When a hurricane is expected, the shutter cover 1 is taken out of storage and is hung using the sheet metal hinge 3 and sheet metal plate 7, and swung down. Carriage bolts 80A, placed in the keyway opening 81A and slid down the keyway 81, are poked through the pre-drilled holes on the shutter cover 1. With the threads sticking out, a wingnut 62 is screwed down tight, as shown in FIG. 1A. The wings 83A provide easy tightening.

Other hooks and plates of this invention can be used as the shutter cover 1 hangers. This latch will work well with plywood as the shutter cover 1. Common bolt washers can be placed against the plywood for added strength against pull out. Other materials can be used as the shutter cover 1 with the sliding latch 61 and wingnut 62, including steel, aluminum, and plastic.

Figure 22A:
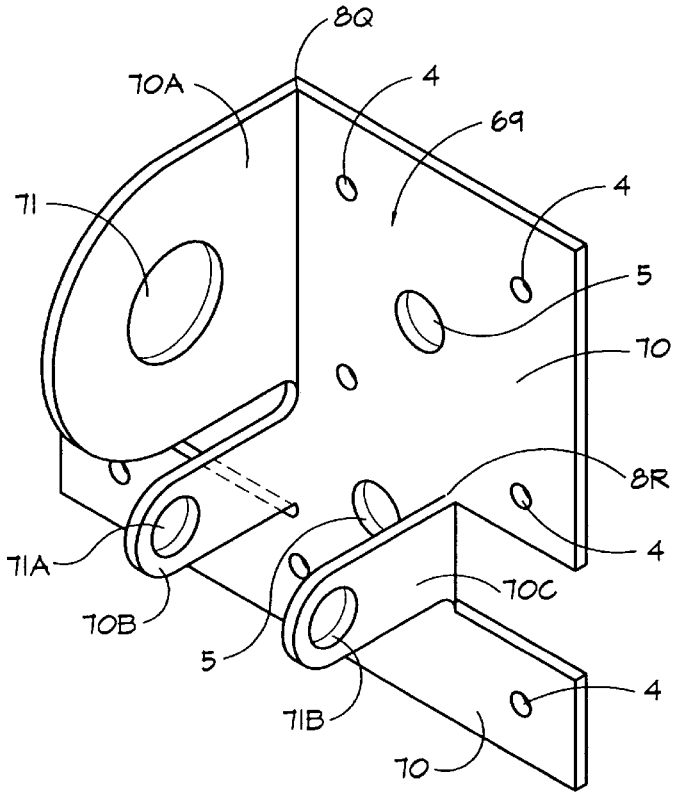
FIG. 22A is a perspective view of a locking latch.

FIG. 22A is a perspective view of a locking latch 69 shown in one of its preferred locations, mounted on a wall outside a house. The locking latch 69 consists of a foundation web 70 with nail holes 4 and lag bolt holes 5. On the left-hand side of the foundation web 70, an approximate right-angle bend, at the junction bend 8Q, forms the aperture web 70A that contains a pole hole 71. This right-angle bend also forms the left locking tab 70B that contains the left locking hole 71A. Directly across from the left locking tab 70B, an approximate right-angle bend at the interchange bend 8R, forms a right locking tab 70C that contains the right locking hole 71B. Continuation of part of the foundation 70, on the bottom of the locking latch, contains nail holes 4.

Figure 22B:
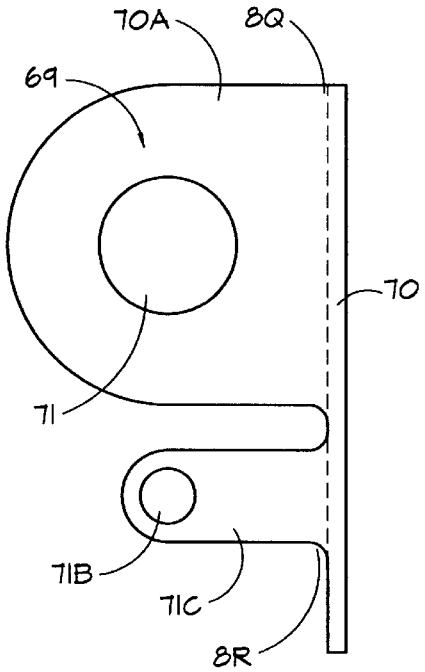
FIG. 22B is a side view of a locking latch.

FIG. 22B is a side view of a locking latch 69. Two right-angle bends are made off the foundation web 70. The junction bend 8Q forms the aperture web 70A with the pole hole 71, and the left locking tab 70B (hidden from view, directly behind the right locking tab 70C) with left locking tab 71A. The interchange bend 8R forms the right locking tab 70C with right locking hole 71B. The left locking hole 71A and right locking hole 71B are the same size and are in a direct line.

Figure 22D:
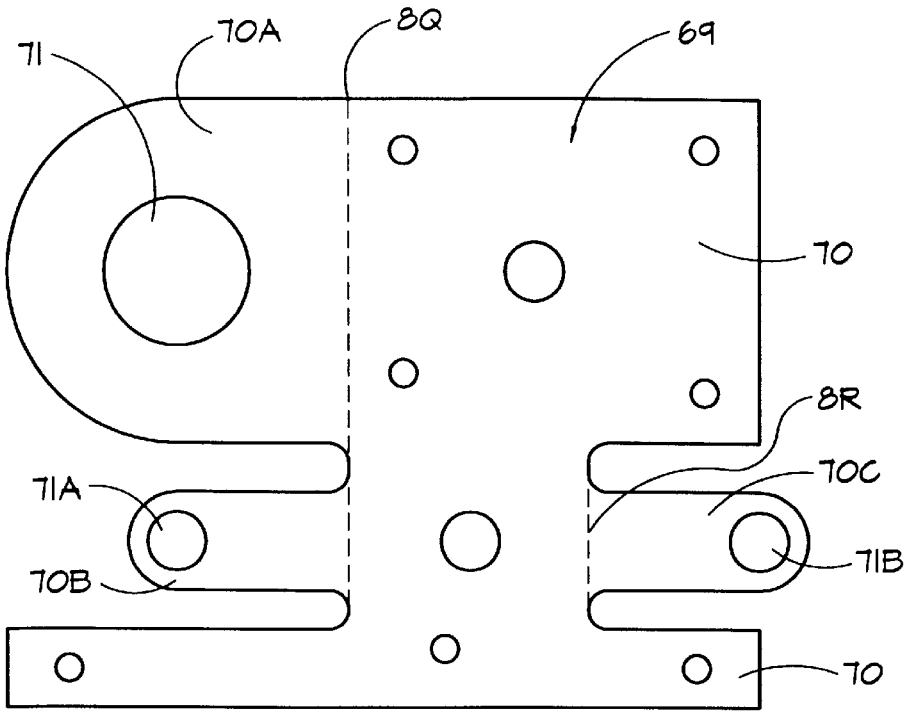
FIG. 22D is a flat pattern layout of a locking latch.
Figure 22C:
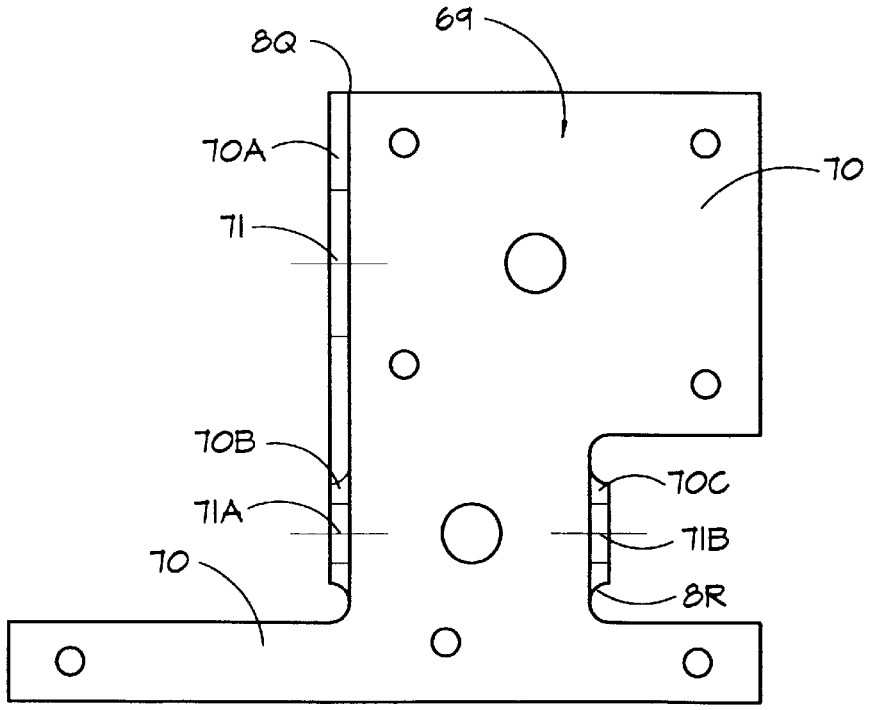
FIG. 22C is a front view of a locking latch.

FIG. 22C is a front view of a locking latch 69 showing mostly the foundation web 70. The junction bend 8Q forms the aperture web 70A with pole hole 71, and left locking tab 70B with left locking hole 71A, both seen on edge. The interchange bend 8R forms the right locking tab 70C, with right locking hole 71B, seen on edge.

FIG. 22D is a flat pattern layout of a locking latch 69 before forming by standard tool-and-die methods. This view shows how the left locking hole 71A of the left locking tab 70B, and the right locking hole 71B of the right locking tab 70C will line up when bends are made at the junction bend 8Q and interchange bend 8R. This view also shows how bending at the junction bend 8Q forms the aperture web 70A with pole hole 71.

Figure 23A:
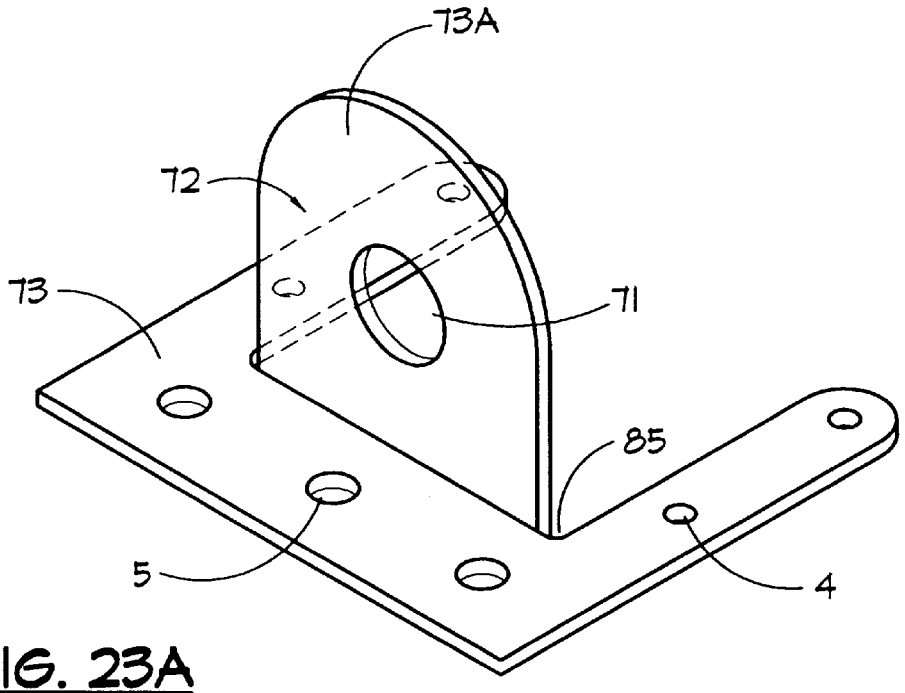
FIG. 23A is a perspective view of a slave lock.

FIG. 23A is a perspective view of a slave lock 72. The support web 73 has nail holes 4 and lag bolt holes 5. There is also an approximate right-angle bend at the crossing bend 8S that forms a perforation web 73A with pole hole 71. The perforation web 73A is similar to the aperture web 70A on a locking latch 69.

Figure 23D:
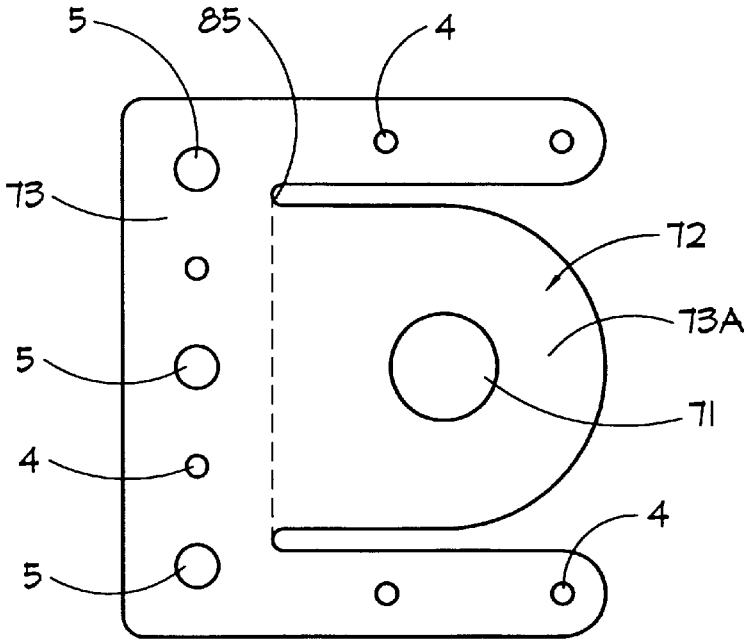
FIG. 23D is a flat pattern layout of a slave lock.
Figure 23B:
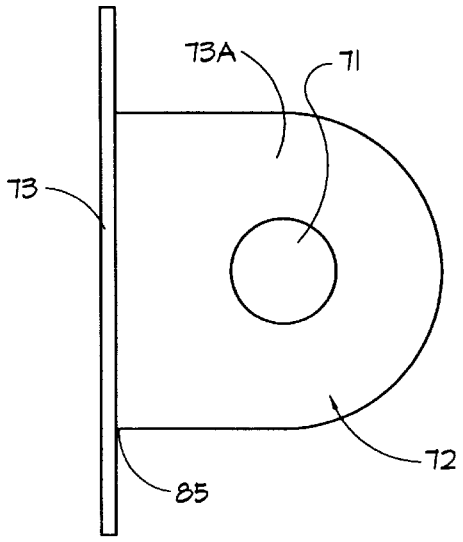
FIG. 23B is a side view of a slave lock.

FIG. 23B is a side view of a slave lock 72, looking edgewise along the support web 73. The crossing bend 8S, off the support web 73, forms the perforation web 73A with a pole hole 71. The pole hole 71 on the perforation web 73A is the same as the pole hole 71 on a locking latch 69.

Figure 23C:
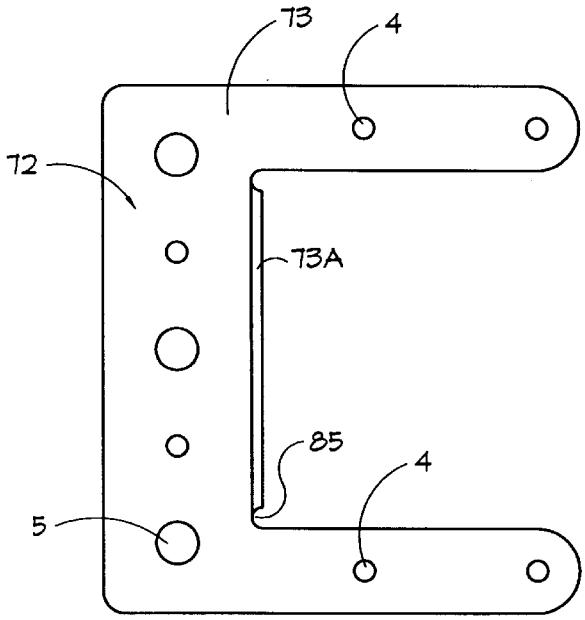
FIG. 23C is a front view of a slave lock.

FIG. 23C is, a front view of a slave lock 72, looking edgewise along the perforation web 73A, formed by the crossing bend 8S. The attached support web 73 contains nail holes 4 and lag bolt holes 5.

FIG. 23D is a flat pattern layout of a slave lock 72, before forming. This view shows where the crossing bend 8S would form the perforation web 73A, and where bolt holes 5 nail holes 4, an pole 71 would be punched-out.

Figure 24A:
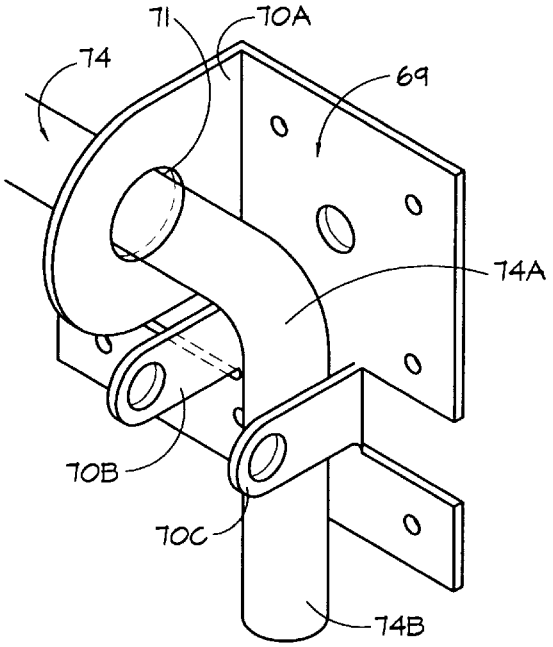
FIG. 24A is a perspective view of a locking latch in operation.

FIG. 24A shows how the locking latch 69 and slave lock 72 operate. This view shows a locking latch 69 installed to the outside wall of a house, next to a window. A slave lock 72 would be installed on the opposite side of the window, but directly in line with the locking latch (FIG. 24B). Preferably, the lag bolts and nails through the nail holes 4 and lag bolt holes 5, of both the locking latch 69 and slave lock 72, would hit studs around the window of a wood-frame house, or the lag bolts 5 would be secured to the masonry of a concrete-block house by standard means.

On a building where a handle hook 45, corrugated handle plate 64, and corrugated steel sheets 66 are used as the shutter cover 1, the locking latch 69 and slave lock 72 make an excellent locking system. After the handle hook 45 is secured above a window, the corrugated handle plate 64 and attached corrugated steel sheet 66 are latched and pivoted down over a window.

The preferred locking method is to insert a metal rod 74 through the pole hole 71, of the locking latch 69, and through pre-drilled holes in the corrugated steel sheet 66. The metal rod 74 would exit the other side of the corrugated steel sheet 66 and be inserted into the pole hole 71 of the slave lock 72. The metal rod 74 has an approximate right-angle sturdy bend 74A near the end, which forms a dogleg 74B. The dogleg 74B is then swung down, between the left locking tab 70B and the right locking tab 70C.

FIG. 24B shows a slave cylinder 72 securing a corrugated steel sheet 66 against a window, using a metal rod 74. The left end of the metal rod 74 is secured in a locking latch 69. The right end of the metal rod 74 is secured in the pole hole 71 and can not be withdrawn until the dogleg 74B (FIG. 24A) is pivoted away from the locking tabs 70B and 70C (see text for FIG. 25H).

Figure 24C:
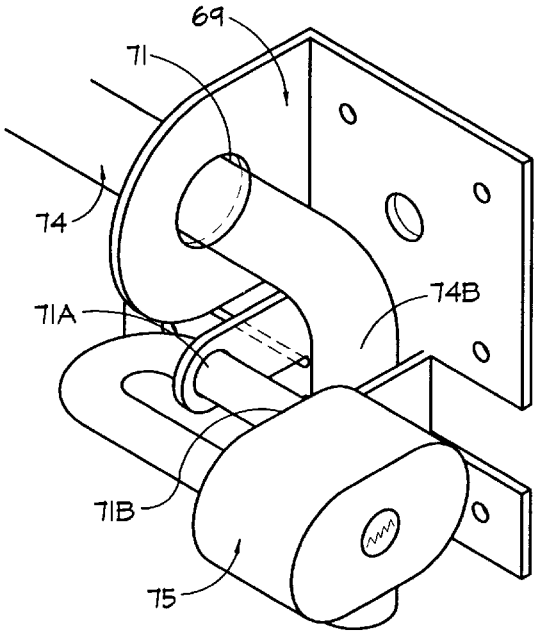
FIG. 24C is a perspective view of a locking latch, locked.
Figure 24B:
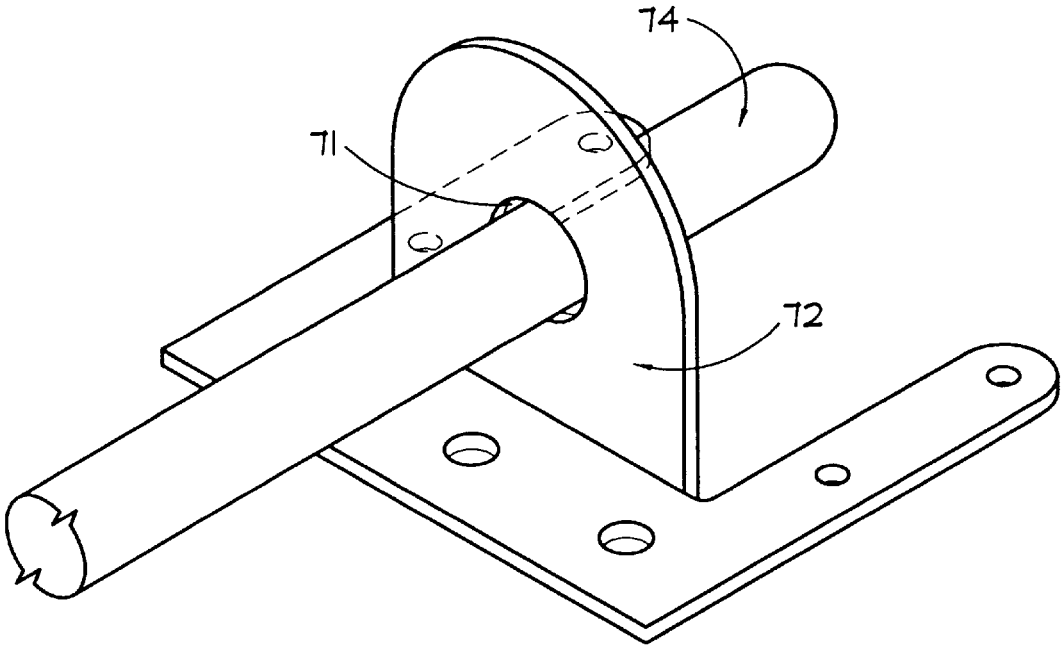
FIG. 24B is a perspective view of a slave lock in operation.

FIG. 24C shows the locking latch 69 secured against hurricanes and vandals. A common lock 75 is inserted through the left locking hole 71A and the right locking hole 71B, preventing the dogleg 74B from moving in or out of the pole holes 71.

A common lock 75 does not have to be used to lock the dogleg 74B. A common bolt, long enough to fit through both locking holes 71A and 71B, can be screwed tight with a nut. A common carabineer is strong, and is very quick to install across the locking holes 71A and 71B. A clevis can also be used across both locking holes 71A and 71B.

Figure 24D:
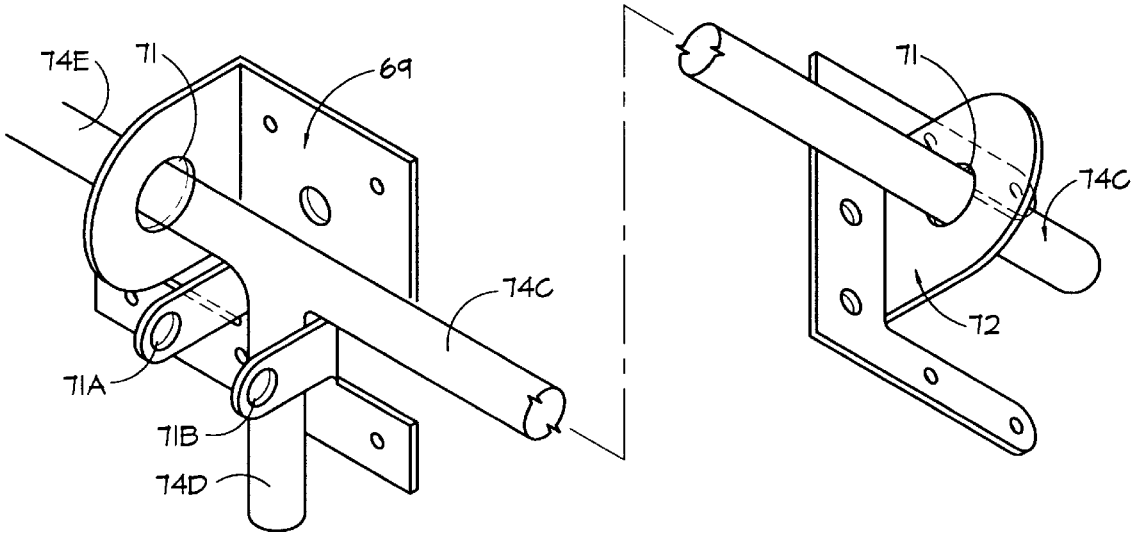
FIG. 24D is a perspective view of a locking latch and metal tee bar.

FIG. 24D shows a locking latch 69 secured with a metal tee bar 74C. For quick installation of the metal tee bar 74C, it can be installed in the corrugated steel sheet 66 prior to hanging. When a hurricane is expected, the corrugated steel sheet 66 is hung from the handle hook 49 and swung down over a window. The metal tee bar 74C is then pushed all the way to the right, into the slave lock 72.

By pushing the metal tee bar 74C all the way to the right, the bullet end 74E is to the right of the pole hole 71. When the bullet end 74E is in line with the pole hole 71, the metal tee bar 74C is pushed to the left until the tee handle 74D can be swung down. The metal tee bar 74C is still in the slave lock 72, and the tee handle 74D is swung down and can be locked with a common lock 75 across the left locking hole 71A and right locking hole 71B.

Figure 25A:
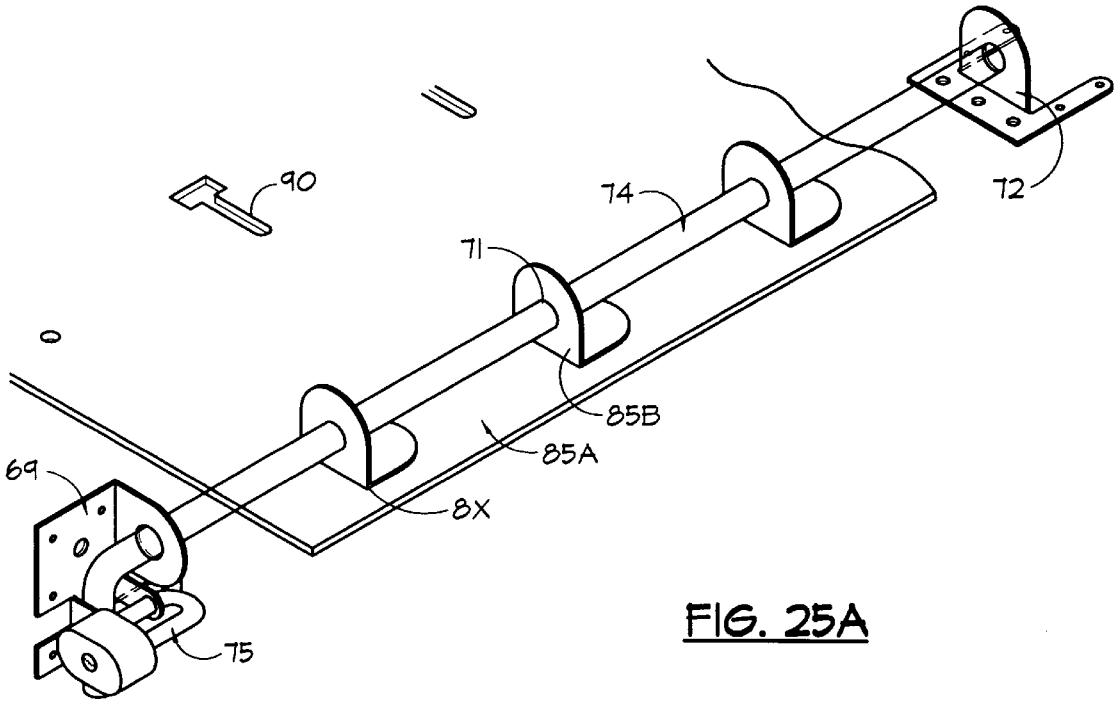
FIG. 25A is a perspective view of a locking latch, slave lock, metal rod and flat steel shutter cover.

Refer now to FIG. 25A which is a perspective view of a simple system of using the locking latch 69 on flat shutter covers 1, such as flat metal sheets or plywood. Locking latch 69 has tabs 690 and 691 for receiving lock 75. Dog-ear 692 is bent into the end of rod 74 and is captured by lock 74 to lock the shutter. In this case, the shutter cover 1 is flat steel 85A. The locking latch 69 and slave lock 72 are installed on opposite sides of a window. The flat steel 85A has pre-stamped rigid tabs 85B with pole holes 71, near the center of each one. A metal rod 74 lock rod is inserted through each pole hole 71 and locked down at the locking latch 69.

The rigid tabs 85B can be formed at the factory or can be crafted on sight in a portable metal press. For large windows, such as store fronts, the distance covered by the shutter cover 1 can be great. The rigid tabs 85B and metal rod 74 make the flat steel 85A very stable and secure. The same system can be used for large sheets of plywood, except several slave locks 72 would be bolted in line, similar to the rigid tabs 85B. The metal rod 74 would go through all the pole holes 71 of the slave locks 72, and lock onto a slave lock 72 secured by the window.

Figure 25B:
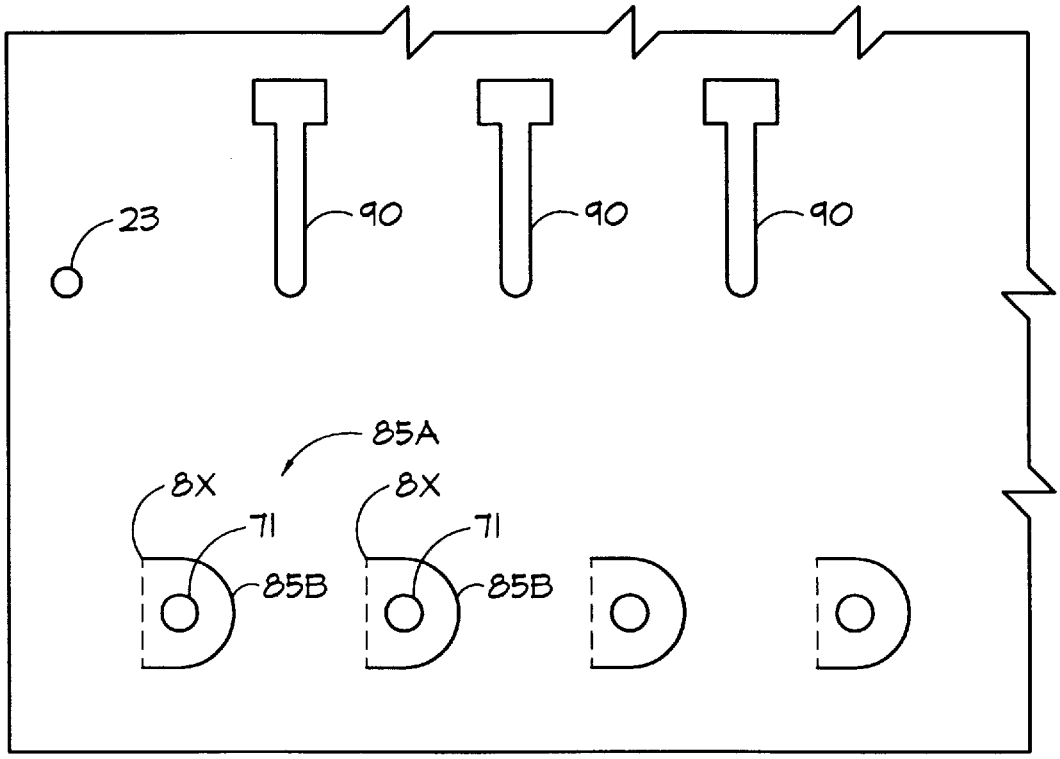
FIG. 25B is a flat patter layout of a flat steel shutter cover.

FIG. 25B shows a flat pattern layout of a flat steel 85A shutter cover and how the rigid tabs 85B would be cut, before forming. The rigid tab 85B would be cut and bent up at an approximate right angle at the favored bend 8X.

Figure 25C:
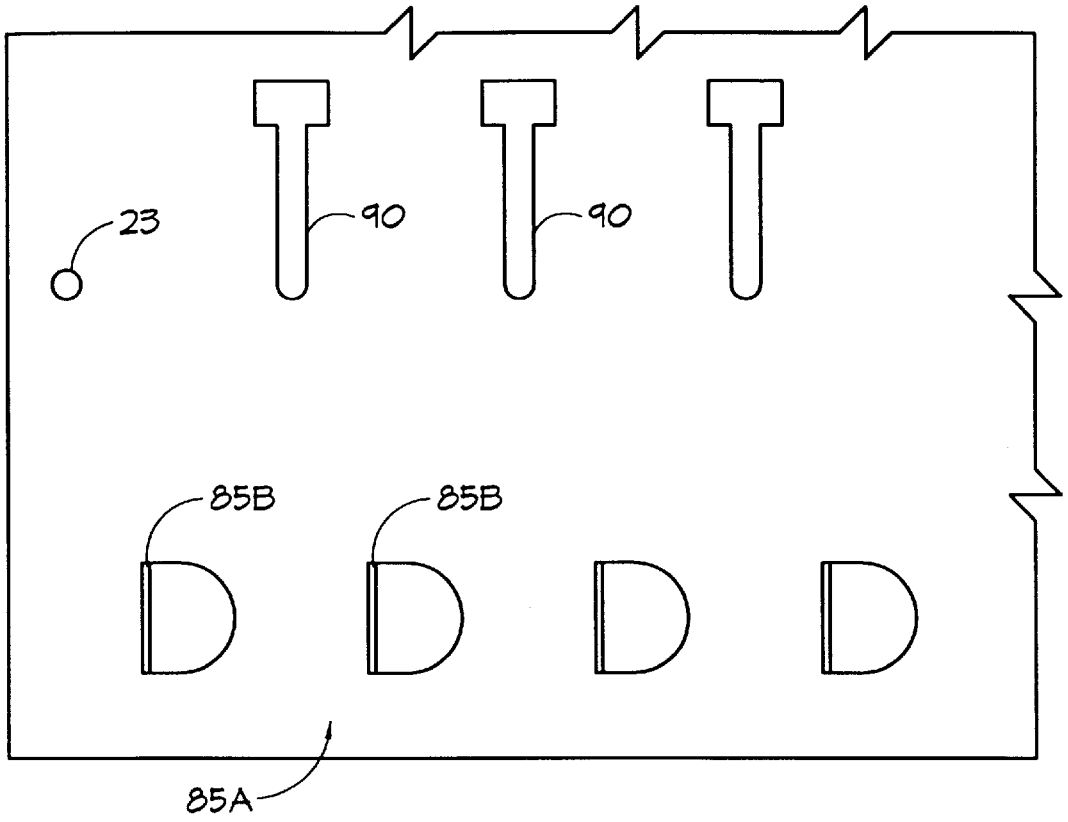
FIG. 25C is a top view of a flat steel shutter cover.

FIG. 25C shows a top view of flat steel 85A after forming by standard tool-and-die methods. This view look at the edge of the rigid tabs 85B.

Figure 25D:
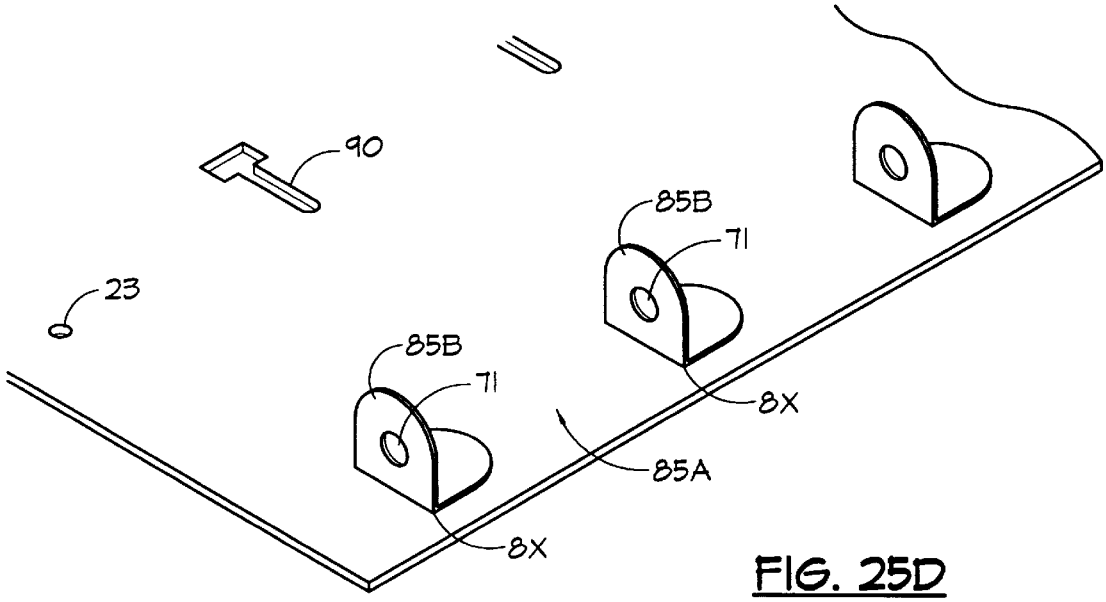
FIG. 25D is a perspective view of a flat steel shutter cover.

FIG. 25D is a perspective of the flat steel 85A after forming. The rigid tabs 85B are in line and the pole holes 71 are all in line for a metal rod 74 or other strong connector.

If the latching lock 69 of FIG. 25A is too big, or the homeowner does not want to lock their shutter cover, or if people do not want such a big latch near their window, slave locks 72 can be used at both ends of the metal bar 74. Slave locks 72 are very simple, don't look imposing, and can use a simple straight metal rod 74. To lock a straight metal rod 74 to two slave locks 72 is simple when using a cinch latch 86.

Figure 25F:
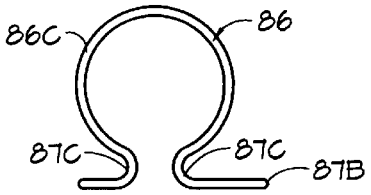
FIG. 25F is a side view of a cinch latch.
Figure 25G:
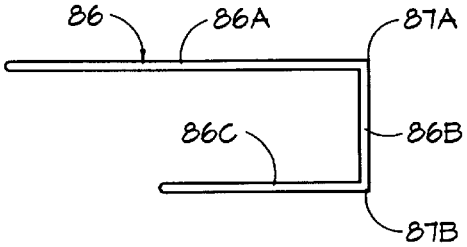
FIG. 25G is a top view of a cinch latch.
Figure 25H:
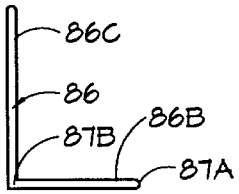
FIG. 25H is a elevation view of a cinch latch.
Figure 25E:
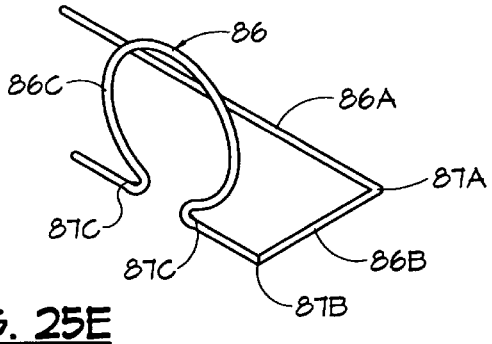
FIG. 25E is a perspective view of a cinch latch.

FIG. 25E shows a perspective view of a cinch latch 86. The cinch latch consists of a straight pin 86A, connected by an approximate right-angle bend at the needle bend 87A to the cross pin 86B. Another approximate right-angle bend at the sharp bend 87B meets the hairpin bends 87C which form the rod loop 86C. The cinch can be formed simply from strong wire, by standard tooling methods.

A metal bar 74 with the right length and a right angle bend 74A may be hard to find, but a straight metal rod 74 can be purchased and cut to fit between the slave locks 72, on either side of the window. A common drill can be used to drill a small hole, slightly bigger than the diameter of the straight pin 86A of the cinch latch 86, through the metal rod 74 near one of the slave locks 72.

When this metal rod 74 is inserted through the slave lock 72 on one side of a window, across the shutter cover 1, and through a slave lock 72 on the other side, the shutter cover 1 is locked down. To prevent the metal rod 74 from moving laterally away from the slave locks 72, the cinch latch 86 is used.

The straight pin 86A, of the cinch latch 86, is inserted through the drilled hole on the metal rod 74 on one side of the performance web 73A of the slave lock 72 (see FIG. 23A). The cross pin 86B is then swung over the performance web 73A of the slave lock 72. The hairpin bends 87C are then pushed against the metal rod 74, until the hairpin bends 87C open up and wrap around the metal rod 74. The rod loop 86C of the cinch latch 86 now wraps around the metal rod 74 on one side of the performance web 73A of the slave lock 72. The straight pin 86A is now on the other side of the performance web 73A. The metal rod 74 can not move in either direction, because of the straight pin 86A on one side and the rod loop 86C and cross pin 86B prevent any movement on the other side. One cinch latch 86 prevents movement left or right.

FIG. 25F is a side view of the cinch latch 86 showing the roundness of the rod loop 86C. The hairpin bends 87C allow the rod loop 86C to open and wrap around a metal rod 74.

FIG. 25G is a top view of a cinch latch 86 showing the cross pin 86B that connects the straight pin 86A with the rod loop 86C using the needle bend 87A and sharp bend 87B.

FIG. 25H is a elevation view of a cinch latch 86 showing the height of the rod loop 86C and the length of the cross pin 86B.

FIG. 24B is a perspective view showing how to lock the cinch latch 86 across a slave lock 72. The straight pin 86A is on the back side, and tile rod loop 86C is on the front side of the performance web 73A.

FIG. 24B is a perspective view of a cinch latch 86 locking the straight pin 86A through a drilled hole in a metal rod 74. The performance web 73A of the slave lock 72 is mostly transparent, for the sake of clarity. The rod loop 86C is completely around the metal rod 74.

Figure 26A:
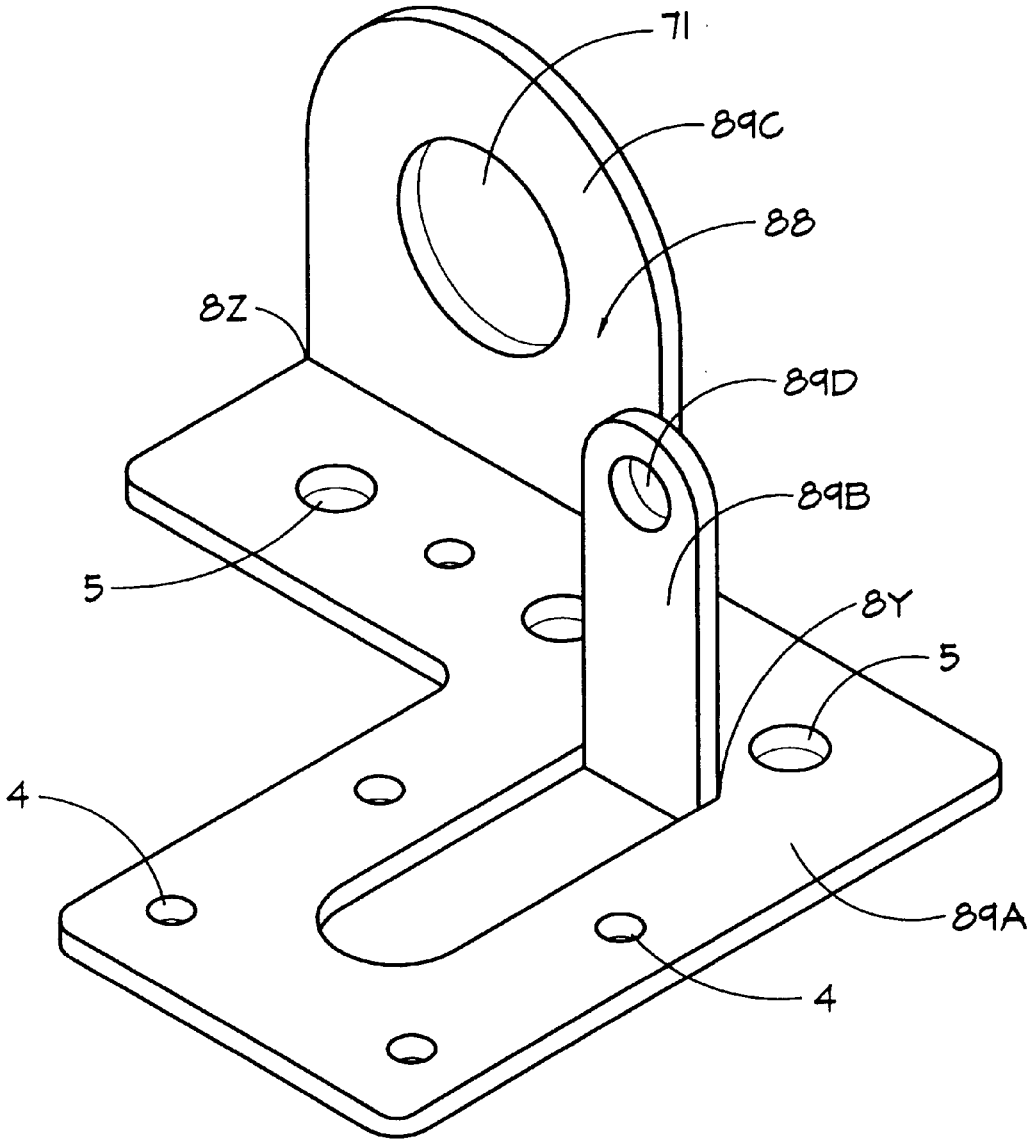
FIG. 26A is a perspective view of a yew latch.

FIG. 26A shows a perspective view of a yew latch 88. The yew latch 88 is similar to the locking latch 69, except the yew latch 88 is simpler and uses less material. The yew latch 88 consists of a basis web 89A with nail holes 4 and lag bolt holes 5. There are two mostly parallel, approximately right-angle bends on the basis web 89A. The timely bend 8Z forms the comfortable web 89C that has a pole hole 71. The convenient bend 8Y forms the impound tab 89B with an impound hole 89D.

Figure 26D:
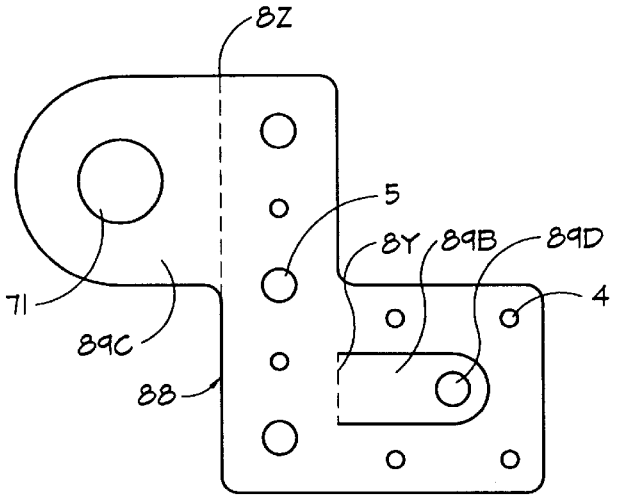
FIG. 26D is a flat pattern layout of a yew latch.
Figure 26C:
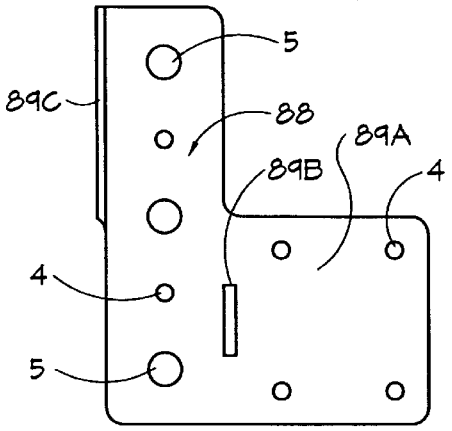
FIG. 26C is a top view of a yew latch.
Figure 26B:
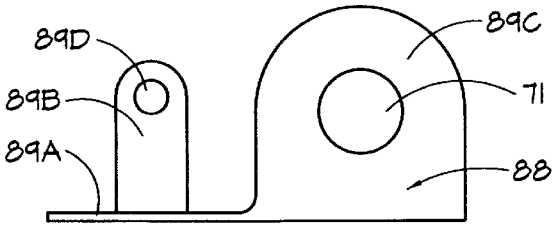
FIG. 26B is a side view of yew latch.

FIG. 26B is a side view of a yew latch 88, showing the basis web 89A on the bottom. The impound tab 89B and impound hole 89D are shown in profile on the left. The comfortable web 89C and pole hole 71 are shown on the right.

FIG. 26C is a top view of a yew latch 88 showing the nail holes 4 and lag bolt holes 5 on the basis web 89A. The comfortable web 89C and impound tab 89B are seen along their edges; attached to the basis web 89A.

FIG. 26D shows a flat pattern layout for a yew latch 88, before forming. This view shows how much less material the yew latch 88 uses compared to a locking latch 69, and shows how the yew latch 88 can "nest" or butt-up next to another yew latch 88 to be formed. Standard tool-and-die bending along the timely bend 8Z will form the comfortable web 89C, and cutting and bending along the convenient bend 8Y will form the impound tab 89B.

FIG. 26A shows a perspective view of a metal rod 74, used to lock a shutter cover 1 with a yew latch 88. The metal bar 74 has a yew hook 74F, formed by simple bends 74G, 74H, and 74J. The yew latch 88 is operated similarly to a locking latch 69. The metal rod 74 is inserted through the pole holes 71 of the yew latch 88, and through the pole holes 71 of rigid tabs 85B or slave locks 72 on a metal sheet or plywood board, or just over a plain, unadorned shutter cover 1, and then through the pole holes 71 of a slave lock 72 on the other side of a window.

The yew hook 74F on the metal rod 74 uses a common lock 75 across the impound hole 89D to lock the yew hook 74F down. The yew hook 74F is fairly tight to the impound tab 89B, preventing lifting when locked with a common lock 75 or bolt.

These latches do not have to be straight across; they can go in a diagonal line across the shutter cover to provide more strength, depending on the length of the metal rod.

Figure 27A:
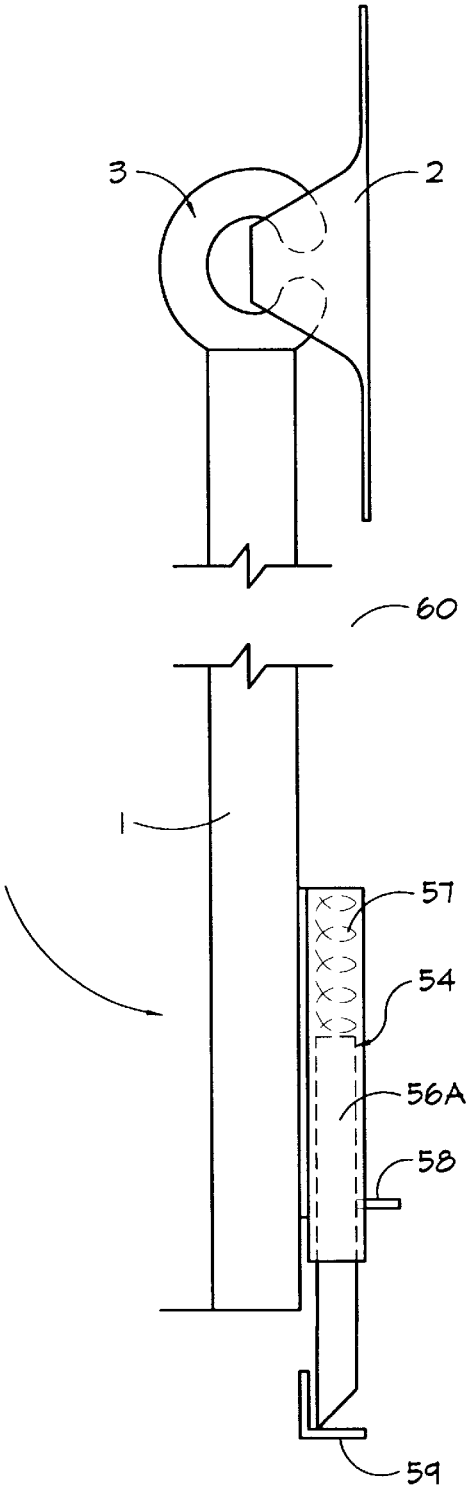
FIG. 27A is a front view of a spring latch.

FIG. 27A is a front view of a spring latch 54. A base element 55, consisting of a flat metal plate, with bolt holes 23 can be bolted to the end of a shutter cover 1 that is covering a window. In the approximate center of the base element 55 is a housing 56. Inside the housing 56 is a plunger 56A and spring 57. The housing 56 allows the plunger 56A to rise and fall, but the spring 57 keeps the plunger mostly in the extended position. The plunger 56A has a sloped end that allows the plunger 56A to slide up and over an angle-iron tab 59, when closed. The spring 57 can be made from spring steel, but the plunger 56A, base element 55, and housing 56 can be made from non-rusting alloy or stainless steel.

The angle-iron tab 59 has a vertical member that locks the plunger from swinging back out from the window. The horizontal member of the angle-iron tab 59 has slotted holes for adjustment of the attachment point on the window sill, window header, or sides of the window. The angle-iron tab 59 should be permanently attached to the house so it is not lost, but it could be connected to the plywood sheet 1 with cord, tape, or other means, and bolted or screwed to the window sill when the plywood sheet 1 is needed. One long angle-iron tab 59 could be used to lock in two spring latches 54 along a window sill, but with one small angle-iron tab 59 per spring latch 54, the spring latches 54 can be installed far apart, or on the sides of a window.

FIG. 27A shows a locating pin 58 on a plunger 56A that keeps the sloped end of the plunger 56A facing toward the inside of a window. The locating pin 58 slides in a locating slot 58A that keeps the plunger in correct position. When a shutter is installed over a non-opening window, or if the shutter is installed from the window sill and swung up, a spring latch 54 is the preferred locking mechanism. A thin wire 60 or cord can be attached to the locating pin 58 and left outside the shutter. After a hurricane passes, the wire can be pulled from the outside of the house and the locating pin 58 will pull the plunger 56A from the angle-iron tab 59, releasing the shutter from the window.

Figure 27B:
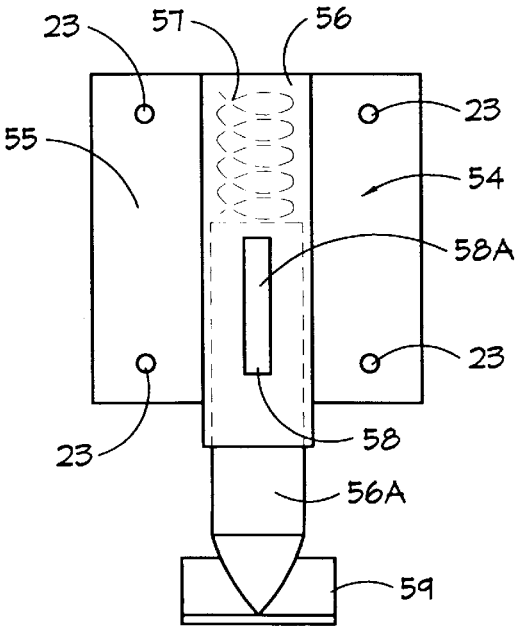
FIG. 27B is a side view of a spring latch.

FIG. 27B shows a side view of a spring latch 54 attached to a plywood sheet and swung down from the left. The housing 56 is cut away, revealing the spring 57, plunger 56A, and locating pin 58. The angle-iron tab 59 is shown in profile.

In an emergency, steel cables, strong wire, or nylon straps could be used instead of the metal rod 74. A metal rod 74 is preferable for a locking latch 69 and slave lock 72 because of the great strength of the metal rod 74 and the lateral stability the metal rod 74 imparts to corrugated steel sheet 66, plywood, and other flat metal sheets.

Figure 28A:
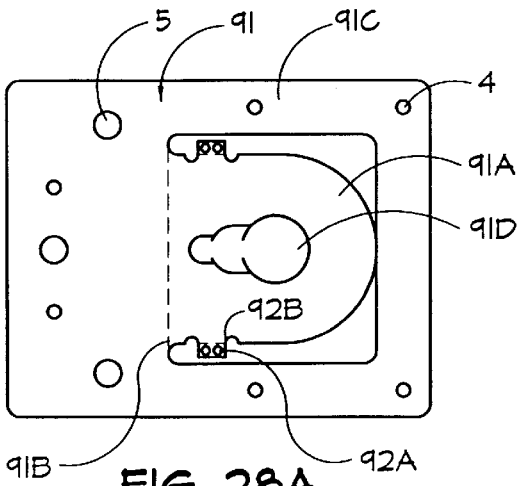
FIG. 28A is a flat pattern layout of a cable latch.

FIG. 28A shows a flat pattern layout for a cable latch 91. The cable latch consists of a buttress web 91C with nail holes 4 and bolt holes 5. At the safe bend 91B, the cable web 91A is bent up at an approximate right angle.

Figure 28B:
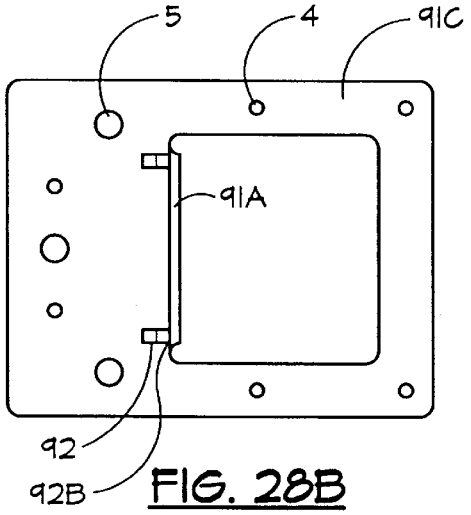
FIG. 28B is a top view of a cable latch.

FIG. 28B is a top view of a cable latch 91 after bending, showing the cable web 91A along its edge. The latch bar 92 is bent out at approximate right angles along the cinch bend 92B. The cinch holes 92A are shown prior to bending at the cinch bend 92B.

Figure 28C:
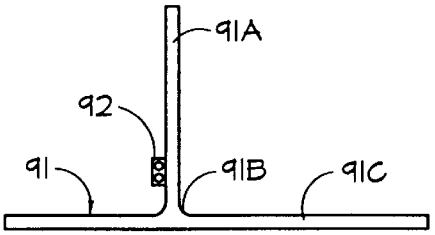
FIG. 28C is a front view of a cable latch.

FIG. 28C is a front view of a cable latch 91 showing the cable web 91A along its edge. The latch bar 92 shows the positions for the bars.

Figure 28D:
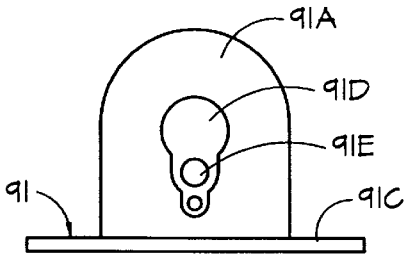
FIG. 28D is a side view of a cable latch.

FIG. 28D is a side view of a cable latch 91 showing the cable web 91A in profile. Also shown are the stepped cable holes 91D and a swaged end of a cable 91E used to lock the shutter down.

The operation of the cable latch is simple. The swaged end of a cable is threaded through rigid tabs 85B on a metal shutter cover 1 or through slave locks 72 mounted on plywood. The swaged ends of the cable are then threaded into cable latches 91 on either side of the window. The swaged ends of the cable are locked into the smallest step of the cable hole 91D that the cable can fit into. A cinch latch 86 is then slid across the lowest cinch holes 92A, holding the swaged ends of the cable 91E in position.

Figure 29A:
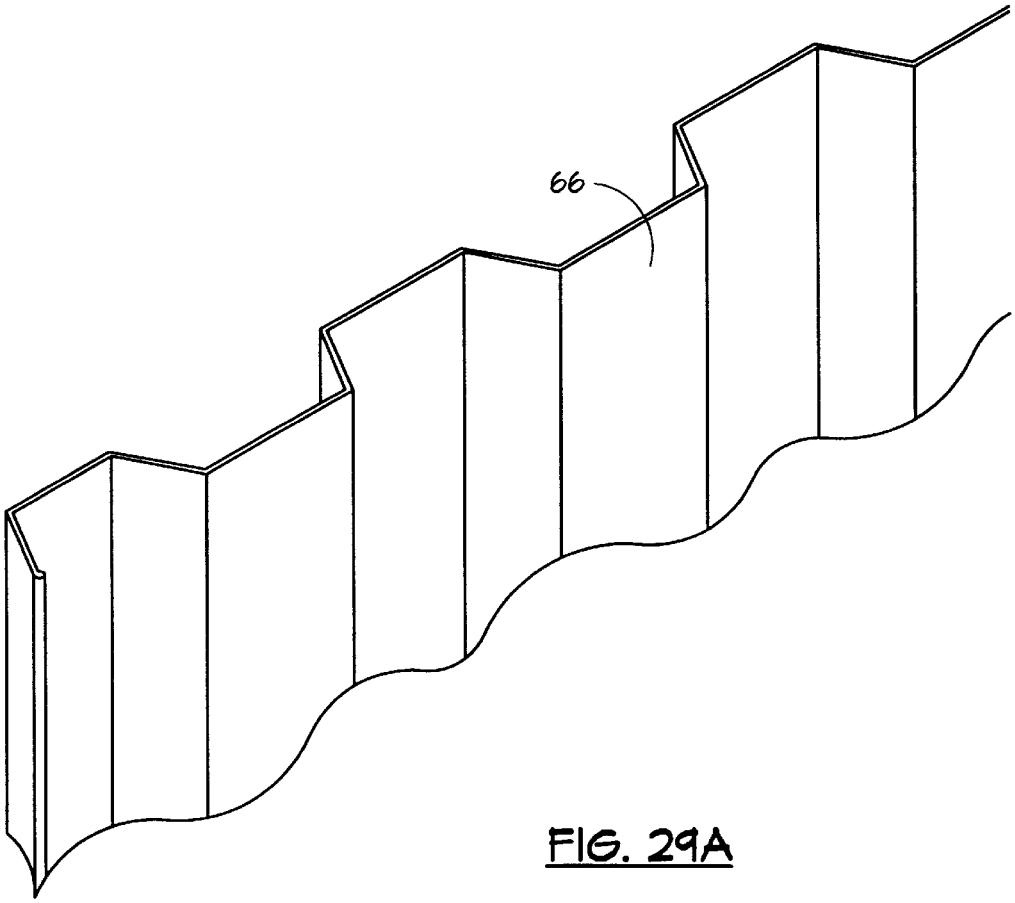
FIG. 29A is a perspective view of a corrugated steel sheet.

FIG. 29A shows a perspective view of the top part of a corrugated steel sheet 66, in between corrugated handle plates 64.

Figure 29B:
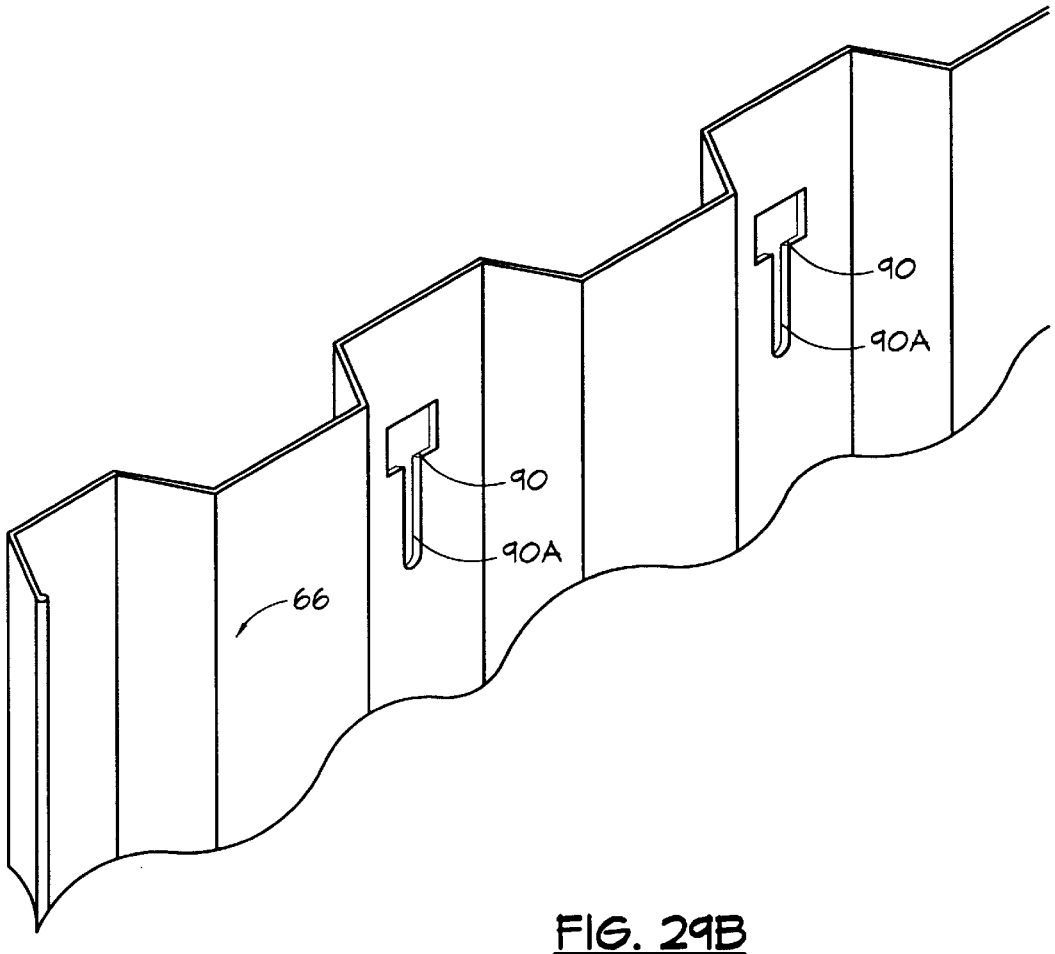

FIG. 29B shows the tee slot opening 90 and tee slots 90A punched into the corrugated steel sheet 66.

Figure 29C:
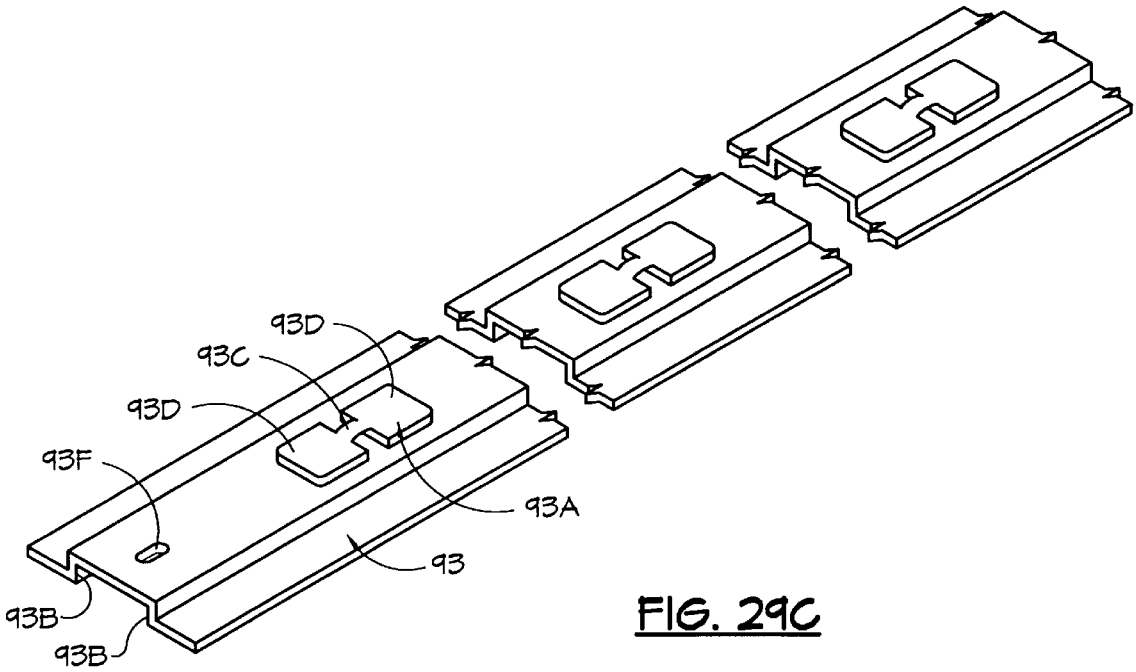

FIG. 29C shows a perspective view of a tee bar 93 with tee hooks 93A. The tee bar 93 has small right angle bends at the stiffen bends 93B in order to strengthen and stiffen the tee bar 93. The tee hooks 93A are punched out and bent up from a center pivot 93C. This cut and bend forms tee wings 93D. The tee hooks 93A are spaced on the tee bar 93 at the same intervals as tee slots 90A are spaced on the corrugated steel sheet 66.

Figure 29D:
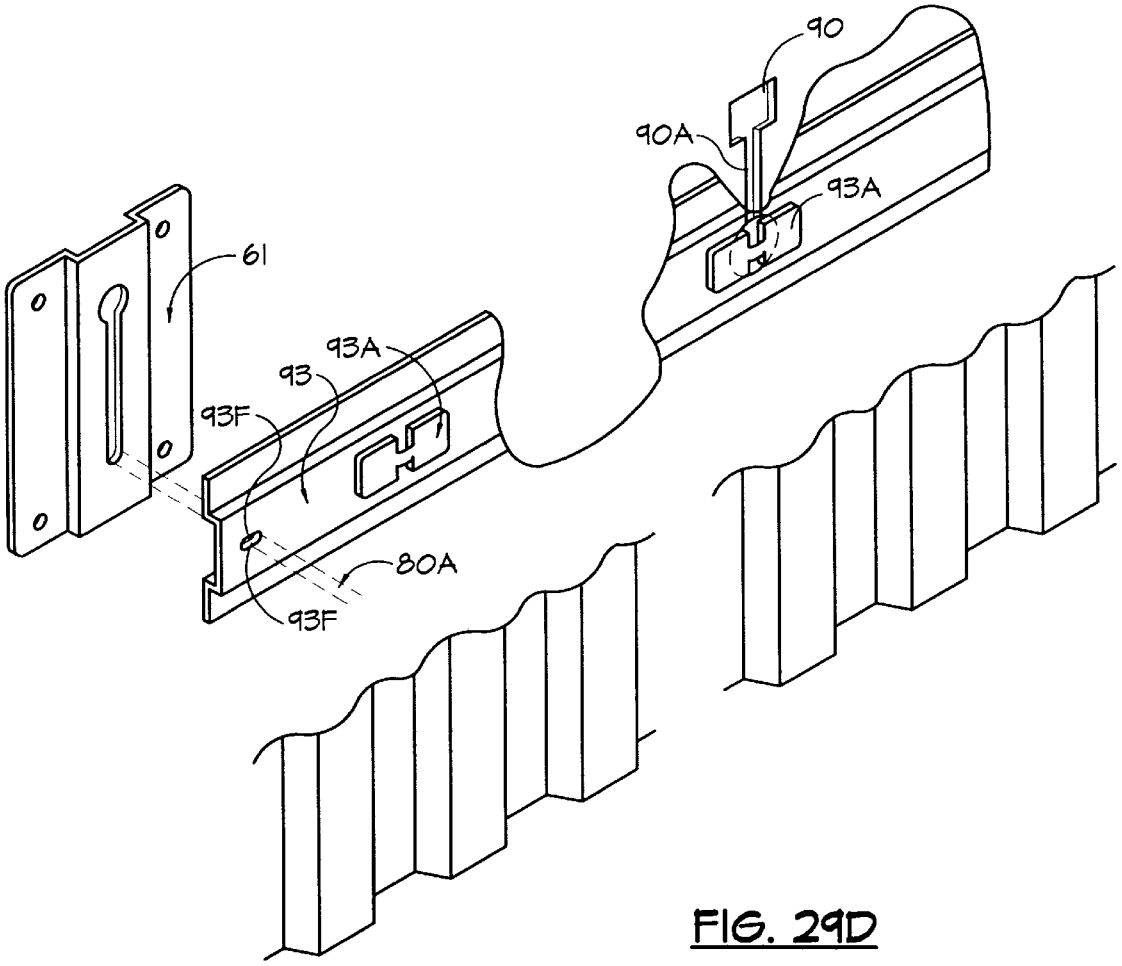

FIG. 29D shows how the tee bar 93 is slid behind the corrugated steel sheet 66 and the tee hooks 93A are placed into the tee slot opening 90 and slid down into the tee slot 93A. The tee bar 93 is locked to the corrugated steel sheet 66, and the tee bar 93 is locked to the wall by a carriage bolts 80A from a sliding latch 61 through a bolt hole 93F and locked to the corrugated steel sheet 66 by a wingnut 62 (not shown). The tee bar 93 is excellent for large windows as the tee bar 93 helps stiffen the corrugated steel sheet 66. FIG. 1B shows how the tee bar 93 works on the shutter cover 1 and how it locks together with a locking latch 69 and metal rod 74 into a slave lock 72.

What is claimed is:

1. A shutter assembly for protecting a structure having walls comprising:

a shutter cover;

a plurality of hinges each comprising a planar web and a hook normal to and extending from said web;

each of said hooks comprising an arcuate upper portion having an end and an opposing arcuate lower portion having an end so arranged that a gap of a predetermined width is formed between the ends of said upper and lower portions;

one of said hinges being attached to said shutter cover so that said hook extends beyond an upper edge of said shutter cover;

another of said hinges being attached to said shutter cover adjacent to said one of said hinges, and whereby said hook of said another of said hinges extends parallel to said hook of said one of said hinges and each extends beyond the upper edge of said shutter cover;

a plurality of latches being attachable to said structure wall in an arrangement defining an outer perimeter of said shutter cover, each of said latches defining a slot that receives a fastener;

a plurality of stationary receiving brackets, each receiving one of said respective fasteners within a slot of said brackets, and each of said brackets being attachable to said structure in a predetermined location so that said shutter cover hangs in a vertical manner; and each of said fasteners projecting from its respective slot through said shutter cover thereby securing said shutter cover to said latches.

2. The shutter assembly as claimed in claim 1, wherein said fasteners further comprise:

a bolt having a head to be received in said slot of said latch; and a wingnut threaded on said bolt.

3. The shutter assembly as claimed in claim 1, wherein said stationary receiving bracket further comprises:

a first and second web;

a receiving ledge attached between said first and second web such that said receiving ledge is perpendicular to said first and second web, thereby allowing its respective hook to be received.

4. The shutter assembly as claimed in claim 1 further comprising a lock rod, said lock rod having a first receiving tab on a lower edge of said shutter cover and a second receiving tab adapted to be mounted on said structure wall so that said shutter cover hangs vertically in a locked position.

5. The shutter assembly as claimed in claim 4, wherein said lock rod further comprises:

said first tab having an opening extending normally from the surface of said shutter cover;

a second tab having an opening adapted to extend normally from the surface of said structure wall; and said lock rod simultaneously penetrating each tab forming a lock.

6. The shutter assembly as claimed in claim 5 further comprising:

a first receiving tab having a hole;

a second receiving tab having a hole parallel to said first receiving tab for attachment to the structure wall such that a lock may be connected between said holes; and a dog-ear on an end of said lock rod such that said dog-ear projects between said tabs under said padlock.

* * * * *